US009601256B2

(12) United States Patent
Nakanoue et al.

(10) Patent No.: US 9,601,256 B2
(45) Date of Patent: Mar. 21, 2017

(54) WOUND IRON CORE FOR STATIC APPARATUS, AMORPHOUS TRANSFORMER AND COIL WINDING FRAME FOR TRANSFORMER

(71) Applicant: Hitachi Industrial Equipment Systems Co., Ltd., Tokyo (JP)

(72) Inventors: Kenji Nakanoue, Tainai (JP); Kazuyuki Fukui, Tainai (JP); Hidemasa Yamaguchi, Tainai (JP); Kouhei Satou, Tainai (JP); Tatsuhito Azegami, Shibata (JP); Makoto Shinohara, Nagano (JP); Toshiaki Takahashi, Tainai (JP); Tooru Honma, Shibata (JP); Masanao Kuwabara, Tainai (JP); Toshiki Shirahata, Shibata (JP); Yuuji Satou, Mie-ken (JP); Manabu Dohi, Tainai (JP); Ryosuke Mikoshiba, Shibata (JP); Hiroyuki Endou, Agano (JP)

(73) Assignee: HITACHI INDUSTRIAL EQUIPMENT SYSTEMS CO., LTD., Tokyo (JP)

( * ) Notice: Subject to any disclaimer, the term of this patent is extended or adjusted under 35 U.S.C. 154(b) by 81 days.

(21) Appl. No.: 14/512,078

(22) Filed: Oct. 10, 2014

(65) Prior Publication Data

US 2015/0028977 A1 Jan. 29, 2015

Related U.S. Application Data

(62) Division of application No. 13/057,873, filed as application No. PCT/JP2009/064859 on Aug. 26, 2009, now Pat. No. 9,013,263.

(30) Foreign Application Priority Data

Sep. 3, 2008 (JP) ..... 2008-225646
Oct. 28, 2008 (JP) ..... 2008-277003
(Continued)

(51) Int. Cl.
*H01F 27/26* (2006.01)
*H01F 27/06* (2006.01)
(Continued)

(52) U.S. Cl.
CPC ..... *H01F 27/25* (2013.01); *H01F 27/06* (2013.01); *H01F 27/245* (2013.01);
(Continued)

(58) Field of Classification Search
CPC ..... H01F 5/00; H01F 27/28
(Continued)

(56) References Cited

U.S. PATENT DOCUMENTS 1,942,164 A 1/1934 Frohlich et al.
3,662,308 A * 5/1972 Muschong ..... H01F 27/25 336/210
(Continued)

FOREIGN PATENT DOCUMENTS

CN 1702783 A 11/2005
JP 42-012186 Y1 7/1967
(Continued)

OTHER PUBLICATIONS

Non-Final Office Action U.S. Appl. No. 13/057,873 dated Apr. 17, 2013.
(Continued)

*Primary Examiner* — Tsz Chan
(74) *Attorney, Agent, or Firm* — McDermott Will & Emery LLP

(57) ABSTRACT

Disclosed is a wound iron core (3) for a static apparatus in which magnetic paths in the inside of the wound iron core are subdivided to improve iron core characteristics. The iron core (3) is configured by using two or more kinds of magnetic materials (11 to 14) with different magnetic permeabilities to form laminated blocks with single plates or a plurality of laminated plates and by alternately arranging the laminated blocks with different magnetic permeabilities from the inner circumference. An iron core material (14) with large magnetic permeability out of iron core materials with different magnetic permeabilities is arranged on the inner circumference side. Further, when the iron core materials with different magnetic permeabilities are alternately arranged, the iron core materials (11) with the same magnetic permeability are configured to gradually change in thickness to ease an excessive magnetic flux density distribution in the iron core. A ring-shaped iron core is configured such that a plurality of block-like laminated members, which are each formed by laminating a plurality of strip-like amorphous material thin plates, are laminated and formed into a ring shape and a sheet-like non-magnetic insulation material is arranged between the n-th (n: an integer of two or more) layer of the ring-shaped block-like laminated members from the most inner circumference side and the (n+1)-th layer of the ring-shaped block-like laminated members from the most inner circumference side.

4 Claims, 51 Drawing Sheets

(30) Foreign Application Priority Data

| | | |
|---|---|---|
| Nov. 5, 2008 | (JP) | 2008-283855 |
| Nov. 11, 2008 | (JP) | 2008-288689 |
| Mar. 11, 2009 | (JP) | 2009-057753 |
| Jul. 24, 2009 | (JP) | 2009-173084 |

(51) Int. Cl.

| | |
|---|---|
| ***H01F 27/02*** | (2006.01) |
| ***H01F 27/30*** | (2006.01) |
| ***H01F 27/25*** | (2006.01) |
| ***H01F 27/245*** | (2006.01) |
| *H01F 27/32* | (2006.01) |
| *H01F 27/34* | (2006.01) |
| *H01F 3/10* | (2006.01) |

(52) U.S. Cl.
CPC ..... *H01F 27/306* (2013.01); *H01F 27/324* (2013.01); *H01F 27/34* (2013.01); *H01F 2003/106* (2013.01)

(58) Field of Classification Search
USPC ..... 336/65, 66–68, 92, 185, 196, 197, 199, 336/208, 210
See application file for complete search history.

(56) References Cited

U.S. PATENT DOCUMENTS

| | | | | |
|---|---|---|---|---|
| 5,138,393 | A | 8/1992 | Okamura et al. | |
| 5,226,222 | A | 7/1993 | Hanaoka et al. | |
| 5,337,034 | A * | 8/1994 | Grimes | H01F 27/06 248/300 |
| 5,619,174 | A | 4/1997 | Kimura et al. | |
| 6,005,468 | A | 12/1999 | Shirahata et al. | |
| 6,931,713 | B2 | 8/2005 | Roshen | |
| 7,369,027 | B2 | 5/2008 | Choi et al. | |
| 2002/0057180 | A1 * | 5/2002 | Shirahata | H01F 30/12 336/213 |
| 2005/0280491 | A1 | 12/2005 | Yamashita et al. | |
| 2008/0036565 | A1 | 2/2008 | Yamashita et al. | |

FOREIGN PATENT DOCUMENTS

| | | | | |
|---|---|---|---|---|
| JP | 50-37369 | | | 12/1975 |
| JP | 51-004992 | A | | 1/1976 |
| JP | 55-88210 | | | 6/1980 |
| JP | 56-118306 | A | | 9/1981 |
| JP | 60-169821 | U | | 11/1981 |
| JP | 56-169696 | U | | 12/1981 |
| JP | 57-143808 | | | 9/1982 |
| JP | 58-27917 | U | | 2/1983 |
| JP | 58-32609 | | | 3/1983 |
| JP | 61-180408 | | | 8/1986 |
| JP | 01-123315 | U | | 8/1989 |
| JP | 02-021719 | U | | 2/1990 |
| JP | 04-356906 | | | 12/1992 |
| JP | 05-029157 | A | | 2/1993 |
| JP | 06-120044 | | | 4/1994 |
| JP | 6-176933 | | | 6/1994 |
| JP | 07-161539 | A | | 6/1995 |
| JP | 07161539 | A | * | 6/1995 |
| JP | 10-027716 | | | 1/1998 |
| JP | 10-116719 | | | 5/1998 |
| JP | 10-270263 | | | 10/1998 |
| JP | 10-340815 | | | 12/1998 |
| JP | 10-340816 | A | | 12/1998 |
| JP | 11-135349 | A | | 5/1999 |
| JP | 11135349 | A | * | 5/1999 |
| JP | 2000-124044 | | | 4/2000 |
| JP | 2001-244121 | | | 9/2001 |
| JP | 2003-077735 | | | 3/2003 |
| JP | 2003-163124 | A | | 6/2003 |
| JP | 2003-303718 | | | 10/2003 |
| JP | 2004-103633 | A | | 4/2004 |
| JP | 2004-134681 | A | | 4/2004 |
| JP | 2004-253677 | A | | 9/2004 |
| JP | 2005-072161 | A | | 3/2005 |
| JP | 2005-159380 | | | 6/2005 |
| JP | 2006-173449 | | | 6/2006 |
| JP | 2006-179727 | A | | 7/2006 |
| JP | 2007-180135 | | | 7/2007 |

OTHER PUBLICATIONS

Non-Final Office Action U.S. Appl. No. 13/057,873 dated Jun. 25, 2013.
Final Office Action U.S. Appl. No. 13/057,873 dated May 7, 2014.
Office Action Indian Patent Application No. 798/DELNP/2011 dated Oct. 31, 2016.

* cited by examiner

105a

105b

WOUND IRON CORE FOR STATIC APPARATUS, AMORPHOUS TRANSFORMER AND COIL WINDING FRAME FOR TRANSFORMER

RELATED APPLICATIONS

This application is a Division of application Ser. No. 13/057,873, filed on Apr. 25, 2011, now U.S. Pat. No. 9,013,263, which is the U.S. National Phase under 35 U.S.C. §371 of International Application No. PCT/JP2009/064859, filed on Aug. 26, 2009, which in turn claims the benefit of Japanese Application Nos. 2008-225646, filed on Sep. 3, 2008, 2008-277003, filed on Oct. 28, 2008, 2008-283855, filed on Nov. 5, 2008, 2008-288689, filed on Nov. 11, 2008, 2009-057753, filed on Mar. 11, 2009, and 2009-173084, filed on Jul. 24, 2009, the disclosures of which Applications are incorporated by reference herein.

TECHNICAL FIELD

The present invention relates to the arrangement of (1) a static apparatus such as a transformer or a reactor, and specifically to the arrangement of an iron core, and also relates to (2) an iron core formed by laminating amorphous material thin plates, (3) an iron core for a transformer and (4) an amorphous iron core transformer equipped with an iron core protection member.

Further, the present invention relates to (5) a coil winding frame for a transformer around which the coil is wound, and (6) a shell-type amorphous transformer.

BACKGROUND ART

The prior art related to (1) a static apparatus according to the present invention is disclosed for example in patent document 1 (Japanese patent application laid-open publication No. 10-270263), which teaches stacking amorphous sheets having different magnetic characteristics to form an iron core. That is, patent document 1 teaches mixing together and using amorphous metals having different magnetic characteristics, but this improvement related to the magnetic characteristics merely reduces the variation of magnetic characteristics during the manufacturing process by combining materials of different material lots, and it does not consider solving the problem of concentration of magnetic flux to the inner circumference of the wound iron core, and thus, it is determined that the disclosed art does not exert any effect related to improving the concentrated status of magnetic flux.

Further, patent document 2 (Japanese patent application laid-open publication No. 2007-180135) teaches setting the magnetic permeability of an amorphous metal foil band layer disposed on the inner side to be lower than the magnetic permeability of the amorphous metal foil band layer disposed on the outer side.

In patent document 2, magnetic properties of the amorphous metal foil band layer are varied intentionally via annealing temperature characteristic to the amorphous metal foil band layer so as to set the magnetic permeability of the inner side of the wound iron core to be lower, so that the magnetic flux will flow more easily toward the outer side. Such effect is exerted by the amorphous metal receiving heat during annealing being micro-crystallized at the inner side by which the magnetic characteristics are varied. Therefore, the above effect cannot be achieved by annealing a wound iron core formed of magnetic steel sheets which are crystalline materials.

Patent document 3 aims at making the magnetic flux density distribution uniform by increasing the magnetic permeability at the outer circumference than the inner circumference based on a similar viewpoint as patent document 2. Such art is suitably applied to a wound iron core formed by laminating magnetic steel sheets.

Patent document 4 teaches a wound iron core formed by combining magnetic steel sheets and amorphous metal thin sheets. However, when the magnetic permeabilities of the materials are compared, the permeability of the magnetic steel sheet is approximately 0.1 H/m while that of the amorphous metal thin sheet is approximately 0.6 H/m. Therefore, as long as there is such difference in magnetic permeabilities, magnetic flux will not flow in the same manner through the magnetic steel sheets and the amorphous metal thin sheets, and magnetic flux will concentrate on the amorphous metal thin sheets in the magnetic flux density range used in the magnetic steel sheets (approximately 1.5 to 1.7 T), which is in the saturation magnetic flux density area of the material, so that the magnetic characteristics is deteriorated even further by such combination. In contrast, magnetic flux will concentrate on the amorphous metal thin sheets in the amorphous metal thin sheet range (approximately 1.2 to 1.3 T), so that the magnetic characteristics is deteriorated even further by such combination. Thus, the method disclosed in patent document 4 does not improve the magnetic characteristics at all.

Further, patent document 5 (Japanese patent application laid-open publication No. 2000-124044) discloses an example of the prior art related to (2) an amorphous iron core according to the present invention. Patent document 5 discloses a low-noise transformer comprising a ring-shaped iron core 1, wherein a sound-absorbing material 3 and a vibration isolating material 4 are arranged at contact part positions of the iron core and covering the whole iron core.

Further, patent document 6 (Japanese patent application laid-open publication No. 06-176933), patent document 7 (Japanese patent application laid-open publication No. 2006-173449) and patent document 8 (Japanese patent application laid-open publication No. 61-180408) discloses prior arts related to (3) an iron core for a transformer according to the present invention. Patent document 6 discloses an amorphous-wound iron core formed by winding amorphous magnetic material-formed thin bands in multilayers to form a magnetic material unit and further laminating a plurality of magnetic material units, wherein the displacement between adjacent magnetic material layers at butted portions between both ends of the respective magnetic material layers is set to be greater in the magnetic material unit disposed on the inner circumference side of the amorphous wound iron core than the magnetic material unit disposed on the outer circumference side thereof, wherein the butted portion (connecting section) of the ends is disposed on the short side of the rectangular wound iron core. Patent document 7 teaches a wound iron core for a transformer formed in a ring shape by laminating plate magnetic materials in multiple layers, wherein the overlapped portions of both ends of the plate magnetic materials are disposed on a long side of the rectangular wound iron core, and patent document 8 teaches a wound iron core for a stationary induction electric apparatus formed of an amorphous ribbon (amorphous thin band), wherein connecting sections (butted portions) at both ends of the laminated blocks formed by laminating multiple layers of amorphous ribbons are disposed on a long side of the rectangular wound iron core.

Patent document 9 (Japanese patent application laid-open publication No. 10-27716) discloses another prior art related to the present invention. Patent document 9 discloses an amorphous wound iron core transformer, wherein a laminated surface of a U-shaped core part consisting of a first yoke part of the wound core and first and second leg parts is covered by a U-shaped cover, a resin coated layer is formed covering the entire laminated surface of the yoke part, and a yoke cover is adhered to the laminated surface of a yoke part using the resin which forms the resin-coated layer, in order to prevent the leaking out of the broken pieces of a core.

Further, patent document 10 (Japanese patent application laid-open publication No. 10-340815) discloses another prior art related to the present invention. Patent document 10 discloses an amorphous wound iron core transformer in which square pipe-like bobbin members are used as coil winding frames.

It further relates to (4) iron core protection of an amorphous iron core transformer, wherein the amorphous iron core transformer is formed by winding an amorphous iron core covered with insulation material around a coil and wrapping both ends of the coil. FIG. 30 is a perspective view showing the state of wrapping an amorphous iron core according to the prior art. According to the prior art iron core wrapping method, a jig 85 for ensuring work space (work space for winding insulation material around the iron core) is disposed below the amorphous iron core 82*a*, and the jig 85 is gradually moved so as to perform wrapping operation for wrapping the amorphous iron core 82*a* with insulation materials 84*a* and 84*b*. Thereafter, the amorphous iron core 82*a* wrapped via insulation materials 84*a* and 84*b* is moved from the work table and inserted to a coil, and then both ends of the amorphous iron core 82*a* are joined to each other on a rotation device.

FIG. 31 is a perspective view showing a prior art structure in which a coil 83*a* is inserted to an amorphous iron core 82*a* and the amorphous iron core 82*a* is joined, and then the joint portion is wrapped. The illustrated arrangement requires insulation members 86*a* and 86*b* to ensure an insulation distance between the amorphous iron core 82*a* and the coil 83*a*. The insulation materials 86*a* and 86*b* are disposed so as to cover at least the part of the surface of the amorphous iron core 82*a* inserted to the coil 83*a*.

According to this method, however, the wrapping operation is performed while moving the jig 85, and the size of the amorphous iron core is increased as the capacity of the transformer increases, so that the number of required jigs 85 increases, and the work time regarding the jig 85 such as the time required for moving the jig 85 is extended. Further, the number of operation steps is increased since an operation to move the amorphous iron core from the wrapping work table to the rotation device becomes necessary, and the number of insulation members is also increased, so that the overall costs for manufacturing the amorphous iron core transformer are increased.

Patent document 11 discloses an amorphous core transformer and its manufacturing method, which prevents amorphous fragments from being scattered inside a coil and preventing the amorphous fragments from being dispersed into an insulation oil during assembly of the transformer by inserting a coil in the amorphous iron core. Further, patent document 12 discloses an arrangement in which reinforcement members are provided to a yoke of an amorphous wound iron core so as to suppress the deformation of the iron core.

Further, it relates to (5) a coil winding frame for a transformer according to the prior art, wherein one or a plurality of coil winding frames having a rectangular shape are arranged along a width direction of the wound iron core material.

Further, patent document 13 (Japanese patent application laid-open publication No. 10-340815) teaches a prior art related to the present invention. Patent document 13 discloses an amorphous wound iron core transformer in which a coil winding frame composed of a winding frame member is disposed on an innermost circumference of the coil. The outermost wound iron core comprises a reinforcement frame surrounding the wound iron core and pressing an outer side of the coil to which the wound iron core is inserted.

When such transformer is applied to large-capacity transformers, the iron core must have a large cross-sectional area, but even according to an arrangement in which multiple coil winding frames are arranged along the width direction of the iron core, the electromagnetic mechanical force applied to the inner side of the inner winding wire generated during short circuit causes the coil winding frame to be buckled toward the inner side and dented (refer to FIG. 40), by which the iron core is pressed, leading to deterioration of excitation current and iron loss.

Further, patent document 14 (Japanese utility model publication No. 58-32609) teaches a bobbin shape used in discharge stabilizers or the like in which a substantially mountain-shaped thickness portion in which the thickness is greatest at the center is formed on respective sides of a coil winding section having a square pipe-like shape, having an enhanced durability against deformation during winding since the strength is enhanced at the center section. According to the taught arrangement, only the center area of the respective sides has increased thickness, so that the manufacturing of such coil winding unit requires much work and uses a large amount of materials, so that the costs related thereto are high.

Patent document 15 (Japanese utility model publication 55-88210) teaches an electromagnetic coil in which a center area of surrounding surfaces of a center cylinder section of a coil-winding bobbin with a fringe has greater thickness, so that the respective surrounding surfaces are protruded outward in an arched shape, wherein the lowermost layer of the coil is wound around the center cylinder section so as to contact the respective surrounding surfaces in a uniform manner in order to prevent displacement of the coil. Since only the center section of the respective sides is formed to be thicker, it has the same drawbacks as patent document 14.

Patent document 16 (Japanese patent application laid-open publication No. 10-116719) teaches a voltage electromagnet device of a wattour meter, wherein each surface in the side of the hollow hole of the coil winding frame portion is expanded outward in an arch shape, so that the expanded portion has an arch effect preventing the coil winding frame portion from deforming to the inner side even when winding force is applied by winding the winding wire thereto. The coil winding frame portion is expanded in an arched shape, so that the design thereof is restricted.

Further, a shell-type amorphous mold transformer having a three-phase five-leg wound iron core structure has been used in the prior art as (6) a transformer for receiving and distributing high pressure. Such amorphous transformer with a three-phase five-leg wound iron core structure is equipped with a coil and an amorphous iron core having legs inserted to the coil, wherein the two legs disposed on the outermost side of the five legs of the amorphous iron core are arranged on the outer side than the coil.

A shell-type amorphous transformer capable of ensuring short strength of the outer winding wire and protecting the iron core from deformation of the coil inserted to the iron core has been proposed. According to such amorphous transformer, the legs of the iron core is stored in an iron core cover formed of iron and having rigidity, thereby preventing deformation or damage of the amorphous iron core caused by the deformed coil approximating or contacting the iron core (refer to patent document 17, Japanese patent application laid-open publication No. 2001-244121).

FIG. 45 is an explanatory view showing one example of such shell-type amorphous transformer, wherein FIG. 45A shows three-phase five-leg amorphous wound iron cores 110 and 111, FIG. 45B shows iron core covers 110*a* and 111*a* for the amorphous wound iron cores, and FIG. 45C shows three-phase five-leg amorphous wound iron cores equipped with the iron core covers as shown in FIG. 45A. Reference 53 denotes a laminated thickness of the iron core, and 111*c* denotes leg portions of the outer iron core. According to this arrangement, however, the iron core covers 110*a* and 111*a* cause the dimensions of the secondary coil, the primary coil and the iron cores 110 and 111 to be increased, and the dimension and the weight of the main body of the transformer to be increased thereby, so that along with the increase of material costs of the iron core covers 110*a* and 111*a* and the increase of number of assembly steps, the costs of the transformer are increased, so that improvement is required from the viewpoint of costs.

Further, an iron core protection case has been proposed to protect the iron core in an amorphous transformer having an amorphous iron core with extremely low rigidity. The iron core protection case itself is formed as a frame body surrounding the leg portions of the iron core on the outermost side, and a slit opening is formed on a surface parallel with a side surface of the coil, for example, so as not to form a turn. However, during operation of the transformer, it is difficult to prevent the generation of multiple current loops passing through the iron core protection case caused by the linkage with a main flux Ø, and such current loops have high resistance since it flows in mid flow in the laminating direction of the amorphous ribbons, and though the current flow will not burn the brackets since the current is small, no-load loss is increased thereby. Therefore, an amorphous transformer is proposed capable of preventing increase of no-load loss by breaking the current loop generated in a core protection case, by providing an insulating material between a core or a bracket used in the transformer and the conductive material member in the iron core protection case (patent document 18, Japanese patent application laid-open publication No. 2003-77735).

CITED REFERENCES

Patent Documents

[Patent document 1] Japanese patent application laid-open publication No. 10-270263
[Patent document 2] Japanese patent application laid-open publication No. 2007-180135
[Patent document 3] Japanese patent application laid-open publication No. 6-120044
[Patent document 4] Japanese patent application laid-open publication No. 57-143808
[Patent document 5] Japanese patent application laid-open publication No. 2000-124044
[Patent document 6] Japanese patent application laid-open publication No. 06-176933
[Patent document 7] Japanese patent application laid-open publication No. 2006-173449
[Patent document 8] Japanese patent application laid-open publication No. 61-180408
[Patent document 9] Japanese patent application laid-open publication No. 10-27716
[Patent document 10] Japanese patent application laid-open publication No. 10-340815
[Patent document 11] Japanese patent application laid-open publication No. 2005-159380
[Patent document 12] Japanese patent application laid-open publication No. 2003-303718
[Patent document 13] Japanese patent application laid-open publication No. 10-340815
[Patent document 14] Japanese utility model publication No. 58-32609
[Patent document 15] Japanese utility model publication No. 55-88210
[Patent document 16] Japanese patent application laid-open publication No. 10-116719
[Patent document 17] Japanese patent application laid-open publication No. 2001-244121
[Patent document 18] Japanese patent application laid-open publication No. 2003-77735

SUMMARY OF THE INVENTION

Problem to be Solved by the Invention (1) An external view of a pole-mounted transformer is shown in FIG. 2 as a typical example of a static apparatus, wherein a partial cross-sectional view is shown to illustrate the inside thereof. Reference number 1 denotes a whole body of a pole-mounted transformer, 2 denotes a winding wire, 3 denotes a wound iron core, 4 denotes a main body casing of a transformer, 5 denotes a top of the main body casing, 6 denotes a content fixture bracket, 7 denotes an iron core engagement bracket for fixing the wound iron core, and 8 denotes a primary bushing. The main body casing and top member of the pole-mounted transformer is generally formed of iron having a coating applied on the surface thereof. Further, the wound iron core 3 adopted in the pole-mounted transformer 1 is arranged as shown in FIG. 3.

FIG. 4 is a ¼ cut view of the wound iron core 3, showing the magnetic flux density distribution of the interlinkage portion with the winding wire (hereinafter referred to as a leg portion).

Generally, the magnetic flux passing through the inside of the wound iron core tends to concentrate on the inner circumference side where the magnetic path is short, and therefore, the magnetic flux is uneven across the cross section of the iron core.

When the magnetic flux concentrates on the inner circumference side of the wound iron core, loss is increased.

The object of the present invention is to provide an iron core with an arrangement preventing the magnetic flux distribution from concentrating on the inner circumference side of the wound iron core and to enable substantially uniform distribution across the iron core.

Further, regarding (2) an amorphous iron core, the prior art merely aimed at reducing the noise of the transformer, and did not consider reducing iron loss of the iron core or preventing deterioration of the magnetic characteristics during annealing when the iron core is an amorphous iron core. In other words, when the iron core is excited, magnetic flux tends to concentrate to the inner circumference side of the iron core, and when magnetic flux concentrates on the inner circumference side, magnetic saturation or increase of magnetic resistance occurs on the inner circumference side, and as a result, the magnetic circuit characteristics are deteriorated and hysteresis loss is increased, along with which waveform distortion of primary coil current and secondary coil current occurs. Further, eddy current loss also tends to increase in the iron core. Moreover, if the iron core is an amorphous iron core, when crystallization advances by heat during annealing and brittleness increases, minute breakage occurs within the iron core deteriorating the magnetic characteristics, and stress is caused by the difference between thermal expansion coefficients between the iron core and the jig for preventing deformation fixed to the outer circumference side or the inner circumference side of the iron core during annealing, and as a result, magnetic characteristics of the iron core are deteriorated.

In light of such problems of the prior art, the present invention aims at solving the problems of an amorphous iron core transformer, such as the concentration of magnetic flux in a certain area in the magnetic circuit cross section, the increase of eddy current loss, and the stress caused by the difference in thermal expansion coefficients between the core and the jig for preventing deformation during annealing.

Further, regarding (3) a transformer iron core, the amorphous wound iron core taught in Japanese patent application laid-open publication No. 06-176933 has butted portions (connecting sections) of respective ends of the magnetic material layers disposed on the short side of the rectangular wound iron core, so that the amount of displacement of the butted portions in the magnetic circuit direction between adjacent magnetic material layers cannot be increased within the respective magnetic material units, so that a large number of magnetic material units must be stacked in order to ensure a predetermined cross-sectional area of the iron core. Therefore, in such amorphous wound iron core, the work performance for forming the butted portions (joint portions) is deteriorated, and since the area occupation rate of the iron core in the short side section is reduced, the magnetic resistance of the magnetic circuit is increased. Further, since the magnetic flux in the short side section flows by transiting to adjacent magnetic material layers in short pitches, the magnetic flux flow is not smooth. Thus, the magnetic resistance of the magnetic circuit is further increased. In the wound iron cores disclosed in Japanese patent application laid-open publications No. 2006-173449 and No. 61-180408, though the butted portions of respective ends of the plate-shaped magnetic materials or the connecting sections (butted portions) of the respective ends of the laminated blocks are disposed on the long side of the rectangular wound iron core, they are disposed within a length range shorter than the length of the short side of the rectangular wound iron core, so that the magnetic resistance of the magnetic circuit of the long side is increased similar to the case of the amorphous wound iron core disclosed in Japanese patent application laid-open publication No. 06-176933. According further to the disclosed arrangement, the flow of magnetic flux in the long side is not smooth, and thus, the magnetic resistance of the magnetic circuit is increased further. Moreover, the workability for forming the butted portions (connecting sections) is not good.

According to the art disclosed in Japanese patent application laid-open publication No. 10-27716, the iron core is covered via a U-shaped cover or a resin coating layer, so that the workability during manufacturing of the iron core is considered to be not good.

According to the art disclosed in Japanese patent application laid-open publication No. 10-340815, it is considered that the winding frame member itself must have high reinforcing strength.

In consideration of the above-described prior art, the present invention aims at providing an iron core for a transformer formed by laminating magnetic thin plates having improved workability for connecting the leading ends and rear ends in the longitudinal direction of the blocks formed by laminating multiple magnetic thin plates during manufacturing, and suppressing the increase of magnetic resistance of the magnetic circuit.

The present invention also aims at solving the problems of the prior art by providing an iron core for a transformer formed by laminating amorphous material thin plates, capable of preventing scattering of fragments of the iron core via a simple configuration.

The present invention also aims at solving the problems of the prior art by providing a transformer exciting the iron core formed by laminating magnetic material thin plates via a coil, capable of reinforcing the coil via a simple arrangement.

The object of the present invention is to solve the problems of the prior art mentioned above by providing a transformer manufactured easily and ensuring superior performance and reliability.

Further, the present invention relates to (4) iron core protection of an amorphous iron core transformer, providing an amorphous iron core transformer capable of simplifying the wrapping operation for wrapping the amorphous iron core with a protection member without using jigs, and ensuring an insulation distance between the amorphous iron core and the coil without using an insulation member.

The object of the present invention is to solve the problems of the prior art mentioned above by providing an amorphous iron core transformer capable of reducing work time and number of insulation members, capable of performing a wrapping operation for wrapping the amorphous iron core with a protection member without using jigs, ensuring an insulation distance between the amorphous iron core and the coil without using insulation members and reducing manufacturing costs.

Further, the problem to be solved regarding (5) a coil winding frame for a transformer is to provide a coil winding frame for a transformer disposed on the innermost circumference of the inner winding wire and a transformer using the same, wherein the strength is improved so as to prevent buckling that may apply pressure to the iron core.

The object of the present invention is to provide a coil winding frame for a transformer and a transformer using the same, capable of ensuring buckling strength of the inner winding wire in a transformer, preventing pressure from being applied to the iron core and preventing deterioration of excitation current and iron loss.

Further, regarding (6) an outer iron side amorphous transformer, the vibration caused during transportation or the like may cause the outer side of an outer iron core leg portion of the amorphous iron core to approximate or contact the high pressure coil, and when such approximation or contact occurs, insulation failure may occur during use of the transformer. Therefore, in a shell-type amorphous transformer or upon eliminating the iron core cover so as to downside the transformer, cut down material costs and number of manufacturing steps, a structure is required to prevent the outer iron core leg portion from approximating or contacting the high pressure coil.

The object of the present invention is to provide an economical amorphous transformer capable of utilizing a side bracket constituting an existing load supporting member to ensure a certain distance between the primary coil and the outer iron core leg portion so as to solve the problem of the outer iron core leg portion approximating or contacting the high pressure coil.

Means for Solving the Problem

The present invention relates to (1) an iron core for a static apparatus, wherein in order to achieve the above objects, the present invention provides an iron core comprising laminated blocks formed by laminating one or a plurality of plates using two or more kinds of magnetic materials with different magnetic permeabilities, wherein laminated blocks with different magnetic permeabilities are arranged alternately from an inner circumference.

As described, by using magnetic materials with different magnetic permeabilities, magnetic flux will flow easily through the material having a high magnetic permeability, while magnetic flux will not flow easily through the material having a low magnetic permeability.

Therefore, when materials having high and low magnetic permeabilities are arranged regularly, magnetic flux will not concentrate on the inner circumference side of the iron core having a short magnetic path, and therefore, the magnetic flux is uniformized.

Further, the wound iron core is annealed to remove the stress generated during molding of the magnetic materials.

Further, in order to solve the problems of (2) an amorphous iron core, the present invention provides an amorphous iron core transformer comprising a ring-shaped iron core having multiple layers of block-like laminated members formed by laminating a plurality of strip-like amorphous material thin plates, having a sheet-like non-magnetic insulation material disposed between an nth (n being a integer of two or more) layer of ring-shaped block-like laminated members from an innermost circumference side and an (n+1) -th layer of block-like laminated members.

In order to solve the problems of (3) a transformer iron core, the present invention provides (1) a transformer comprising a ring-shaped rectangular iron core having blocks formed by laminating a plurality of strip-like magnetic material thin plates laminated for a plurality of layers, wherein respective leading end portions and rear end portions in the longitudinal direction of the plurality of blocks are connected, and a coil wound around one side of the two long sides of the rectangular iron core, wherein the iron core has a plurality of connecting sections formed by the leading end portions and the rear end portions of the plurality of blocks disposed on the other of the two long sides, with the connecting sections arranged at mutually displaced positions in the longitudinal direction of the other long side between adjacent blocks, and wherein the plurality of connecting sections of all the blocks are arranged in a dispersed manner along the other long side across a range longer than a linear length of the short side of the iron core.

(2) Regarding (1), the iron core is formed so that the plurality of connecting sections are arranged in a dispersed manner along the linear portion of the other long side across a range longer than 1.3 times the length of the linear portion of the short side of the iron core.

(3) Further regarding (1), the iron core is formed so that the plurality of connecting sections are arranged in a dispersed manner along the linear portion of the other long side across a range longer than 50% the length of the linear portion.

(4) In one of (1) through (3) mentioned above, the iron core is formed so that the block forming the inner circumference side portion of the iron core has a larger number of laminated layers of magnetic material thin plates in a block than the block forming the outer circumference side portion of the iron core.

(5) The invention further provides a transformer comprising a ring-shaped rectangular iron core having blocks formed by laminating a plurality of strip-like magnetic material thin plates laminated for a plurality of layers and constituting a single unit, wherein a plurality of units are laminated, and respective leading end portions and rear end portions in the longitudinal direction of the plurality of blocks are connected in each of the plurality of units, and a coil wound around one of the two long sides of the rectangular iron core, wherein the iron core has a plurality of connecting sections formed by the leading end portions and the rear end portions of the plurality of blocks in the plurality of units disposed on the other of the two long sides, with the connecting sections arranged at mutually displaced positions in the longitudinal direction of the other long side between adjacent blocks, and wherein the plurality of connecting sections of the blocks of the plurality of units being arranged in a dispersed manner along the other long side across a range longer than a linear length of the short side of the iron core.

(6) Further regarding (5), the iron core is formed so that the unit forming the inner circumference side portion of the iron core has a smaller number of blocks per unit than the unit forming the outer circumference side portion of the iron core.

(7) Further regarding (5), the iron core is formed so that the unit forming the inner circumference side portion of the iron core has a larger number of laminated layers of magnetic material thin plates in a block than the unit forming the outer circumference side portion of the iron core.

(8) The present invention further provides a transformer comprising a ring-shaped iron core having a thermosetting or light curing coating applied on an end surface of the laminated layers.

(9) The present invention further provides a transformer having a ring-shaped iron core formed by laminating amorphous material thin plates, comprising an iron core having an outer surface covered with sheet-like thermosetting resin or pouched insulation material, and a coil wound around an outer side of the sheet-like thermosetting resin or pouched insulation material with respect to the iron core for exciting the iron core and generating inductive voltage.

(10) The present invention provides a transformer comprising an iron core formed by laminating amorphous material thin plates and formed in a ring shape, and a retention member disposed on an inner circumference side of an upper side or on an outer circumference side of a lower side of the iron core for retaining the iron core.

(11) The present invention further provides a transformer comprising a ring-shaped iron core having a plurality of plate-like magnetic materials laminated and constituting a magnetic circuit of the transformer, a cylindrical winding frame formed of nonmagnetic material, and a coil wound around the winding frame, passed through the winding frame and assembled thereto, wherein at least the portion of the iron core passed through the winding frame corresponds to a radius of curvature of an inner circumference surface of the winding frame, and the magnetic materials laminated on an inner circumference side and an outer circumference side of the iron core having a narrower plate width than the magnetic materials laminated on a center side.

(12) The present invention further provides a transformer having a ring-shaped iron core formed by laminating a plurality of magnetic thin plates, the transformer comprising a cylindrical winding frame formed of nonmagnetic material, a cylindrical coil wound around the winding frame, an iron core passed through the winding frame and excited via the coil, being divided into multiple parts both in the width direction and the laminated direction of the magnetic material within a cross section orthogonal to a magnetic circuit direction, wherein multiple divided cores constitute a plurality of independent magnetic circuits, and a plate-shaped reinforcement member arranged between divided cores and having both end surfaces thereof in contact with an inner circumference surface of the winding frame within the winding frame for reinforcing the coil.

The present invention further relates to (4) protection of the amorphous iron core, wherein in order to achieve the objects mentioned above, the present invention provides an amorphous iron core transformer formed of an amorphous material and having an iron core equipped with a box-shaped iron core protection member, and a coil inserted to the iron core, wherein the box-shaped iron core protection member is formed of an insulation member, and covers a whole body of the iron core to prevent fragments of the amorphous material from scattering.

According to the amorphous iron core transformer, the amorphous iron core is wrapped using a box-shaped iron core protection member, wherein the iron core protection member is formed of an insulation member and covering the whole body of the iron core without any clearance, so that fragments of the amorphous material constituting the iron core will not scatter within the interior of the transformer.

According to the present amorphous iron core transformer, the iron core protection member ensures a constant insulation distance between the amorphous iron core and the coil. Further, in the iron core wrapping operation, a contact surface with a work table during mounting operation to the iron core is composed of a single plate, and the connecting section between the iron core protection members generated when forming the iron core protection member in a box shape is disposed on a side surface, an inner surface of an iron core window or an upper surface of the transversely placed iron core. Furthermore, the iron core protection member covers an expanded section formed by temporarily expanding the joint portion of the iron core, and when the iron core is inserted to the coil with the expanded section placed at the leading end, the iron core protection member protects the expanded section of the iron core.

According further to the amorphous iron core transformer, the iron core protection member is formed so that a contact surface with a work table during mounting operation to the iron core is composed of a single plate, and the iron core protection member is fold-formed around the iron core so as to cover the whole body of the iron core together with the iron core window inner side protection member without any clearance. Moreover, the iron core protection member can be composed of a bottom surface protection member having a contact surface composed of a single plate in contact with a work table during mounting operation to the iron core, a contact surface protection member extending from the bottom surface protection member and disposed on a contact surface between the iron core and the coil, an iron core window inner surface protection member, and a joint portion side surface protection member disposed on a side surface of the joint portion of the iron core, wherein the iron core protection member is equipped with an insulation material for covering a surface of the iron core that cannot be covered by the iron core protection member. Furthermore, the iron core can be composed of a plurality of inner iron cores having outer curved portions on four corners, and an outer iron core surrounding the plurality of arranged inner cores from the outer side and having four inner curved corners fit to the outer curved portions of the inner iron cores, an inner iron core protection member covering the inner iron cores having overhanging portions overhung to the outer side on upper and lower surfaces corresponding to the outer curved portions of the inner iron cores, an outer iron core protection member covering the outer iron core having recessed portions on upper and lower surfaces recessed corresponding to the inner curved portions of the outer iron core, and the overhanging portions and the recessed portions are fit to each other without any clearance.

Further, in order to solve the problems of (5) a coil winding frame for a transformer, the present invention provides a coil winding frame for a transformer disposed on an innermost circumference of a coil into which an iron core is inserted, the coil winding frame having an enhanced strength with respect to buckling toward an inner side in a dented manner. Furthermore, the transformer according to the present invention is composed of a wound iron core in which magnetic strips are wound around the iron core or a laminated iron core in which magnetic strips are laminated in multiple layers, wherein the coil is inserted to the iron core, and the coil winding frame having improved strength against buckling toward the inner side in a dented manner is disposed on the innermost circumference of the coil.

Further, regarding (6) a shell-type amorphous transformer according to the present invention, the present invention provides a shell-type amorphous transformer, wherein a side bracket for connecting a lower bracket for receiving load of the coil and the amorphous iron core and an upper bracket having a lifting lug for suspending the transformer surrounds an outer iron core leg portion of the amorphous iron core together with an iron core retention member connected to the side bracket.

According to the present shell-type amorphous transformer, the amorphous iron core uses a side bracket for connecting a lower bracket for receiving load of the coil and the amorphous iron core and an upper bracket having a lifting lug for suspending the transformer, and surrounds the core with an iron core protection member such as an iron core retention member connected as a separate member to the side bracket, so that when the coil approximates and contacts the amorphous iron core during transportation or via deformation of the coil, the iron core protection member can protect the amorphous iron core.

According to the shell-type amorphous transformer, the side bracket is composed of a main face plate and two side face plates disposed along an outer side surface and both width-direction side surfaces of the amorphous iron core, and an insulating iron core support panel can be passed through a pair of or multiple pairs of holes formed at opposing areas of the both side face plates along an inner side wall of the amorphous iron core. Further, the side bracket can be composed of a main face plate and two side face plates disposed along an outer side surface and both width-direction side surfaces of the amorphous iron core, and an insulating iron core support panel can be arranged between leading end sides of the two side face plates for covering a surrounding of an outer iron core leg portion of the amorphous iron core together with the side bracket. Even further, the side bracket can be composed of a plate-shaped bracket disposed along an outer side surface of the amorphous iron core, and an insulating iron core retention member connected to the plate-shaped bracket and extending along an inner side surface and both width-direction side surfaces of a leg portion of the amorphous iron core can be arranged to cover the circumference of an outer iron core leg portion of the amorphous iron core together with the plate-shaped bracket.

Effect of the Invention (1) Regarding an iron core for a static apparatus, according to the prior art method, the arrangement of the wound iron core caused the magnetic flux to be concentrated to the inner circumference side of the core having a short magnetic path, whereas according to the present invention, magnetic flux distribution becomes uneven, suppressing the excessive magnetic flux concentration on the inner circumference side to thereby provide an iron core with lower loss.

Further, regarding (2) an amorphous iron core, the present invention provides an amorphous iron core transformer capable of suppressing or the increase of iron loss of the iron core the deterioration of magnetic properties caused by the stress generated by the difference of thermal expansion coefficients between the iron core and the jig for preventing deformation during annealing, and further reducing noise of the transformer during operation.

Moreover, regarding (3) a transformer iron core, the present invention provides (1) an iron core for a transformer formed by laminating magnetic thin plates, capable of improving the workability for connecting leading ends and rear ends in the longitudinal direction of blocks formed by laminating a plurality of magnetic thin plates during the manufacturing process, to provide a transformer capable of suppressing the increase of magnetic resistance of the magnetic circuit that can be manufactured easily and can ensure superior performance.

The present invention provides (2) an iron core for a transformer formed by laminating amorphous material thin plates, capable of preventing fragments of the iron core from scattering in the transformer via a simple arrangement to ensure the reliability of the transformer.

The present invention provides (3) a transformer designed so that the iron core formed by laminating magnetic thin plates is excited via a coil, wherein the coil can be reinforced via a simple arrangement to ensure the reliability of the transformer.

Further regarding (4) iron core protection of an amorphous iron core, the present invention enables to manufacture the amorphous iron core without using a jig during wrapping operation, and since it includes a box-shaped iron core protection member capable of stabilizing the iron core shape and enables easy inserting operation of the coil, during insertion of the iron core to the coil, the contact surface between the iron core after wrapping and the work table is made smooth so that the sliding and inserting to a transversely positioned coil is facilitated, according to which work time can be reduced, and since the protection member covers the whole body of the iron core, there is no need to provide an insulation member between the iron core and the coil, according to which an amorphous iron core transformer capable of preventing amorphous material fragments from scattering therein can be provided.

Further, regarding (5) a coil frame of a transformer, the present invention provides a coil winding frame and a transformer using the same, capable of improving the buckling strength of the inner wire by enhancing the buckling strength of the coil winding frame disposed on the innermost circumference of the inner winding wire via a simple method, to thereby prevent deterioration of excitation current and iron loss by preventing buckling of the inner winding wire so as not to apply pressure to the iron core even in a large capacity transformer.

Further regarding (6) a shell-type amorphous transformer, the present invention provides a shell-type amorphous transformer capable of ensuring a certain distance between the primary coil and the outer iron core leg portion using the side bracket which is an existing load support member, so that the outer iron core leg portion can be prevented from approximating or contacting the high pressure coil even when the iron core cover is omitted, according to which an inexpensive amorphous transformer requiring a small amount of materials can be provided.

BEST MODE FOR CARRYING OUT THE INVENTION

Now, the preferred embodiments for carrying out the present invention will be described in detail.

The present invention relates to (1) an invention related to an iron core for a static apparatus, (2) an invention related to an amorphous iron core, (3) an invention related to a transformer iron core, (4) an invention related to protection of an iron core of an amorphous transformer, (5) an invention related to a coil winding frame for a transformer, and (6) an invention related to a shell-type amorphous transformer, wherein the detailed descriptions of each invention will follow.

At first, we will describe the invention regarding (1) an iron core for a static apparatus.

Embodiment 1

Figure 1:
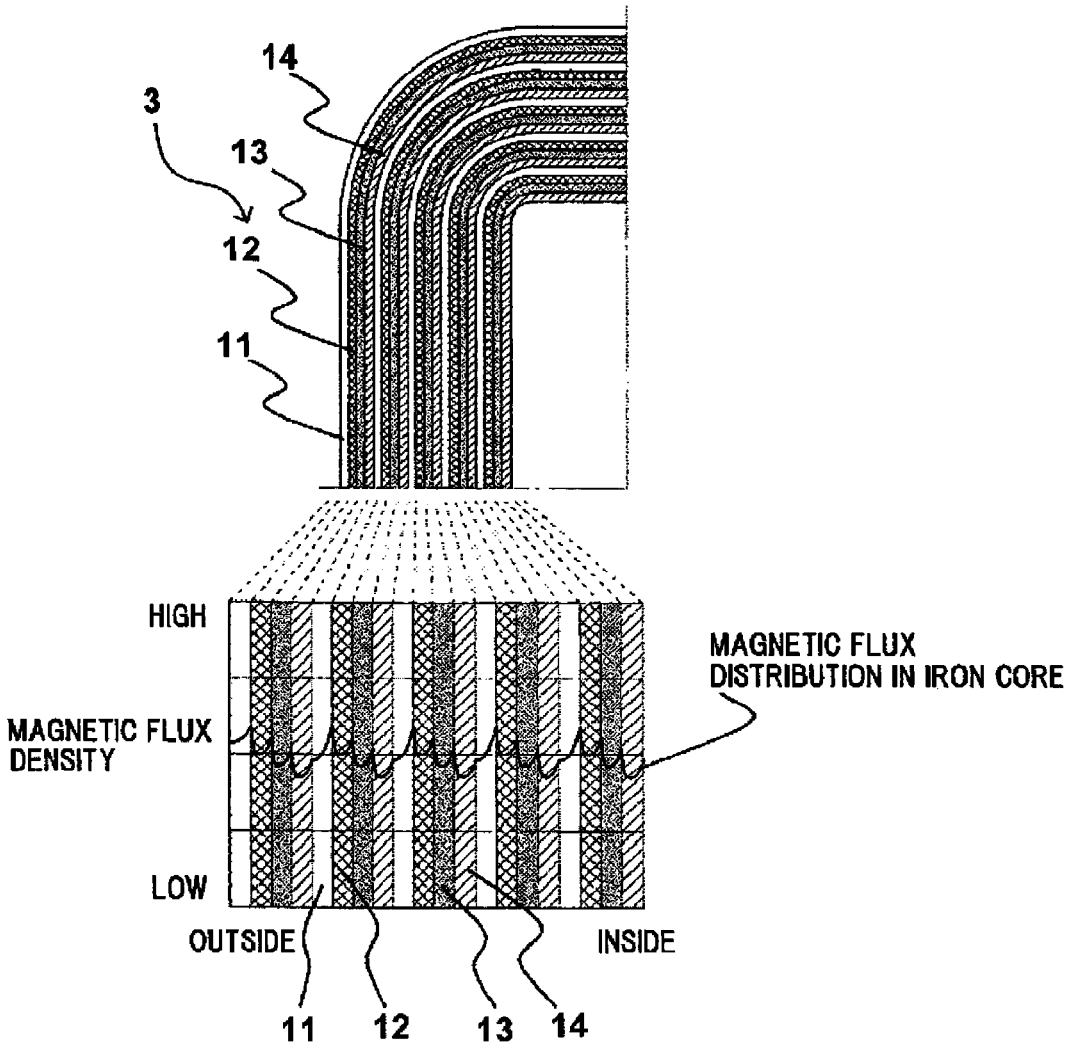
FIG. 1 is a ¼ view of a wound iron core illustrating claim 1 of the present invention.
Figure 2:
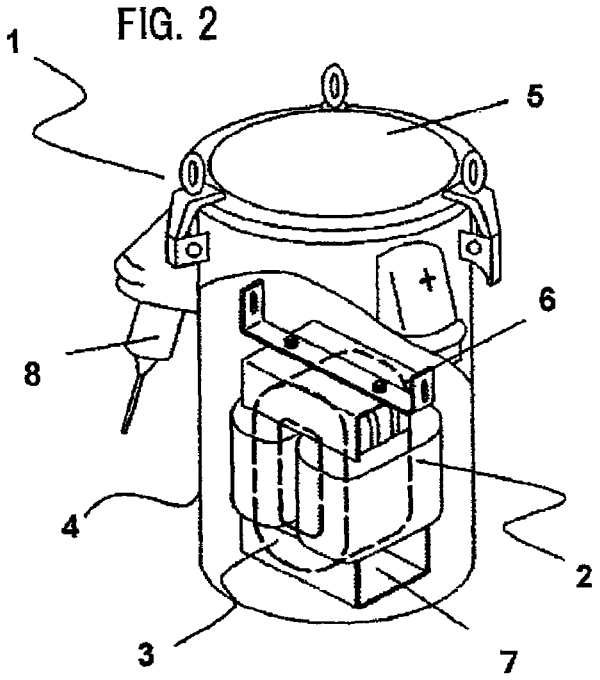
FIG. 2 is a view showing a pole-mounted transformer as a typical example of a static apparatus.
Figure 3:
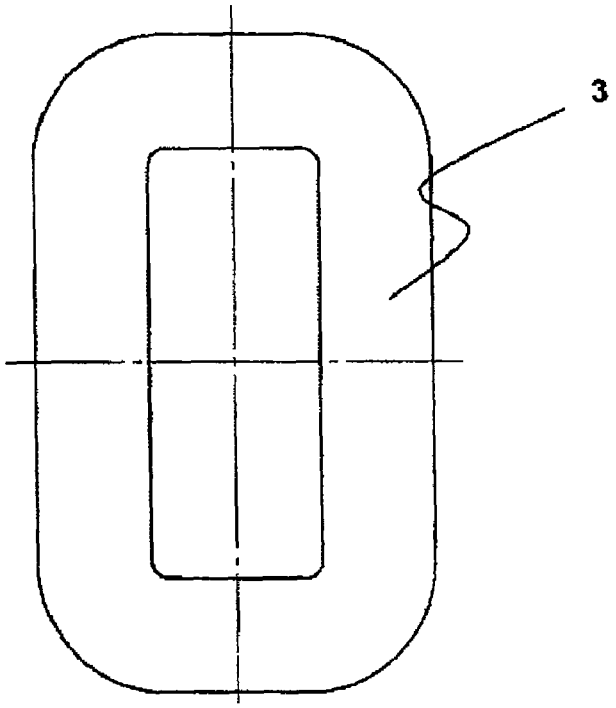
FIG. 3 is a view showing a wound iron core.
Figure 4:
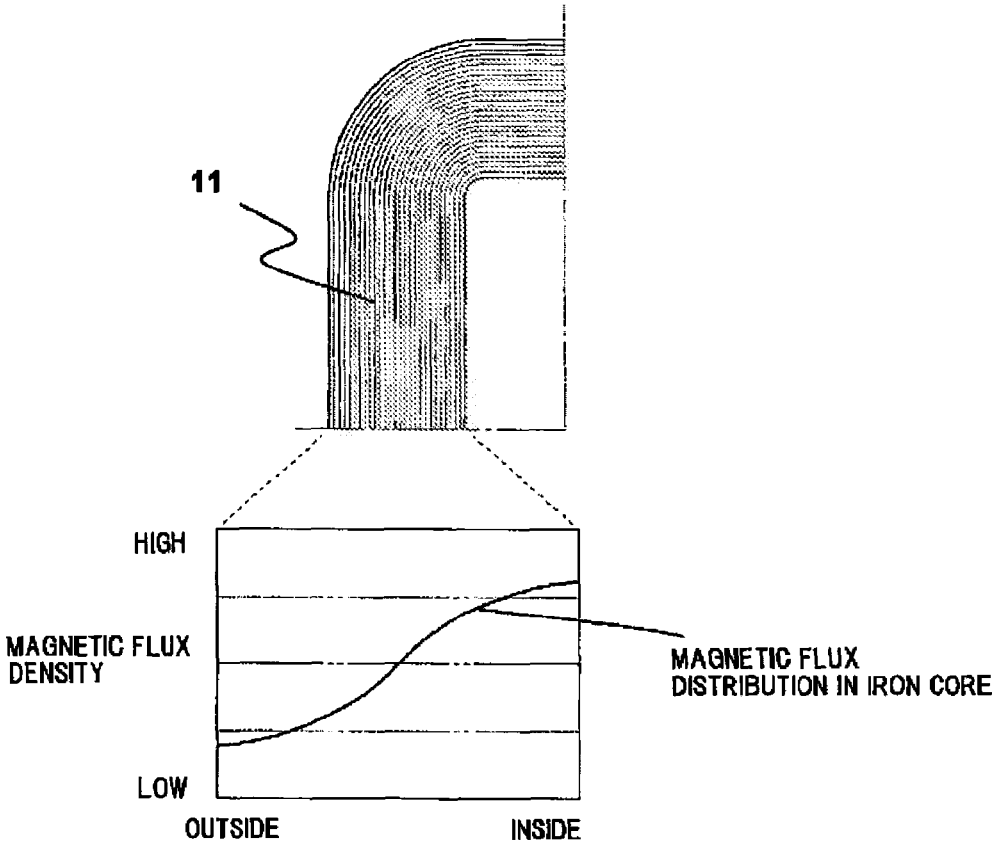
FIG. 4 is a view showing a ¼ view of the wound iron core and the magnetic flux density distribution of the cross section of the core.

FIG. 1 shows a partial cross-sectional view of a wound iron core 3 using four kinds of magnetic steel sheets with different magnetic permeabilities. When the respective magnetic permeabilities of the four kinds of magnetic steel sheets constituting the wound iron core 3 are referred to as $\mu1$, $\mu2$, $\mu3$ and $\mu4$ and the respective magnetic steel sheets satisfy a relationship of $\mu1<\mu2<\mu3<\mu4$, the magnetic steel sheet having a small magnetic permeability (magnetic permeability $\mu1$) is arranged on the inner side of the iron core, the magnetic steel sheet having a magnetic permeability $\mu2$ is disposed on the next layer on the outer side thereof, the magnetic steel sheet having a magnetic permeability $\mu3$ is disposed on the next layer on the outer side thereof, and the magnetic sheet having a magnetic permeability $\mu4$ is disposed as the next layer on the outer side thereof, wherein these layers formed of four kinds of magnetic steel sheets constitute a single block, and these blocks are repeatedly laminated to constitute the iron core.

Actually when magnetic steel sheets are used, a nondirectional magnetic steel sheet is used as the iron core material 14 disposed on the innermost circumference side, a domain control magnetic steel sheet having a greater magnetic permeability than the nondirectional magnetic steel sheet is disposed as the next outer layer (material 13), a unidirectional magnetic steel sheet having a greater magnetic permeability than the domain control magnetic steel sheet is disposed as the next layer (material 12), and a high orientation magnetic steel sheet having a greater magnetic permeability than the unidirectional magnetic steel sheet is disposed as the next layer (material 11).

These magnetic steel sheets constitute a single block, and these blocks are alternately arranged and laminated to form the iron core.

Now, the magnetic permeabilities of the respective magnetic sheets are as follows: the magnetic permeability of the nondirectional magnetic steel sheet is generally 0.016 or smaller (Nippon Steel Corporation, product name 35H210); the magnetic permeability of the domain control magnetic steel sheet is 0.08 or smaller (product name 23ZDKH); the magnetic permeability of the unidirectional magnetic steel sheet is 0.10 or smaller (product name 23Z110); and the magnetic permeability of the high orientation magnetic steel sheet is 0.11 or smaller (product name 23ZH90). Further, FIG. 1 shows an enlarged view in which single plates of magnetic steel sheets are laminated for easier understanding, but it is also possible to laminate a plurality of plates having the same magnetic permeability.

Regarding the magnetic flux distribution within the iron core according to the present arrangement, as shown in FIG. 1, the magnetic flux density at the innermost circumference side is low, the magnetic flux density becomes higher at areas closer to the next outer-circumference-side laminated section, the density becomes lower at the center of the laminated section, the density becomes higher at areas closer to the subsequent third laminated layer, the density becomes lower at the center of the third laminated layer, and the magnetic flux density becomes higher at areas closer to the forth laminated layer. Similarly, the magnetic flux density becomes lower at the center of the fourth laminated layer, and the density of the fifth laminated layer becomes equivalent to the first laminated layer on the innermost circumference, so that at areas of the fourth laminated layer closer to the fifth laminated layer, the magnetic flux density becomes lower than at the center area.

The value of the magnetic flux density at the intermediate section from the first laminated layer to the fourth laminated layer is relatively a little higher, and from the fifth layer onward, the properties of the first to fourth layers are repeated.

In other words, the material having higher magnetic permeability allows higher magnetic flux flow and that having lower permeability exerts the opposite effect, so that when materials having high magnetic permeability and low magnetic permeability are arranged regularly, the magnetic permeability becomes uneven. When observing the whole body of the iron core, magnetic flux tends to gather at the inner circumference portion having a short magnetic path, but since the magnetic permeability is uneven, the magnetic flux flowing through the area having a high magnetic permeability cannot easily exceed the areas having a low magnetic permeability. Therefore, compared to a wound iron core formed of a single material, the present embodiment enables magnetic paths through which magnetic flux flows to be subdivided in the circumferential direction, and enables to prevent magnetic flux from excessively concentrating at the inner circumference portion of the iron core due to the difference in lengths of the magnetic paths. By utilizing this effect, when the material having a high magnetic permeability has a low loss, local magnetic flux concentration is suppressed, so that the present embodiment enables to ease the loss caused by excessive excitation by the magnetic flux being concentrated at the inner circumference side of a single-material iron core, thereby offering an iron core with a low loss and capable of maintaining the low loss performance of a single-plate material.

Further, the magnetic permeability can be varied by combining materials having different magnetic permeabilities, but as for amorphous metal, the magnetic permeability can be varied using the same annealing temperature by utilizing different kinds of materials, so that the same effect can be achieved by combining materials and performing collective annealing.

Embodiment 2

Figure 5:
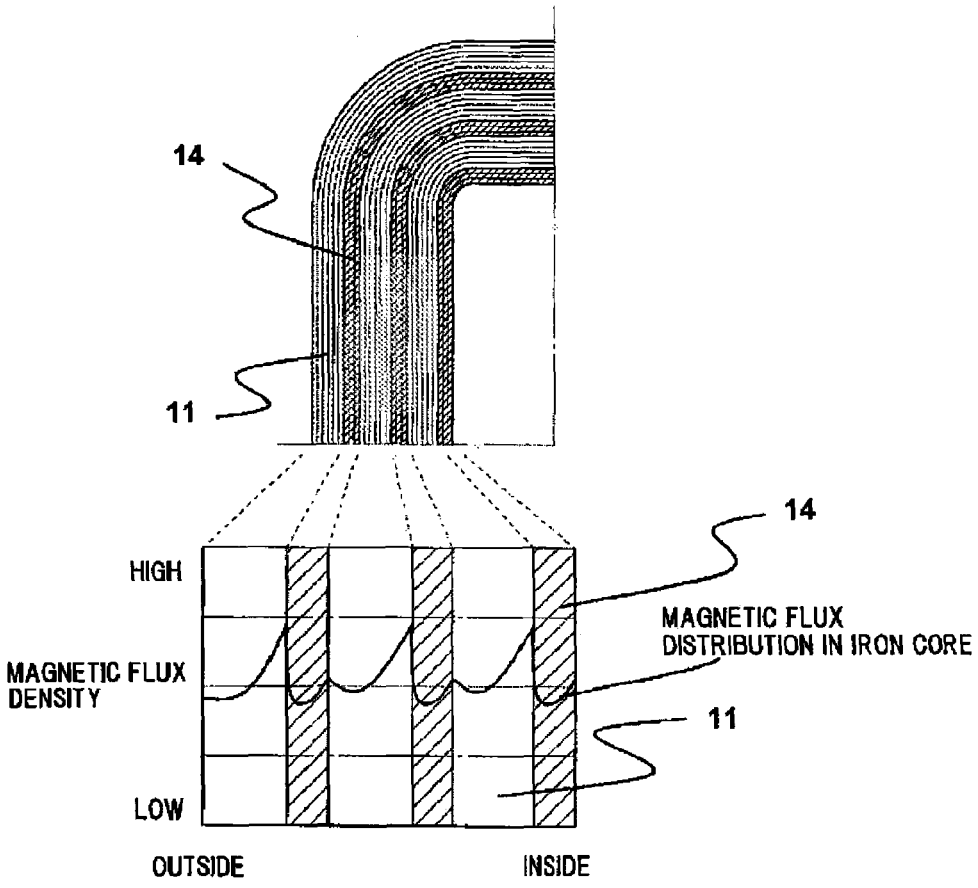
FIG. 5 is a view illustrating embodiment 2.

FIG. 5 shows an arrangement in which an iron core is formed by laminating two kinds of materials with different magnetic permeabilities.

In this example, an amorphous material SA1 (Hitachi Metals, product name 2605SA1) and an amorphous material HB1 (Hitachi Metals, product name 2605HB1) having a higher magnetic flux density than SA1 were used as the two materials with different magnetic permeabilities.

In FIG. 5, the iron core 15 is formed by disposing an amorphous material in which the magnetic permeability is reduced when the core is annealed at a certain temperature on the inner circumference side of the core, laminating an amorphous material in which the magnetic permeability is increased when annealed as the next layer, and repeating such arrangement to constitute the amorphous iron core.

The amorphous material 15 having a small magnetic permeability can be formed of a single plate or a plurality of plates, and the amorphous material having a greater magnetic permeability can also be formed of a single plate or a plurality of plates.

FIG. 5 shows the magnetic flux density distribution of the iron core formed by laminating two kinds of amorphous materials with different magnetic permeabilities. In this magnetic flux density distribution, an iron core material 14 having a small magnetic permeability μ is disposed as the first layer on the inner circumference side, and a core material 11 having a high magnetic permeability is disposed as the second layer laminated on the outer side thereof, wherein the thickness of the second layer is formed thicker than the first layer, so that the magnetic flux distribution of the first layer is low and that of the second layer is high. From the third layer onward, the structure of the first and second layers are repeatedly disposed, so that the magnetic flux distribution of the second layer becomes smaller at areas closer to the third layer, and this property of magnetic flux distribution appears repeatedly.

When the magnetic flux density distribution shown in FIG. 5 is compared with the magnetic flux density distribution of the prior art, the magnetic flux density of the iron core material (amorphous material) 14 is small while that of the iron core material (amorphous material) 11 is greater, so that as a whole, the magnetic flux distribution biased toward the inner core side in the prior art is eased and the characteristics of the iron core are improved.

Figure 6:
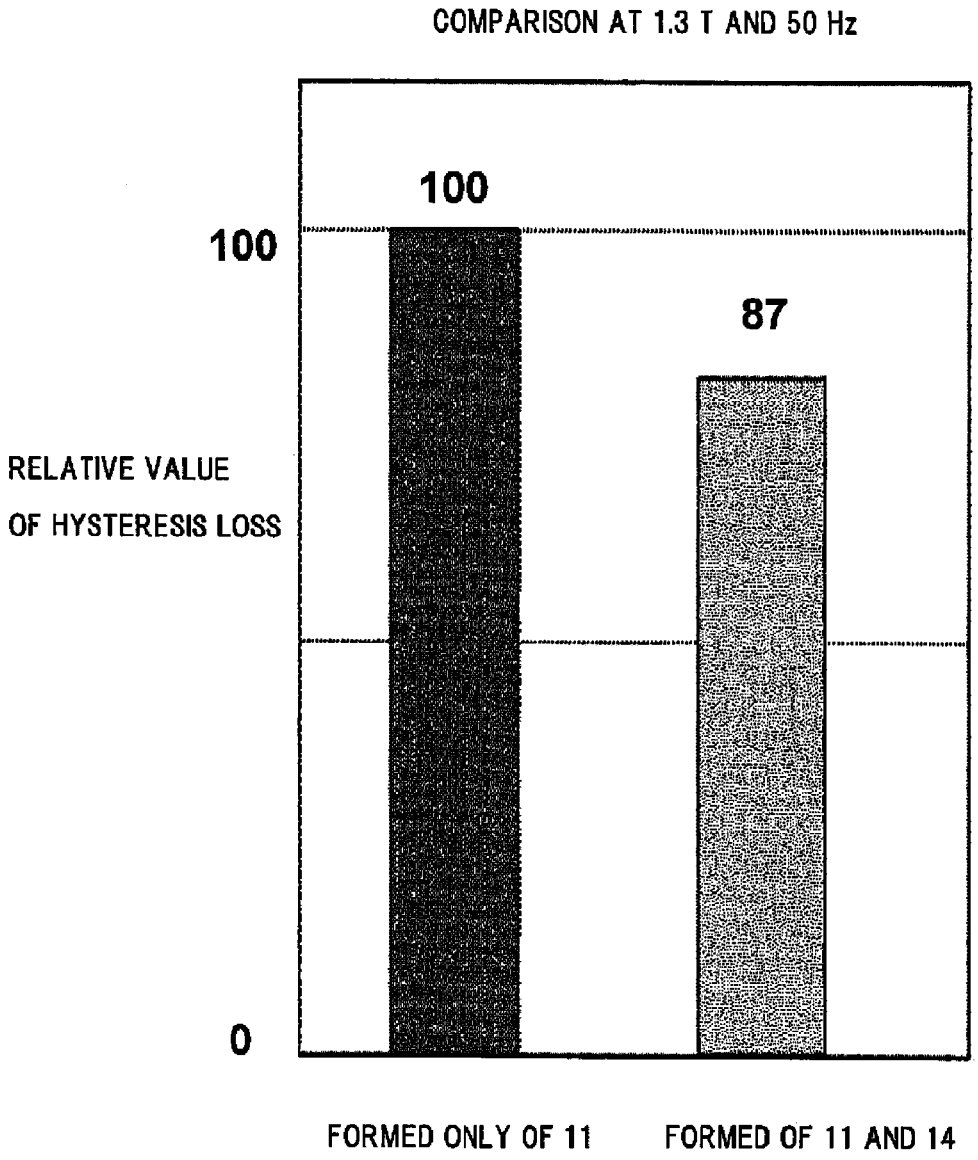
FIG. 6 is a view comparing the result of measurement of embodiment 2.

Next, FIG. 6 shows the result of comparison in which the iron core is formed by laminating two kinds of amorphous materials with different magnetic permeabilities in the arrangement shown in FIG. 5 and the hysteresis loss thereof is measured. FIG. 6 compares the change of characteristics in a magnetic flux density of 1.3 T and 50 Hz, wherein the left side of FIG. 6 shows an example in which the iron core is formed by laminating only the amorphous material thin plate with a small magnetic permeability (material 11), the hysteresis loss of which is shown as 100.

In comparison, the iron core formed by alternately laminating two kids of amorphous ribbons (materials 11 and 14) with different magnetic permeabilities has a 87% hysteresis loss, so that the loss could be improved by approximately 15%.

This comparison shows that hysteresis loss can be reduced by forming an iron core by using amorphous thin plates with different magnetic permeabilities as the iron core material in which the amorphous material with a small magnetic permeability is disposed on the inner side, the amorphous material having a greater magnetic permeability is disposed on the outer side and the materials are laminated alternately.

Embodiment 3

Figure 7:
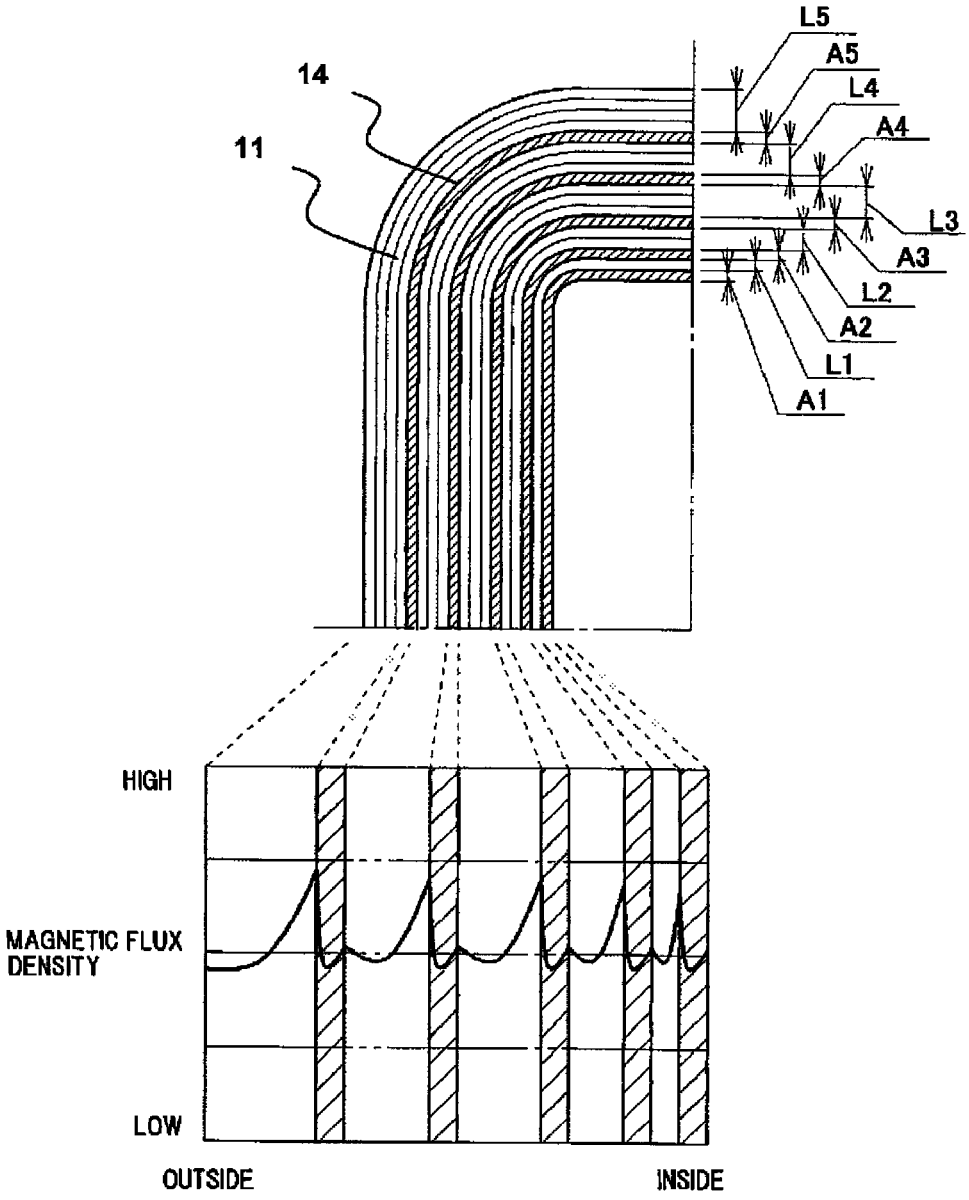
FIG. 7 is a view illustrating embodiment 3.

FIG. 7 shows a partial cross-sectional view of an iron core formed by laminating two kinds of amorphous ribbons with different magnetic permeabilities.

In FIG. 7, the inner iron core is formed by laminating a single plate or a plurality of plates of amorphous ribbons (material 14) with a small magnetic permeability, laminating as the next layer an amorphous ribbon (material 11) with greater magnetic permeability, and alternately repeating such lamination, wherein the laminated amount, or thickness, of amorphous ribbons having greater magnetic permeability is gradually increased. The thickness of the amorphous ribbon 14 is substantially the same, that is, the values of A1, A2, A3, A4 and A5 are substantially equal.

The laminated thickness of the amorphous ribbons having greater magnetic permeability is L1<L2<L3<L4<L5, wherein the amount of thickness is increased proportionally. However, it is possible to set the thickness at the center portion of the iron core to be substantially the same, such as L1<L2<L3=L4<L5, as shown in FIG. 7.

FIG. 7 shows the magnetic flux density of the iron core structure. FIG. 7 shows partially enlarged view of the amorphous iron core, wherein the magnetic flux density of the inner side of the iron core is shown by a solid line 100. A1 and A2 are narrowed so as to prevent the density from concentrating at the inner side of the iron core.

FIG. 7 is formed by laminating an iron core material 14 having a small magnetic permeability as the first layer on the innermost circumference, an iron core material 11 having a greater magnetic permeability as the second layer on the outer side thereof, the iron core material 14 having a small magnetic permeability as the third layer on the outer side thereof, the iron core material 11 having a greater magnetic permeability as the fourth layer on the outer side thereof, and repeating this laminated structure from the fifth layer onward with the thickness of the iron core material having greater magnetic permeability gradually increased.

According to this arrangement, the magnetic flux density distribution is low at the first layer, gradually increased at areas closer to the second layer, lowered at the center area, lowered at areas closer to the third layer, lowered at the third layer, and increased at areas closer to the fourth layer, wherein such magnetic flux density distribution characteristics appears repeatedly, by which the excessive concentration of the magnetic flux density is eased as a whole and the iron core characteristics is improved.

Figure 8:
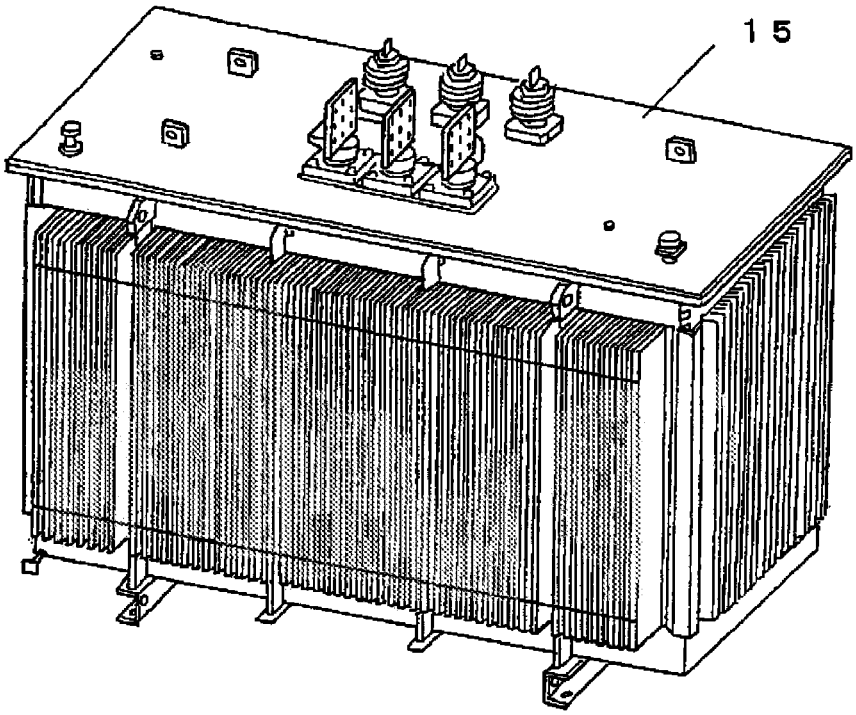
FIG. 8 is a view showing an oil-immersed transformer equipped with the iron core according to the present invention.

FIG. 8 shows a static apparatus 15, such as a three-phase oil-immersed transformer, equipped with a wound iron core having, for example, the amorphous steel plate having the above-described arrangement.

Embodiment 4

Next, the invention regarding (2) the amorphous iron core will be described with reference to the drawings.

Figure 9:
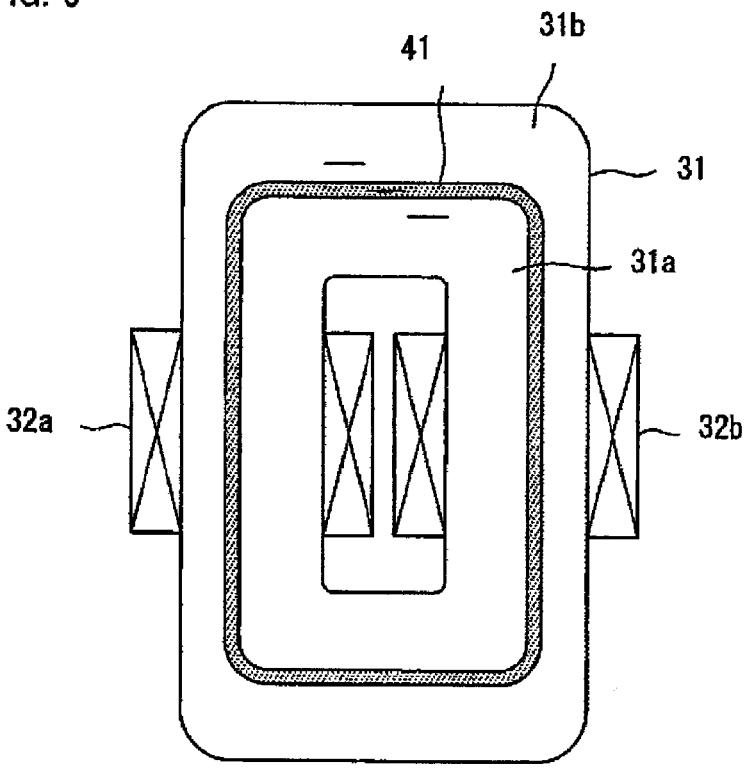
FIG. 9 is a view showing a cross-sectional structure of an amorphous iron core transformer according to embodiment 4 of the present invention.
Figure 10:
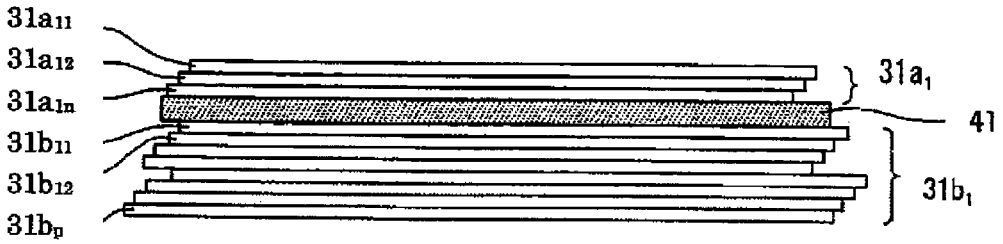
FIG. 10 is an explanatory view of a laminated state of a block-like laminated member of an iron core according to the amorphous iron core transformer of FIG. 9.
Figure 11:
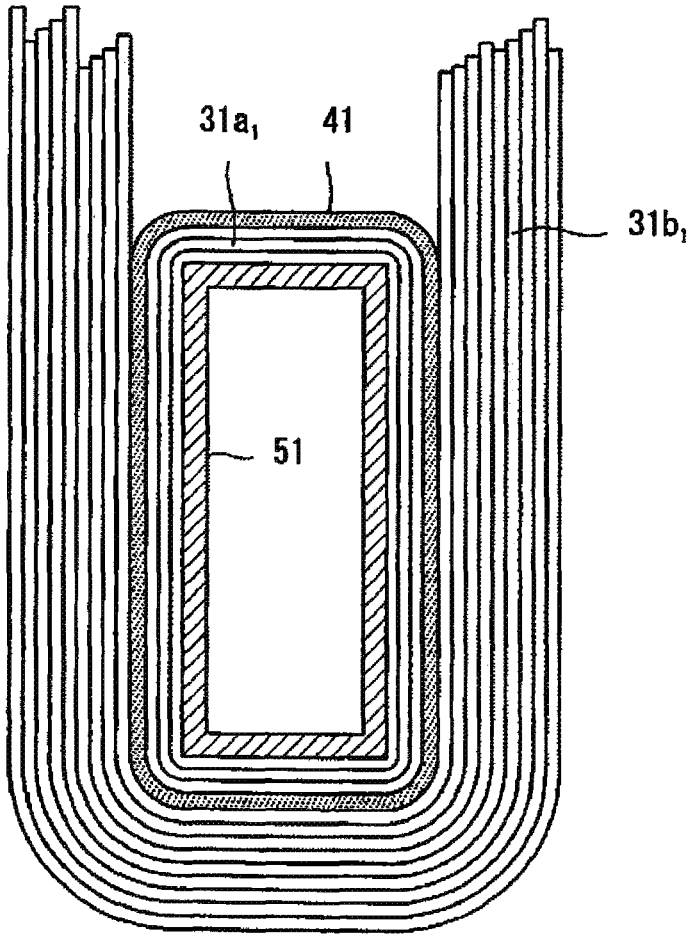
FIG. 11 is an explanatory view of a step for forming the block-like laminated member shown in FIG. 10 into a ring shape.

FIGS. 9 through 11 are explanatory views of embodiment 4 of an amorphous iron core transformer according to the present invention. FIG. 9 is a cross-sectional view of an amorphous iron core transformer according to embodiment 4 of the invention, FIG. 10 shows a state where block like-laminated members constituting the iron core of the amorphous iron core transformer of FIG. 9 is laminated, and FIG. 11 is an explanatory view in which the block-like laminated members of FIG. 10 are formed in a ring shape.

In FIG. 9, 105*a* refers to an amorphous iron core transformer according to embodiment 4 of the present invention, 31 refers to a ring-shaped iron core formed of amorphous material and constituting a magnetic circuit of the amorphous iron core transformer 105*a*, 32*a* and 32*b* refer to coils for exciting the iron core 31, 41 refers to a sheet-like non-magnetic insulation material capable of enduring a temperature of over 400° C., for example, 31*a* refers to an iron core portion on the inner circumference side constituting a portion of the iron core 31 disposed on the inner circumference side of the sheet-like non-magnetic insulation material 41, and 31*b* refers to an iron core portion on the outer circumference side constituting a portion of the iron core 31 disposed on the outer circumference side of the sheet-like non-magnetic insulation material 41. The inner-circumference-side iron core portion 31*a* and the outer-circumference-side iron core portion 31*b* are each composed so that a plurality of block-like laminated member formed by laminating a plurality of sheets of strip-like amorphous material (hereinafter referred to as amorphous sheet material) with a thickness of approximately $0.025\times10^{-3}$ m, for example, are further laminated. In other words, the sheet-like non-magnetic insulation material 4*l* having heat resistance is disposed between a block-like laminated member on the n-th layer (n being an integer of two or more) from the innermost circumference side of the iron core 31 and a block-like laminated member disposed on the (n+1)-th layer thereof. The sheet-like non-magnetic insulation material 41 enables to suppress concentration of magnetic flux in the cross-section of the iron core 31, increase of eddy current loss, and stress generated due to the difference of thermal expansion coefficients with a jig for preventing deformation (not shown) during annealing. In other words, (1) the sheet-like non-magnetic insulation material 41 forms a non-magnetic layer between the inner-circumference-side iron core portion 31*a* and the outer-circumference-side iron core portion 31*b* of the iron core 31, wherein the nonmagnetic layer divides the magnetic circuit of the iron core 31 into a magnetic circuit formed in the inner-circumference-side iron core portion 31*a* and the magnetic circuit formed in the outer-circumference-side iron core portion 31*b*. Therefore, the magnetic flux generated in the iron core 31 by the excitation via power supply to coils 32*a* and 32*b* is dispersed and flown through the respective magnetic circuits. As a result, the concentration of magnetic flux to the inner-circumference-side iron core portion 31*a* can be suppressed or the level of concentration of the magnetic flux can be eased. Thus, the magnetic saturation or the increase of magnetic resistance can be suppressed at the inner-circumference-side iron core portion 31*a*, and the deterioration of magnetic circuit characteristics or the increase of hysteresis loss can be suppressed. Since the present arrangement enables to prevent the deterioration of magnetic circuit characteristics, the occurrence of waveform distortion of the first and second coil currents can be prevented. (2) The sheet-like non-magnetic insulation material 41 forms an insulation layer between the inner-circumference-side iron core portion 31*a* and the outer-circumference-side iron core portion 31*b* in the cross-section of the iron core 31, thereby electrically isolating the inner-circumference-side iron core portion 31*a* and the outer-circumference-side iron core portion 31*b*. Therefore, the electrical resistance in the cross-section of the iron core 31 is increased, suppressing the increase of eddy current generated in the cross-section of the iron core 31 due to the time variation of magnetic flux flowing through the iron core 31, that is, the alternating magnetic field. (3) During annealing, for example, jigs for preventing deformation formed of steel material (not shown) are disposed respectively on the inner circumference portion and the outer circumference portion of the iron core 31, and when the iron core 31 and the jigs for preventing deformation are heated to a temperature of approximately 400° C., since the thermal expansion coefficients of the amorphous material of the iron core 31 and the steel material of the jig for preventing deformation (not shown) differ greatly (the thermal expansion coefficient of the amorphous material is small, which is approximately one-fourth to one-half of the thermal expansion coefficient of the steel material), so that stress is generated in the interior of the iron core 31 by the deformation via thermal expansion of the jig for preventing deformation, leading to baking of the amorphous sheet materials and deteriorating magnetic characteristics, however, the sheet-like non-magnetic insulation material 41 due to its deformability and shock-absorbing performance forms a layer for absorbing stress between the inner-circumference-side iron core portion 31*a* and the outer-circumference-side iron core portion 31*b* within the iron core 31, and thereby absorbs the stress generated in the iron core 31 by the jig for preventing deformation, suppressing the deterioration of magnetic characteristics of the iron core 31 or the baking of amorphous sheet materials.

In the following description, the components equivalent to that in FIG. 9 are denoted with the same reference numbers.

FIG. 10 is a view showing the state in which a plurality of block-like laminated members constituting the iron core 31 of the amorphous iron core transformer 105*a* of FIG. 9 are laminated in multiple layers.

In FIG. 10, references $\mathbf{31}a_{11}$, $\mathbf{31}a_{12}$, . . . $\mathbf{31}a_{1n}$, $\mathbf{31}b_{11}$, $\mathbf{31}b_{12}$, . . . , $\mathbf{31}b_{1p}$ each refer to block-like laminated members in which a plurality of (for example, 20) sheets of strip-like amorphous sheet members with a thickness of approximately $0.025\times10^{-3}$ m are laminated, $\mathbf{31}a_1$ is a group of block-like laminated members on the inner circumference side constituting the inner-circumference-side iron core portion 31*a* (FIG. 9) of the iron core 31 in which block-like laminated members $\mathbf{31}a_{11}$, $\mathbf{31}a_{12}$, . . . , $\mathbf{31}a_{1n}$ are laminated, and $\mathbf{31}b_1$ is a group of block-like laminated members on the outer circumference side constituting the outer-circumference-side iron core portion 31*b* (FIG. 9) of the iron core 31 in which block-like laminated members $\mathbf{31}b_{11}$, $\mathbf{31}b_{12}$, . . . , $\mathbf{31}b_{1p}$ are laminated. The block-like laminated members $\mathbf{31}a_{1n}$ constitute a block-like laminated member on the n-th layer (n being an integer of two or more) from the innermost circumference side of the ring-shaped iron core 31, and the block-like laminated member $\mathbf{31}b_{11}$ constitutes a block-like laminated member on the (n+1) -th layer. The sheet-like non-magnetic insulation material 41 is laminated between the group of block-like laminated members $\mathbf{31}a_1$ and $\mathbf{31}b_1$, in other words, between the block-like laminated member $\mathbf{31}a_{1n}$ and the block-like laminated member $\mathbf{31}b_{11}$.

In the following description, the components equivalent to the components in FIG. 10 are denoted with the same reference numbers.

FIG. 11 is an explanatory view of an example where the group of block-like laminated members of FIG. 10 is formed in a ring shape.

In FIG. 11, reference number 51 denotes a jig for forming the group of block-like laminated member $\mathbf{31}a_1$ and $\mathbf{31}b_1$ and the sheet-like non-magnetic insulation material 41 into a ring shape. The groups of block-like laminated members $\mathbf{31}a_1$ and $\mathbf{31}b_1$ and the sheet-like non-magnetic insulation material 41 are wound around a ring-shape forming jig 51 in the named order of the group of block-like laminated members $31a_1$, the sheet-like non-magnetic insulation material 41 and the group of block-like laminated members $31b_1$. The ring-shape forming jig 51 is formed for example of steel material. The block-like laminated members $31a_{11}$, $31a_{12}$, . . . $31a_{1n}$, $31b_{11}$, $13b_{12}$, . . . , $31b_{1p}$ have their respective leading ends and rear ends in the longitudinal direction thereof butted against or superposed with one another. The sheet-like non-magnetic insulation material 41 is also disposed so that the leading end and the rear end in the longitudinal direction thereof is butted against each other.

The group of block-like laminated members $31a_1$ and $31b_1$ and the sheet-like non-magnetic insulation material 41 formed into a ring-shape are subjected to annealing as an iron core 31. The annealing process is performed for example by attaching jigs for preventing deformation formed of steel material (not shown) respectively to the inner circumference of the group of block-like laminated members $31a_1$ and the outer circumference of the group of block-like laminated members $31b_1$, and raising the environment temperature to 400° C., for example. A ring-shape forming jig 51 can be used as the jig for preventing deformation attached to the inner circumference of the group of block-like laminated members $31a_1$. During annealing, the sheet-like non-magnetic insulation material 41 absorbs the stress generated in the iron core 31 between the inner-circumference-side iron core portion 31*a* and the outer-circumference-side iron core portion 31*b* by the thermal expansion of the jig for preventing deformation, and thereby suppresses the deterioration of magnetic characteristics of the iron core 31 or the baking of amorphous sheet materials. When the annealing process is completed, the annular condition of the group of block-like laminated members $31a_1$ and $31b_1$ and the sheet-like non-magnetic insulation material 41 is released, so that both ends thereof in the longitudinal direction are released.

The amorphous iron core transformer 105*a* of embodiment 4 of the present invention enables to suppress the increase of iron loss of the iron 31 or the deterioration of magnetic characteristics of the iron core 31 due to the stress caused by the difference of thermal expansion coefficients of the iron core 31 and the jig for preventing deformation during annealing, and further enables to reduce noise caused during operation of the amorphous iron core transformer 105*a*.

Embodiment 5

Figure 12:
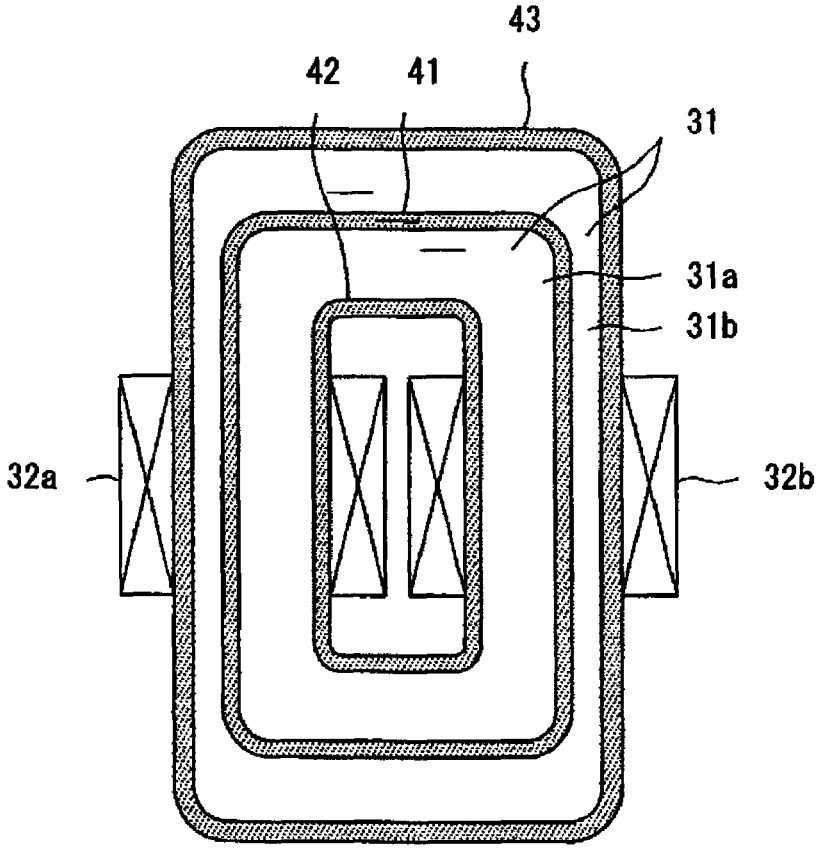
FIG. 12 is a view showing a cross-sectional structure of an amorphous iron core transformer according to embodiment 5 of the present invention.
Figure 13:
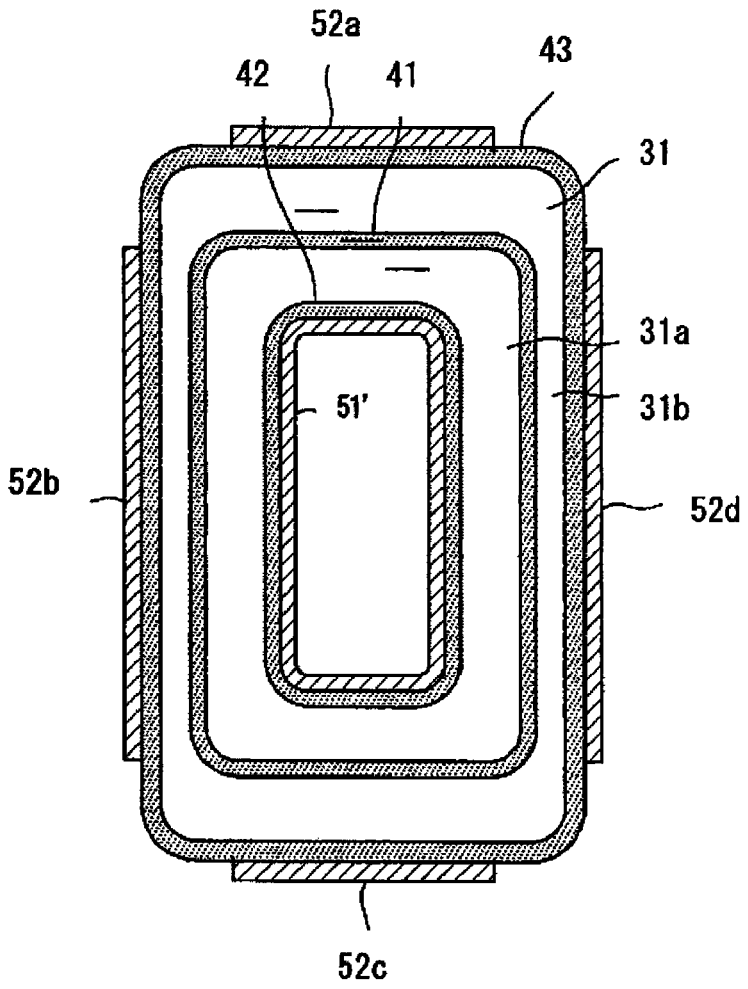
FIG. 13 is an explanatory view showing the state during annealing of the iron core according to the amorphous iron core transformer shown in FIG. 12.

FIGS. 12 and 13 are explanatory views of embodiment 5 of the amorphous iron core transformer according to the present invention. FIG. 12 is a cross-sectional view of the amorphous iron core transformer according to embodiment 5, and FIG. 13 shows a state where the iron core of the amorphous iron core transformer shown in FIG. 12 is annealed. The amorphous iron core transformer according to embodiment 5 has sheet-like non-magnetic insulation materials disposed not only between the group of block-like laminated members within the iron core but also on the inner-circumference side and the outer-circumference side of the iron core.

In FIG. 12, reference 105*b* refers to the amorphous iron core transformer according to embodiment 5 of the present invention, 31 refers to a ring-shaped iron core formed of amorphous material and constituting a magnetic circuit of the amorphous iron core transformer 105*b*, 41, 42 and 43 each refer to a sheet-like non-magnetic insulation material having heat resistance (for example, capable of enduring a temperature of 400° C. or higher), 31*a* refers to the inner-circumference-side iron core portion disposed on the inner circumference of the sheet-like non-magnetic insulation material 41 in the iron core 31, and 31*b* refers to the outer-circumference-side iron core portion disposed on the outer circumference of the sheet-like non-magnetic insulation material 41 in the iron core 31. The inner-circumference-side iron core portion 31*a* and the outer-circumference-side iron core portion 31*b* are each formed so that a plurality of layers of block-like laminated members formed by laminating a plurality of strip-like amorphous sheet members with a thickness of approximately $0.025\times10^{-3}$ m are laminated further.

The sheet-like non-magnetic insulation material 41 is disposed between the group of block-like laminated members constituting the inner-circumference-side iron core portion 31*a* and the group of block-like laminated members constituting the outer-circumference-side iron core portion 31*b*, that is, between the n-th layer (n being an integer of two or more) of block-like laminated members from the innermost circumference of the ring-shaped iron core 31 and the (n+1)-th layer of block-like laminated members, similar to the case of embodiment 4. Further, a sheet-like non-magnetic insulation material 42 is disposed on the inner-circumference side of the iron core 31, and a sheet-like non-magnetic insulation material 43 is disposed on the outer-circumference side of the iron core 31. The sheet-like non-magnetic insulation material 41 enables to suppress the concentration of magnetic flux within the cross-section of the iron core 31, the increase of eddy current loss, or enables to suppress the stress generated due to the difference in thermal expansion coefficients between the core and the jig for preventing deformation (not shown) due to its deformability and shock absorbing property during annealing, the sheet-like non-magnetic insulation material 42 enables to suppress the stress caused by the difference in thermal expansion coefficients between the jig for preventing deformation (not shown) and the iron core 31 during annealing from being generated to the inner-circumference-side iron core portion 31*a* due to its deformability and shock absorbing property, and the sheet-like non-magnetic insulation material 43 suppresses the stress caused by the difference in thermal expansion coefficients between the jig for preventing deformation (not shown) and the iron core 31 during annealing from being generated to the outer-circumference-side iron core portion 31*b* due to its deformability and shock absorbing property. In other words, (1) the sheet-like non-magnetic insulation material 41 forms a nonmagnetic layer between the inner-circumference-side iron core portion 31*a* and the outer-circumference-side iron core portion 31*b* of the iron core 31, wherein the nonmagnetic layer divides the magnetic circuit of the iron core 31 into a magnetic circuit formed in the inner-circumference-side iron core portion 31*a* and the magnetic circuit formed in the outer-circumference-side iron core portion 31*b*. Therefore, the magnetic flux generated in the iron core 31 by the excitation via power supply to coils 32*a* and 32*b* is dispersed and flown through the respective magnetic circuits. As a result, the concentration of magnetic flux to the inner-circumference-side iron core portion 31*a* can be suppressed or the level of concentration of the magnetic flux can be eased. Thus, the magnetic saturation or the increase of magnetic resistance can be suppressed at the inner-circumference-side iron core portion 31*a*, and the deterioration of magnetic circuit characteristics or the increase of hysteresis loss can be suppressed. Since the present arrangement enables to prevent the deterioration of magnetic circuit characteristics, the occurrence of waveform distortion of the first and second coil currents can be suppressed. Further, the sheet-like non-magnetic insulation material 41 forms an insulation layer between the inner-circumference-side iron core portion 31*a* and the outer-circumference-side iron core portion 31*b* in the cross-section of the iron core 31, thereby electrically isolating the inner-circumference-side iron core portion 31*a* and the outer-circumference-side iron core portion 31*b*. Therefore, the electrical resistance in the cross-section of the iron core 31 is increased, suppressing the increase of eddy current generated in the cross-section of the iron core 31 due to the time variation of magnetic flux flowing through the iron core 31, that is, the alternating magnetic field. Even further, during annealing of the iron core 31, for example, jigs for preventing deformation formed of steel material (not shown) are disposed respectively on the inner circumference portion and the outer circumference portion of the iron core 31, and when the iron core 31 and the jigs for preventing deformation are heated to a temperature of approximately 400° C., since the thermal expansion coefficients of the amorphous material of the iron core 31 and the steel material of the jig for preventing deformation (not shown) differ greatly (the thermal expansion coefficient of the amorphous material is small, which is approximately one-fourth to one-half the thermal expansion coefficient of the steel material), stress is generated to the interior of the iron core 31 by the deformation via thermal expansion of the jig for preventing deformation, leading to baking of the amorphous sheet materials and deteriorating magnetic characteristics, however, the sheet-like non-magnetic insulation material 41 due to its deformability and shock-absorbing performance forms a layer for absorbing stress between the inner-circumference-side iron core portion 31*a* and the outer-circumference-side iron core portion 31*b* within the iron core 31, and thereby absorbs the stress generated in the iron core 31 by the jig for preventing deformation, suppressing the deterioration of magnetic characteristics of the iron core 31 or the baking of amorphous sheet materials. (2) The sheet-like non-magnetic insulation material 42 absorbs the deformation caused by the difference in thermal expansion quantity of the jig for preventing deformation formed for example of steel material and attached to the inner circumference side of the insulating material 42 and the thermal expansion quantity of the iron core 31 itself during annealing by the deformability and the shock absorbing property thereof, so as to prevent stress caused by such deformation from being generated in the inner-circumference-side iron core portion 31*a*. (3) The sheet-like non-magnetic insulation material 43 absorbs the deformation due to the difference in thermal expansion quantity of the jig for preventing deformation formed for example of steel material and attached to the outer circumference side of the insulating material 43 and the thermal expansion quantity of the iron core 31 itself during annealing by the deformability and the shock absorbing property thereof, so as to prevent stress caused by such deformation from being generated in the outer-circumference-side iron core portion 31*b*.

In the following description, the components of FIG. 13 equivalent to those in FIG. 12 are denoted with the same reference numbers.

FIG. 13 is a drawing showing a state where the iron core 31 of the amorphous iron core transformer 105*b* shown in FIG. 12 is annealed.

In FIG. 13, reference 51' denotes a jig for forming a ring shape doubling as jig for preventing deformation for forming the group of block-like laminated members disposed on the inner-circumference side of the sheet-like non-magnetic insulation material 42 and constituting the inner-circumference-side iron core portion 31*a*, the group of block-like laminated members constituting the outer-circumference-side iron core portion 31*b* and the sheet-like non-magnetic insulation materials 41, 42 and 43 in a ring-shape and also for preventing deformation of the iron core 31 during annealing, and 52*a*, 52*b*, 52*c* and 52*d* are jigs for preventing deformation disposed on the outer circumference side of the sheet-like non-magnetic insulation material 42 for preventing deformation of the iron core 31 during annealing. The jig for forming a ring shape doubling as jig for preventing deformation 51' and the jigs for preventing deformation 52*a*, 52*b*, 52*c* and 52*d* are formed for example of steel material. During annealing of the iron core 31, the sheet-like non-magnetic insulation material 41 absorbs the stress generated in the iron core 31 by the difference in thermal expansion quantity of the iron core 31 itself and the thermal expansion quantity of the jig for forming a ring shape doubling as jig for preventing deformation 51' and the jig for preventing deformation 52*a*, 52*b*, 52*c* and 52*d* within the iron core 31 between the inner-circumference-side iron core portion 31*a* and the outer-circumference-side iron core portion 31*b*, thereby suppressing the deterioration of magnetic characteristics of the iron core 31 and baking of the amorphous sheet members. The sheet-like non-magnetic insulation material 42 absorbs the deformation caused by the difference in the thermal expansion quantity of the iron core 31 itself and the thermal expansion quantity of the jig for forming a ring shape doubling as jig for preventing deformation 51' during annealing of the iron core 31, and prevents stress caused by such deformation from being generated in the inner-circumference-side iron core portion 31*a*. Further, the sheet-like non-magnetic insulation material 43 absorbs the deformation caused by the difference in the thermal expansion quantity of the iron core 31 itself and the thermal expansion quantity of the jigs for preventing deformation 52*a*, 52*b*, 52*c* and 52*d* during anneal ing of the iron core 31, and prevents stress caused by such deformation from being generated in the outer-circumference-side iron core portion 31*b*.

The amorphous iron core transformer 105*b* according to embodiment 4 of the present invention enables to suppress the increase of iron loss of the iron core 31 and the deterioration of the magnetic characteristics of the iron core 31 due to the stress caused by the difference in the thermal expansion coefficients of the iron core 31 and the jig for forming a ring shape doubling as jig for preventing deformation 51' or the jig for preventing deformation 52*a*, 52*b*, 52*c* and 52*d* during annealing, and also enables to reduce the noise during operation of the amorphous iron core transformer 105*a*.

Next, the information regarding (3) a transformer iron core will be described with reference to the drawings.

Figure 14:
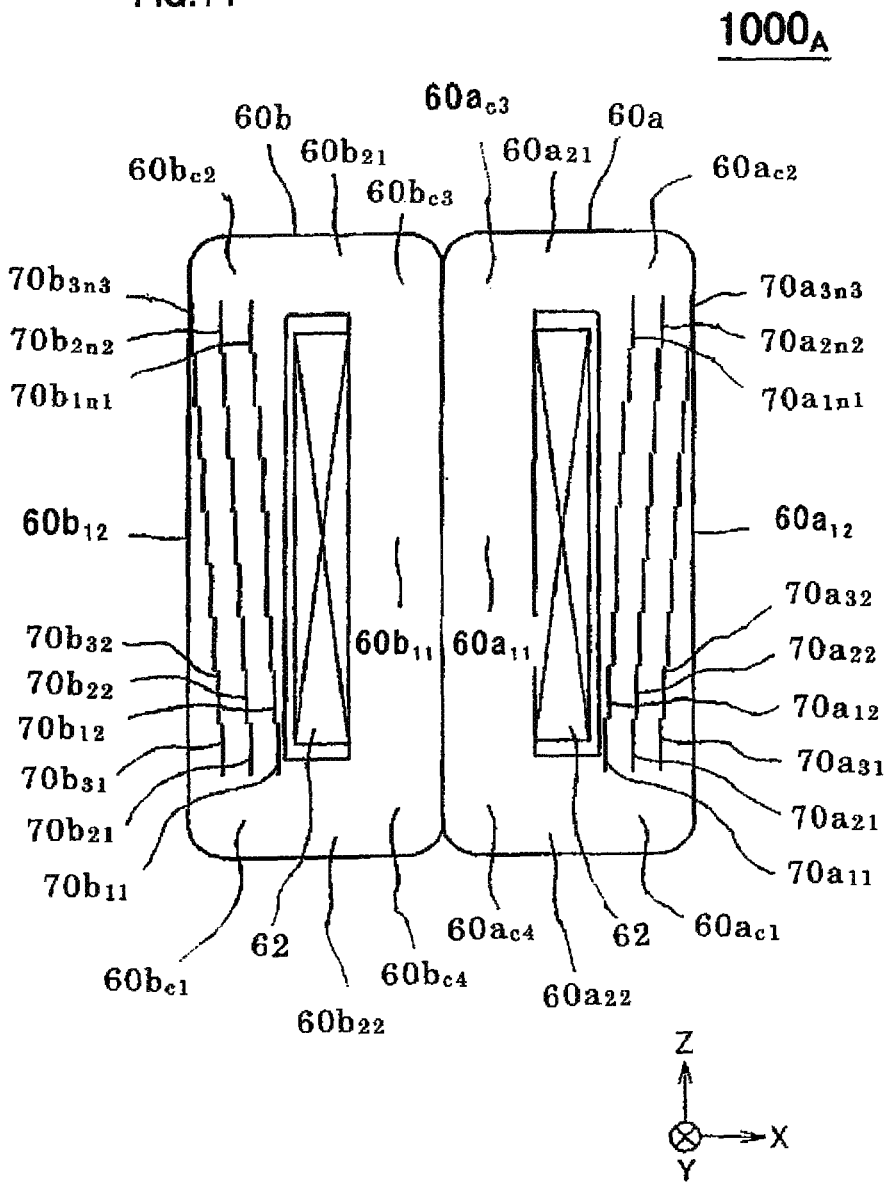
FIG. 14 is a view showing the arrangement of a transformer according to a preferred embodiment of the present invention.
Figure 15:
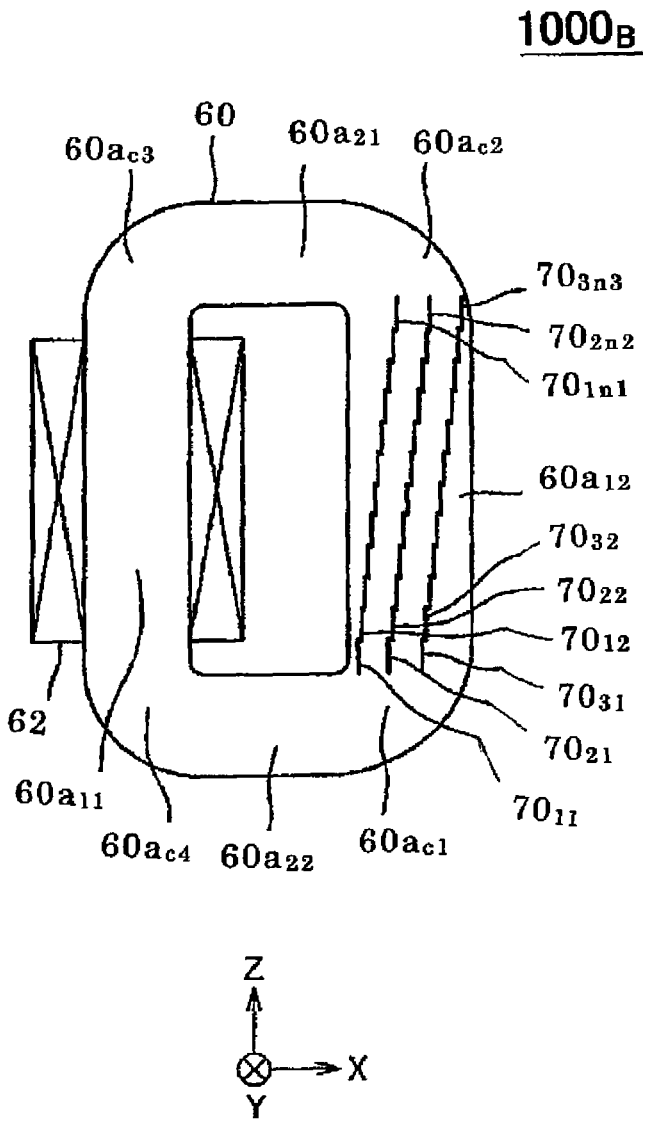
FIG. 15 is a view showing the arrangement of a transformer according to an embodiment of the present invention.
Figure 16A:
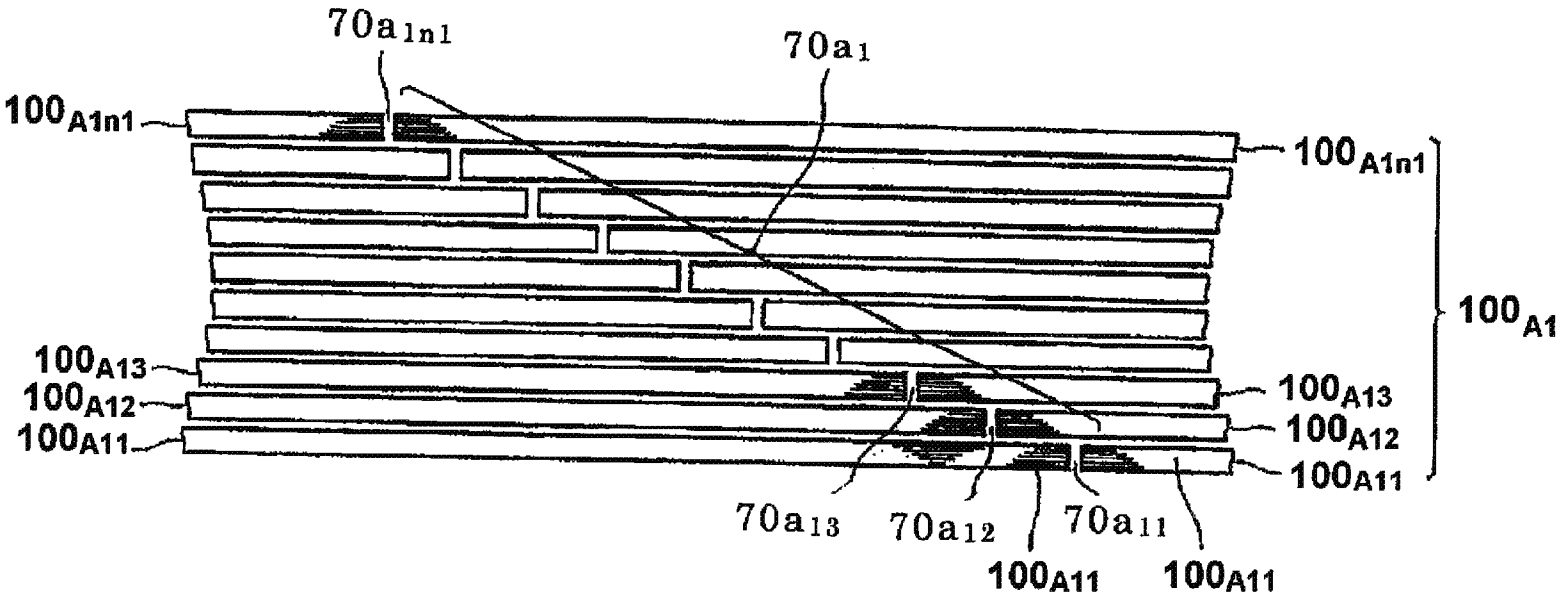
FIG. 16A is an explanatory view of an arrangement of connecting sections of a plurality of block-like laminated members of the iron core according to the transformer of FIGS. 14 and 15.
Figure 16B:
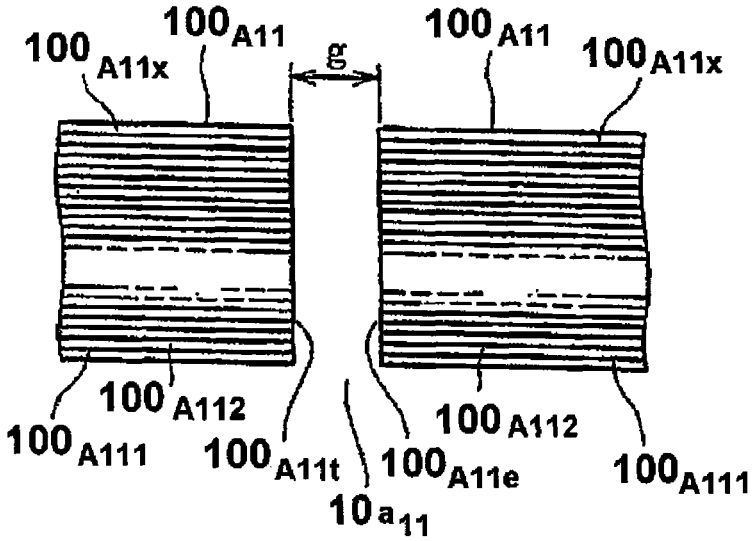
FIG. 16B is a view showing the connecting section of a single block-like laminated member of an iron core according to the transformer of FIGS. 14 and 15.
Figure 17:
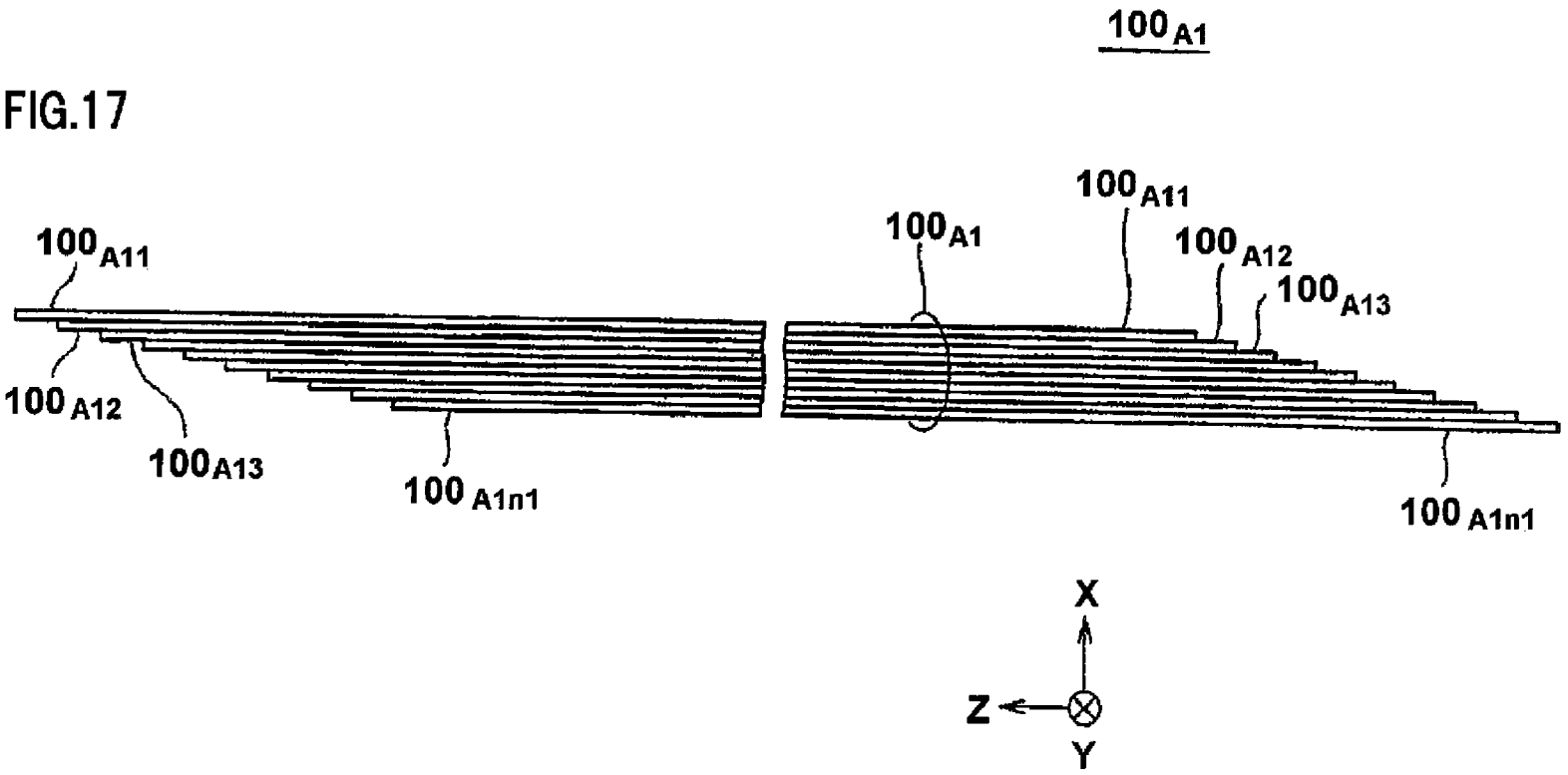
FIG. 17 is a view showing the laminated state of the iron core according to the transformer of FIGS. 14 and 15.
Figure 18:
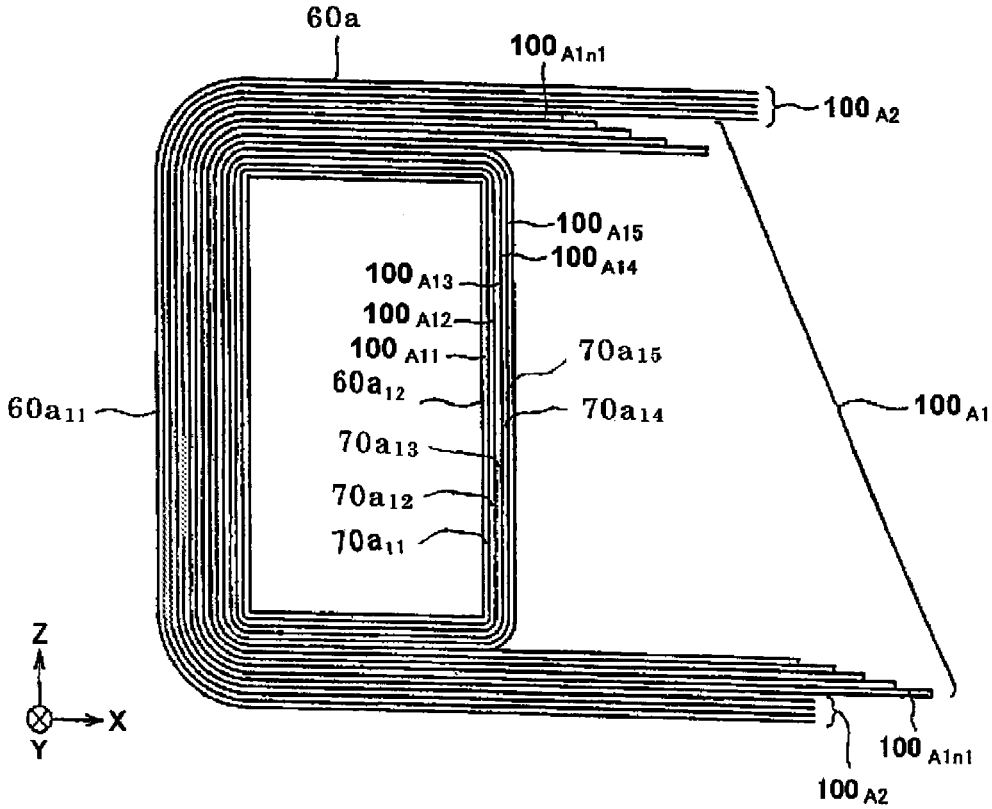
FIG. 18 is an explanatory view for processing the iron core according to the transformer of FIGS. 14 and 15.
Figure 19A:
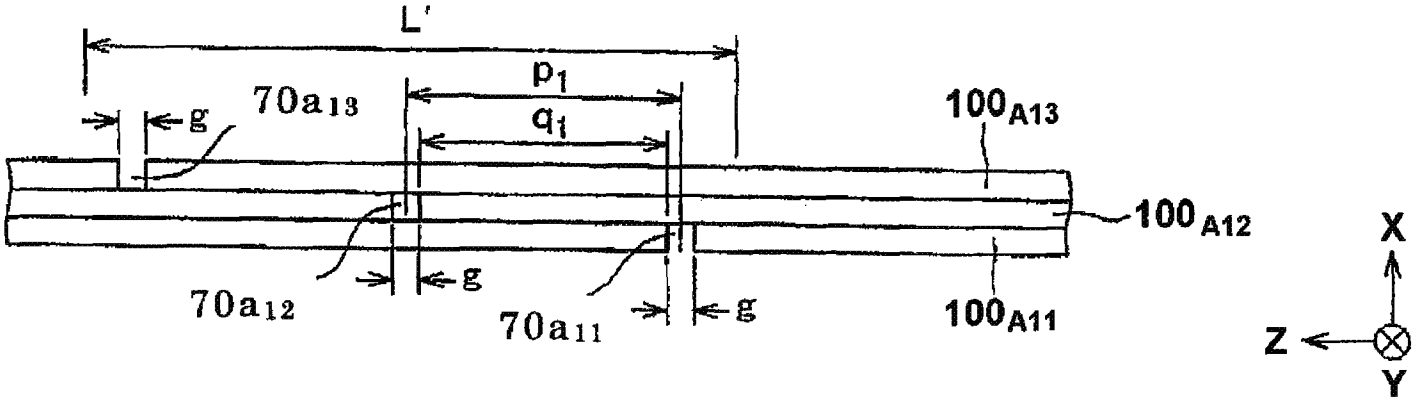
FIG. 19A is an explanatory view showing the operation and effect of the iron core according to the transformer of FIGS. 14 and 15.
Figure 19B:
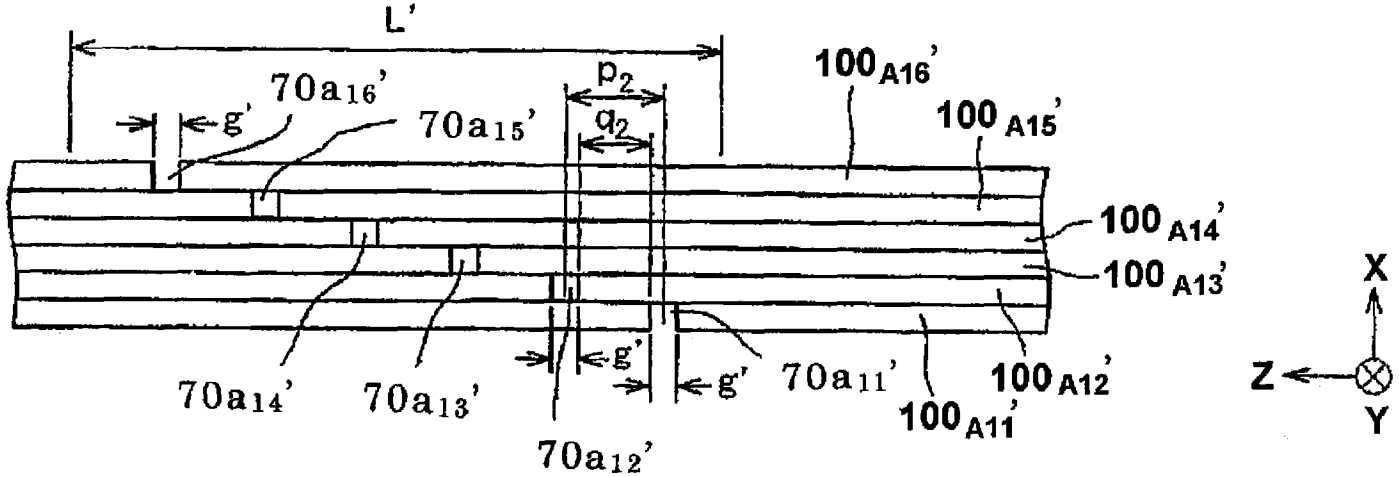
FIG. 19B is an explanatory view of the connecting section of the iron core according to the prior art transformer.
Figure 20:
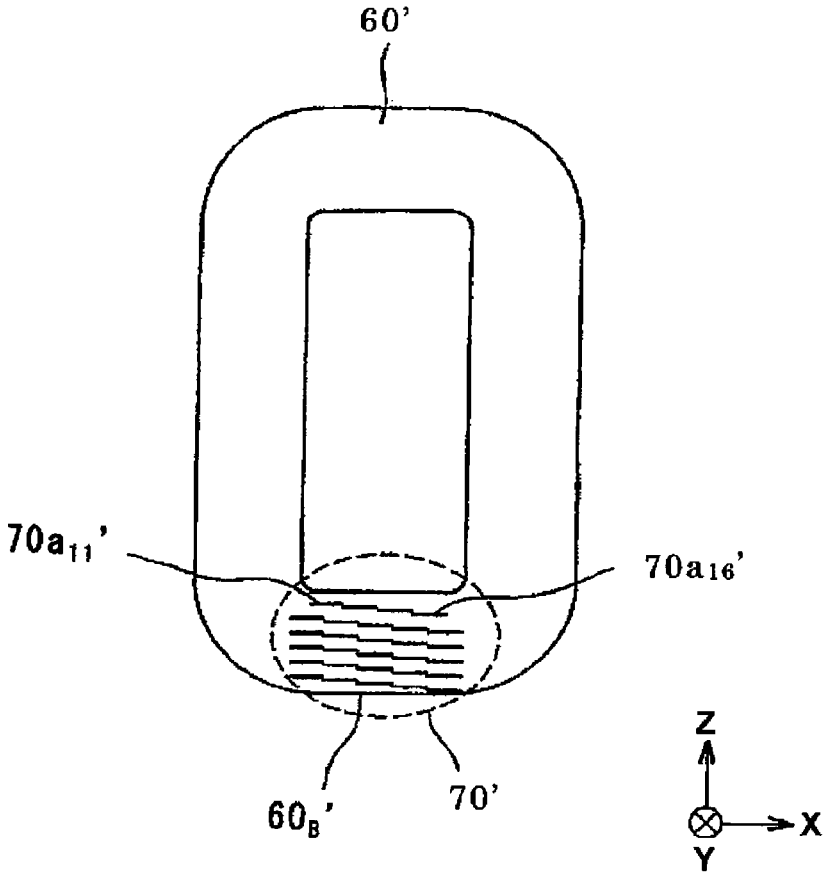
FIG. 20 is a view showing the example of arrangement of the iron core according to a prior art transformer.

FIGS. 14 through 20 are explanatory views of the embodiment of a transformer according to the present invention, which are explanatory views of the case where the requirements regarding the connecting section of the iron core are set as the characteristic configuration requirements of the present invention. FIGS. 14 and 15 are views showing the arrangement of a transformer according to the present embodiment, FIGS. 16A and 16B are explanatory views of the arrangement of the connecting section of the iron core in the transformer of FIGS. 14 and 15, FIG. 17 is a view showing the laminated state of the iron core in the transformer of FIGS. 14 and 15, FIG. 18 is an explanatory view showing the processing of the iron core in the transformer of FIGS. 14 and 15, FIG. 19A is an explanatory view of the effects of the iron core in the transformer of FIGS. 14 and 15, FIG. 19B is an explanatory view of the connecting section of the iron core according to the prior art transformer, and FIG. 20 is a view showing the arrangement example of an iron core in a prior art transformer.

FIG. 14 shows an example of the case of a transformer using two rectangular iron cores according to one embodiment of a transformer of the present invention.

In FIG. 14, $\mathbf{1000}_A$ is a transformer, 60*a* and 60*b* are rectangular iron cores, 62 are coils for exciting the iron cores 60*a* and 60*b* and generating induction voltage, $\mathbf{60}a_{11}$ is one long side out of the two long sides of the iron core 60*a* around which the coil 62 is wound (one long side), $\mathbf{60}a_{12}$ is the other long side around which the coil 62 is not wound (the other long side), $\mathbf{60}a_{21}$ and $\mathbf{60}a_{22}$ are short sides of the iron core 60*a*, $\mathbf{60}b_{11}$ is one long side out of the two long sides of the iron core 60*b* around which the coil 62 is wound (one long side), $\mathbf{60}b_{12}$ is the other long side around which the coil 62 is not wound (the other long side), $\mathbf{60}b_{21}$ and $\mathbf{60}b_{22}$ are short sides of the iron core 60*b*, $\mathbf{60}a_{c1}$ through $\mathbf{60}a_{c4}$ are corners of the iron core 60*a*, $\mathbf{60}b_{c1}$ through $\mathbf{60}b_{c4}$ are corners of the iron core 60*b*, $\mathbf{70}a_{11}$ through $\mathbf{70}a_{1n1}$, $\mathbf{70}a_{21}$ through $\mathbf{70}a_{2n2}$ (n2>n1) and $\mathbf{70}a_{31}$ through $\mathbf{70}a_{3n3}$ (n3>n2) are connecting sections of the iron core 60*a*, and $\mathbf{70}b_{11}$ through $\mathbf{70}b_{1n1}$, $\mathbf{70}b_{21}$ through $\mathbf{70}b_{2n2}$ (n2>n1) and $\mathbf{70}b_{31}$ through $\mathbf{70}b_{3n3}$ (n3>n2) are connecting sections of the iron core 60*b*. In the example, the long side (the other long side) $\mathbf{60}a_{12}$ includes a linear portion between the corners $\mathbf{60}a_{c1}$ and $\mathbf{60}a_{c2}$ and a portion of the respective corners $\mathbf{60}a_{c1}$ and $\mathbf{60}a_{c2}$, the long side (one long side) $\mathbf{60}a_{11}$ includes the linear portion between the corners $\mathbf{60}a_{c3}$ and $\mathbf{60}a_{c4}$ and a portion of the respective corners $\mathbf{60}a_{c3}$ and $\mathbf{60}a_{c4}$, the long side (the other long side) $\mathbf{60}b_{12}$ includes a linear portion between the corners $\mathbf{60}b_{c1}$ and $\mathbf{60}b_{c2}$ and a portion of the respective corners $\mathbf{60}b_{c1}$ and $\mathbf{60}b_{c2}$, and the long side (one long side) $\mathbf{60}b_{11}$ includes the linear portion between the corners $\mathbf{60}b_{c3}$ and $\mathbf{60}b_{c4}$ and a portion of the respective corners $\mathbf{60}b_{c3}$ and $\mathbf{60}b_{c4}$. Similarly, the short side $\mathbf{60}a_{21}$ includes a linear portion between the corners $\mathbf{60}a_{c2}$ and $\mathbf{60}a_{c3}$ and a portion of the respective corners $\mathbf{60}a_{c2}$ and $\mathbf{60}a_{c3}$, the short side $\mathbf{60}a_{22}$ includes the linear portion between the corners $\mathbf{60}a_{c1}$ and $\mathbf{60}a_{c4}$ and a portion of the respective corners $\mathbf{60}a_{c1}$ and $\mathbf{60}a_{c4}$, the short side $\mathbf{60}b_{21}$ includes a linear portion between the corners $\mathbf{60}b_{c2}$ and $\mathbf{60}b_{c3}$ and a portion of the respective corners $\mathbf{60}b_{c2}$ and $\mathbf{60}b_{c3}$, and the short side $\mathbf{60}b_{22}$ includes the linear portion between the corners $\mathbf{60}b_{c1}$ and $\mathbf{60}b_{c4}$ and a portion of the respective corners $\mathbf{60}b_{c1}$ and $\mathbf{60}b_{c4}$.

Each iron core 60*a* and 60*b* are formed by laminating a plurality of blocks formed by laminating a plurality of thin plates of strip-like magnetic materials (hereinafter referred to as block-like laminated members), wherein each of the block-like laminated member of the plurality of block-like laminated members have their leading ends and rear ends in the longitudinal direction connected to one another (abutted against one another) at connecting sections $\mathbf{70}a_{11}$, $\mathbf{70}a_{12}$, . . . $\mathbf{70}a_{1n1}$, $\mathbf{70}a_{21}$, $\mathbf{70}a_{22}$, . . . $\mathbf{70}a_{2n2}$, $\mathbf{70}a_{31}$, $\mathbf{70}a_{32}$, . . . , $\mathbf{70}a_{3n3}$, and at connecting sections $\mathbf{70}b_{11}$, $\mathbf{70}b_{12}$, . . . , $\mathbf{70}b_{1n1}$, $\mathbf{70}b_{21}$, $\mathbf{70}b_{22}$, . . . , $\mathbf{70}b_{2n2}$, $\mathbf{70}b_{31}$, $\mathbf{70}b_{32}$, . . . , $\mathbf{70}b_{3n3}$, and formed in a ring shape (n3>n2>n1). In other words, in the ring-shaped iron core 60*a*, the block-like laminated member disposed on the innermost circumference side has the leading end portion and the rear end portion thereof in the longitudinal direction connected via a connecting section $\mathbf{70}a_{11}$ into a ring shape, the plurality of block-like laminated members disposed on the outer side thereof have their leading ends and rear ends in the longitudinal direction connected via connecting sections $\mathbf{70}a_{12}$, . . . , $\mathbf{70}a_{1n1}$ into a ring shape, the block-like laminated members on the outer side thereof have their leading ends and rear ends in the longitudinal direction connected via connecting sections $\mathbf{70}a_{21}$, $\mathbf{70}a_{22}$, . . . , $\mathbf{70}a_{2n}$, $\mathbf{70}a_{31}$, $\mathbf{70}a_{32}$, . . . into a ring shape, and the block-like laminated member disposed on the outermost circumference side has its leading end and rear end in the longitudinal direction connected via a connecting section $\mathbf{70}a_{3n}$ into a ring shape. Similarly, in the ring-shaped iron core 60*b*, the block-like laminated member disposed on the innermost circumference side has the leading end portion and the rear end portion in the longitudinal direction connected via a connecting section $\mathbf{70}b_{11}$ into a ring shape, the plurality of block-like laminated members disposed on the outer side thereof have their leading ends and rear ends in the longitudinal direction connected via connecting sections $\mathbf{70}b_{12}$, . . . , $\mathbf{70}b_{1n1}$ into a ring shape, the block-like laminated members on the outer side thereof have their leading ends and rear ends in the longitudinal direction connected via connecting sections $\mathbf{70}b_{21}$, $\mathbf{70}b_{22}$, . . . , $\mathbf{70}b_{2n}$, $\mathbf{70}b_{31}$, $\mathbf{70}b_{32}$, . . . into a ring shape, and the block-like laminated member disposed on the outermost circumference side has its leading end and rear end in the longitudinal direction connected via a connecting section $\mathbf{70}b_{3n}$ into a ring shape. In each connecting section, each leading end and each rear end of the block-like laminated members have their end surfaces (end surfaces of the leading end and end surface of the rear end) butted against one another. Each of the plurality of block-like laminated members are formed so that a single block-like laminated member has a plurality of, for example, 20 to 30 sheets, of amorphous material thin plates (hereinafter referred to as amorphous sheet materials) with a thickness of approximately $0.025\times10^{-3}$ m, for example.

In the ring-shaped iron core 60*a*, the n1 numbers of block-like laminated members constituting the connecting sections $\mathbf{70}a_{11}$, $\mathbf{70}a_{12}$, . . . , $\mathbf{70}a_{1n1}$ form a single unit (first unit), the n2 numbers (n2>n1) of block-like laminated members constituting the connecting sections $\mathbf{70}a_{21}$, $\mathbf{70}a_{22}$, . . . $\mathbf{70}a_{2n2}$ also form a single unit (second unit), and the n3 numbers (n3>n2) of block-like laminated members constituting the connecting sections $\mathbf{70}a_{31}$, $\mathbf{70}a_{32}$, . . . , $\mathbf{70}a_{3n3}$ also form a single unit (third unit). In manufacturing the ring-shaped iron core 60*a*, the operation for butting the leading end and the rear end of each block-like laminated member to form the respective connecting section is performed per each unit. In other words, in the n1 numbers of block-like laminated members within the first unit on the innermost circumference side of the iron core 60*a*, the end surfaces of the leading ends and the end surfaces of the rear ends are butted against one another to form connecting sections $\mathbf{70}a_{11}$, $\mathbf{70}a_{12}$, . . . , $\mathbf{70}a_{1n1}$, thereafter, in the n2 numbers of block-like laminated members within the second unit disposed adjacent to the outer side of the first unit, the end surfaces of the leading ends and the end surfaces of the rear ends are butted against one another to form connecting sections $\mathbf{70}a_{21}$, $\mathbf{70}a_{22}$, . . . , $\mathbf{70}a_{2n2}$, and thereafter, in the n3 numbers of block-like laminated members within the third unit disposed adjacent to the outer side of the second unit, the end surfaces of the leading ends and the end surfaces of the rear ends are butted against one another to form connecting sections $\mathbf{70}a_{31}$, $\mathbf{70}a_{32}$, . . . , $\mathbf{70}a_{3n3}$.

The connecting sections $\mathbf{70}a_{11}$, $\mathbf{70}a_{12}$, . . . , $\mathbf{70}a_{1n1}$ are disposed within the first unit so that they are mutually displaced in the magnetic circuit direction, the connecting sections $\mathbf{70}a_{21}$, $\mathbf{70}a_{22}$, $\mathbf{70}a_{2n2}$ are disposed within the second unit so that they are mutually displaced in the magnetic circuit direction, and the connecting sections $70a_{31}$, $70a_{32}$, . . . , $70a_{3n3}$ are also disposed within the third unit so that they are mutually displaced in the magnetic circuit direction. The distance between adjacent connecting sections in the magnetic circuit direction of connecting sections $70a_{11}$, $70a_{12}$, . . . , $70a_{1n1}$ is greater than the distance between adjacent connecting sections in the magnetic circuit direction of connecting sections $70a_{21}$, $70a_{22}$, . . . , $70a_{2n2}$, and the distance between adjacent connecting sections in the magnetic circuit direction of connecting sections $70a_{21}$, $70a_{22}$, . . . , $70a_{2n2}$ is greater than the distance between adjacent connecting sections in the magnetic circuit direction of connecting sections $70a_{31}$, $70a_{32}$, . . . , $70a_{3n3}$. The sum of connecting sections (n1) of connecting sections $70a_{11}$, $70a_{12}$, . . . , $70a_{1n1}$ is smaller than the sum of connecting sections (n2) of connecting sections $70a_{21}$, $70a_{22}$, . . . $70a_{2n2}$ (n1<n2), and the sum of connecting sections (n2) of connecting sections $70a_{21}$, $70a_{22}$, . . . , $70a_{2n2}$ is smaller than the sum of connecting sections (n3) of connecting sections $70a_{31}$, $70a_{32}$, . . . , $70a_{3n3}$ (n2<n3).

Similarly in the ring-shaped iron core 60*b*, the n1 numbers of block-like laminated members constituting the connecting sections $70b_{11}$, $70b_{12}$, . . . , $70b_{1n1}$ form a single unit (first unit), the n2 numbers (n2>n1) of block-like laminated members constituting the connecting sections $70b_{21}$, $70b_{22}$, . . . $70b_{2n2}$ also form a single unit (second unit), and the n3 numbers (n3>n2) of block-like laminated members constituting the connecting sections $70b_{31}$, $70b_{32}$, . . . , $70b_{3n3}$ also form a single unit (third unit). In fabricating the ring-shaped iron core 60*b*, the operation for butting the leading end and the rear end of each block-like laminated member and forming the connecting section is performed per each unit. In other words, in the n1 numbers of block-like laminated members within the first unit on the innermost circumference side of the iron core 60*b*, the end surfaces of the leading ends and the end surfaces of the rear ends are butted against one another to form connecting sections $70b_{11}$, $70b_{12}$, . . . , $70b_{1n1}$, thereafter, in the n2 numbers of block-like laminated members within the second unit disposed adjacent to the outer side of the first unit, the end surfaces of the leading ends and the end surfaces of the rear ends are butted against one another to form connecting sections $70b_{21}$, $70b_{22}$, . . . , $70b_{2n2}$, and thereafter, in the n3 numbers of block-like laminated members within the third unit disposed adjacent to the outer side of the second unit, the end surfaces of the leading ends and the end surfaces of the rear ends are butted against one another to form connecting sections $70b_{31}$, $70b_{32}$, . . . , $70b_{3n3}$.

The connecting sections $70b_{11}$, $70b_{12}$, . . . , $70b_{1n1}$ are disposed within the first unit so that they are mutually displaced in the magnetic circuit direction, the connecting sections $70b_{21}$, $70b_{22}$, . . . , $70b_{2n2}$ are disposed within the second unit so that they are mutually displaced in the magnetic circuit direction, and the connecting sections $70b_{31}$, $70b_{32}$, . . . , $70b_{3n3}$ are also disposed within the third unit so that they are mutually displaced in the magnetic circuit direction. The distance between adjacent connecting sections in the magnetic circuit direction of connecting sections $70b_{11}$, $70b_{12}$, . . . , $70b_{1n1}$ is greater than the distance between adjacent connecting sections in the magnetic circuit direction of connecting sections $70b_{21}$, $70b_{22}$, . . . , $70b_{2n2}$, and the distance between adjacent connecting sections in the magnetic circuit direction of connecting sections $70b_{21}$, $70b_{22}$, . . . , $70b_{2n2}$ is greater than the distance between adjacent connecting sections in the magnetic circuit direction of connecting sections $70b_{31}$, $70b_{32}$, . . . $70b_{3n3}$. The sum of connecting sections (n1) of connecting sections $70b_{11}$, $70b_{12}$, $70b_{1n1}$ is smaller than the sum of connecting sections (n2) of connecting sections $70b_{21}$, $70b_{22}$, . . . , $70b_{2n2}$ (n1<n2), and the sum of connecting sections (n2) of connecting sections $70b_{21}$, $70b_{22}$, . . . , $70b_{2n2}$ is smaller than the sum of connecting sections (n3) of connecting sections $70b_{31}$, $70b_{32}$, . . . , $70b_{3n3}$ (n2<n3). In other words, the iron cores 60*a* and 60*b* are each formed so that the unit forming the inner circumference portion of the iron core has a smaller number of block-like laminated members in a unit compared to the unit forming the outer circumference portion of the iron core. According to such arrangement, the number of connecting sections are reduced at the inner circumference side portion of the iron core, according to which the magnetic resistance of the magnetic circuit is reduced, and the magnetic flux transits via long pitches to the side of the adjacent block-like laminated members and flows smoothly, and as a result, the amount of magnetic flux flowing through the iron core in the inner circumference portion of the iron core can be increased and thus the overall amount of magnetic flux flowing through the iron core can be increased, according to which the efficiency of the transformer can be improved.

Further, both iron cores 60*a* and 60 are designed so that the number of laminated magnetic thin plates per single block-like laminated member is greater in the block-like laminated member constituting the inner-circumference-side portion of the iron core than the block-like laminated member constituting the outer-circumference-side portion of the iron core. In other words, in the iron core 60*a*, the n1 block-like laminated members within the innermost circumference-side unit (first unit) constituting the connecting sections $70a_{11}$, $70a_{12}$, . . . , $70a_{1n1}$ are each formed by laminating 30 sheets of amorphous sheet members with a thickness of approximately $0.025\times10^{-3}$ m, the n2 block-like laminated members within the unit (second unit) constituting the connecting sections $70a_{21}$, $70a_{22}$, . . . $70a_{2n2}$ are each formed by laminating 25 sheets of amorphous sheet members with a thickness of approximately $0.025\times10^{-3}$ m, and the n3 block-like laminated members within the outermost circumference-side unit (third unit) constituting the connecting sections $70a_{31}$, $70a_{32}$, . . . , $70a_{3n3}$ are each formed by laminating 20 sheets of amorphous sheet members with a thickness of approximately $0\ 025\times10^{-3}$ m. Similarly, in the iron core 60*b*, the n1 block-like laminated members within the innermost circumference-side unit (first unit) constituting the connecting sections $70b_{11}$, $70b_{12}$, . . . , $70b_{1n1}$ are each formed by laminating 30 sheets of amorphous sheet members with a thickness of approximately $0.025\times10^{-3}$ m, the n2 block-like laminated members within the unit (second unit) constituting the connecting sections $70b_{21}$, $70b_{22}$, . . . , $70b_{2n2}$ are each formed by laminating 25 sheets of amorphous sheet members with a thickness of approximately $0.025\times10^{-3}$ m, and the n3 block-like laminated members within the outermost circumference-side unit (third unit) constituting the connecting sections $70b_{31}$, $70b_{32}$, . . . , $70b_{3n3}$ are each formed by laminating 20 sheets of amorphous sheet members with a thickness of approximately $0.025\times10^{-3}$ m. According to such arrangement, in each of the iron cores 60*a* and 60*b*, a certain predetermined thickness can be ensured for each of the iron cores 60*a* and 60*b* with the number of block-like laminated members reduced and the number of connecting sections reduced at the inner-circumference-side portion of the iron core so as to enable magnetic flux to be passed therethrough easily. According to the above-described arrangement, the numbers of amorphous sheet members constituting a single block-like laminated member are varied among units, but in another example, it is possible to vary the number of amorphous sheet members in block-like laminated member units. For example, in iron core 60$a$, the number of laminated layers of amorphous sheet materials in the block-like laminated member formed in a ring shape in connecting section 70$a_{11}$ can be formed greater than the number of laminated layers of amorphous sheet materials in the block-like laminated member formed in a ring shape in the connecting section 70$a_{12}$.

In the ring-shaped iron core 60$a$, the connecting sections 70$a_{11}$, 70$a_{12}$, . . . , 70$a_{1n1}$, 70$a_{21}$, 70$a_{22}$, . . . , 70$a_{2n1}$, 70$a_{31}$, 70$a_{32}$, . . . , 70$a_{3n3}$ are arranged in a dispersed manner in a longer area in the other long side 60$a_{12}$ or in the linear portion of the long side 60$a_{12}$ than the length of the linear portion of the short side 60$a_{12}$ or in the linear portion of the short side 60$a_{22}$. In the arrangement of FIG. 14, the respective connecting sections are arranged in a dispersed manner across the length area corresponding to the whole length of the linear portion of the other long side 60$a_{12}$. Similarly, the connecting sections 70$b_{11}$, 70$b_{12}$, . . . , 70$b_{1n1}$, 70$b_{21}$, 70$b_{22}$, . . . , 70$b_{2n2}$, 70$b_{31}$, 70$b_{32}$, . . . , 70$b_{3n3}$ are arranged in a dispersed manner in a longer area in the long side 60$b_{12}$ or in the linear portion of the long side 60$b_{12}$ than the length of the linear portion of the short side 60$b_{12}$ or the linear portion of the short side 60$b_{22}$. In the arrangement of FIG. 14, the respective connecting sections are arranged in a dispersed manner across the length area corresponding to the whole length of the linear portion of the other long side 60$b_{12}$. Further, an arrangement can be adopted in which the connecting sections 70$a_{11}$, 70$a_{12}$, . . . , 70$a_{1n1}$, 70$a_{21}$, 70$a_{22}$, . . . , 70$a_{2n1}$, 70$a_{31}$, 70$a_{32}$, . . . , 70$a_{3n3}$ are arranged in a dispersed manner in the long side 60$a_{12}$ or in the linear portion of the long side 60$a_{12}$ in a length area 1.3 times or longer than the length of the linear portion of the short side 60$a_{21}$ or in the linear portion of the short side 60$a_{22}$, and the connecting sections 70$b_{11}$, 70$b_{12}$, . . . , 70$b_{1n1}$, 70$b_{21}$, 70$b_{22}$, . . . , 70$b_{2n1}$, 70$b_{31}$, 70$b_{32}$, . . . , 70$b_{3n3}$ are arranged in a dispersed manner in the other long side 60$b_{12}$ or in the linear portion of the long side 60$b_{22}$ in a length area 1.3 times or longer than the length of the linear portion of the short side 60$b_{23}$ or in the linear portion of the short side 60$b_{22}$, or in another example, the connecting sections 70$a_{11}$, 70$a_{12}$, . . . , 70$a_{1n1}$, 70$a_{21}$, 70$a_{22}$, . . . 70$a_{2n1}$, 70$a_{31}$, 70$a_{32}$ . . . , 70$a_{3n3}$ are arranged in a dispersed manner in the other long side 60$a_{12}$ or in the linear portion of the long side 60$a_{12}$ in a length area 50% or longer than the length of the linear portion, and the connecting sections 70$b_{11}$, 70$b_{12}$, . . . , 70$b_{1n1}$, 70$b_{21}$, 70$b_{22}$, . . . , 70$b_{2n1}$, 70$b_{31}$, 70$b_{32}$, . . . , 70$b_{3n3}$ are arranged in a dispersed manner in the long side 60$b_{12}$ or in the linear portion of the long side 60$b_{12}$ in a length area 50% or longer than the length of the linear portion.

Further, the coil 62 is formed so that a secondary-side coil which is a low pressure-side coil is disposed on the inner side and a primary-side coil which is a high pressure-side coil is disposed on the outer side, wherein high pressure is applied to the primary-side coil to excite the iron cores 60$a$ and 60$b$ and to generate a low-pressure induction voltage on the secondary-side coil.

FIG. 15 is an example of a transformer using a single rectangular iron core out of the embodiments of a transformer according to the present invention.

In FIG. 15, 1000$_B$ refers to a transformer, 60 refers to a rectangular iron core, 62 refers to a coil for exciting the iron core 60 and for generating induction voltage, 60$a_{22}$ refers to a long side (one long side) of the two long sides of the iron core 60 around which the coil 62 is wound, 60$a_{12}$ is another long side (the other long side) around which the coil 62 is not wound, 60$a_{21}$ and 60$a_{22}$ are short sides of the iron core 60, 60$a_{c1}$ through 60$a_{c4}$ are corners of the iron core 60, and 70$_{11}$ through 70$_{1n1}$, 70$_{21}$ through 70$_{2n2}$ (n2>n1) and 70$_{31}$ through 70$_{3n3}$ (n3>n2) are connecting sections of the iron core 60. Here, the long side (the other long side) 60$a_{12}$ includes a linear portion between corners 60$a_{c1}$ and 60$a_{c2}$ and a portion of the respective corners 60$a_{c1}$ and 60$a_{c2}$, and the long side (one long side) 60$a_{11}$ includes a linear portion between corners 60$a_{c3}$ and 60$a_{c4}$ and a portion of the respective corners 60$a_{c3}$ and 60$a_{c4}$. Similarly, the short side 60$a_{21}$ includes a linear portion between the corners 60$a_{c2}$ and 60$a_3$ and a portion of the respective corners 60$a_{c2}$ and 60$a_{c3}$, and the short side 60$a_{22}$ includes a linear portion between the corners 60$a_{c1}$ and 60$a_{c4}$ and a portion of the respective corners 60$a_{c1}$ and 60$a_{4c}$.

The iron core 60 is formed by laminating a plurality of blocks formed by laminating a plurality of strip-like magnetic thin plates (hereinafter referred to as block-like laminated members), wherein the respective block-like laminated members of the plurality of block-like laminated members have their leading ends and rear ends in the longitudinal direction thereof connected via connecting sections 70$_{11}$, 70$_{12}$, . . . , 70$_{1n1}$, 70$_{21}$, 70$_{22}$, . . . , 70$_{2n2}$, 70$_{32}$, 70$_{32}$, . . . , 70$_{3n3}$ (n3>n2>n1) and formed into a ring shape. That is, in the ring-shaped iron core 60, the block-like laminated member disposed on the innermost circumference side is connected via a connecting section 70$_{11}$ and formed into a ring shape, the block-like laminated members disposed on the outer side thereof are connected via connecting sections 70$_{12}$, . . . and 70$_{1n1}$ and formed into a ring shape, the block-like laminated members on the outer side thereof are connected via connecting sections 70$_{21}$, 70$_{22}$, . . . 70$_{2n}$, 70$_{31}$, 70$_{32}$, . . . and formed into a ring shape, and the block-like laminated member disposed on the outermost circumference side is connected via a connection section 70$_{3n}$ and formed into a ring shape. In the respective connecting sections, the leading end and the rear end of each block-like laminated member have their end surfaces (end surface of the leading end and the end surface of the rear end) opposed and butted against one another. In the above-mentioned block like laminated members, similar to the case of FIG. 14, a single block-like laminated member is formed by laminating a plurality of (20 to 30 sheets, for example) amorphous material thin plates (hereinafter referred to as amorphous sheet materials) with a thickness of approximately $0.025\times10^{-3}$ m.

In the ring-shaped iron core 60, the n1 numbers of block-like laminated members constituting the connecting sections 70$_{11}$, 70$_{12}$, . . . , 70$_{1n1}$ form a single unit (first unit), the n2 numbers (n2>n1) of block-like laminated members constituting the connecting sections 70$_{21}$, 70$_{22}$, . . . 70$_{2n2}$ also form a single unit (second unit), and the n3 numbers (n3>n2) of block-like laminated members constituting the connecting sections 70$_{31}$, 70$_{32}$, . . . , 70$_{3n3}$ also form a single unit (third unit). In manufacturing the ring-shaped iron core 60, the operation for butting the leading end and the rear end of each block-like laminated member to form connecting sections is performed per each unit. In other words, in the n1 numbers of block-like laminated members within the first unit on the innermost circumference side of the iron core 60, the end surfaces of the leading ends and the end surfaces of the rear ends are butted against one another to form connecting sections 70$_{11}$, 70$_{12}$, . . . , 70$_{1n1}$, thereafter, in the n2 numbers of block-like laminated members within the second unit disposed adjacent to the outer side of the first unit, the end surfaces of the leading ends and the end surfaces of the rear ends are butted against one another to form connecting sections 70$_{21}$, 70$_{22}$, . . . , 70$_{2n2}$, and thereafter, in the n3 numbers of block-like laminated members within the third unit disposed adjacent to the outer side of the second unit, the end surfaces of the leading ends and the end surfaces of the rear ends are butted against one another to form connecting sections $70_{31}$, $70_{32}$, . . . , $70_{3n3}$.

The connecting sections $70_{11}$, $70_{12}$, . . . , $70_{1n1}$ are disposed within the first unit so that they are mutually displaced in the magnetic circuit direction, the connecting sections $70_{21}$, $70_{22}$, . . . , $70_{2n2}$ are disposed within the second unit so that they are mutually displaced in the magnetic circuit direction, and the connecting sections $70_{31}$, $70_{32}$, . . . , $70_{3n3}$ are also disposed within the third unit so that they are mutually displaced in the magnetic circuit direction. The distance between adjacent connecting sections in the magnetic circuit direction of connecting sections $70_{11}$, $70_{12}$, . . . , $70_{1n1}$ is greater than the distance between adjacent connecting sections in the magnetic circuit direction of connecting sections $70_{21}$, $70_{22}$, . . . , $70_{2n2}$, and the distance between adjacent connecting sections in the magnetic circuit direction of connecting sections $70_{21}$, $70_{22}$, . . . , $70_{2n2}$ is greater than the distance between adjacent connecting sections in the magnetic circuit direction of connecting sections $70_{31}$, $70_{32}$, . . . , $70_{3n3}$. The sum of connecting sections (n1) of connecting sections $70_{11}$, $70_{12}$, . . . , $70_{1n1}$ is smaller than the sum of connecting sections (n2) of connecting sections $70_{21}$, $70_{22}$, . . . , $70_{2n2}$ (n1<n2), and the sum of connecting sections (n2) of connecting sections $70_{21}$, $70_{22}$, . . . , $70_{2n2}$ is smaller than the sum of connecting sections (n3) of connecting sections $70_{31}$, $70_{32}$, . . . , $70_{3n3}$ (n2<n3). In other words, the iron core 60 is formed so that the unit forming the inner circumference portion of the iron core has a smaller number of block-like laminated members in a unit compared to the unit forming the outer circumference portion of the iron core. According to such arrangement, the number of connecting sections are reduced at the inner circumference side portion of the iron core, according to which the magnetic resistance of the magnetic circuit is reduced, and the magnetic flux transits via long pitches to the side of the adjacent block-like laminated members and flows smoothly, and as a result, the amount of magnetic flux flowing through the iron core in the inner circumference portion of the iron core can be increased and thus the overall amount of magnetic flux flowing through the iron core can be increased, according to which the efficiency of the transformer can be improved.

Further, the iron core 60 is designed so that the number of laminated magnetic thin plates in a single block-like laminated member is greater in the block-like laminated member constituting the inner-circumference-side portion of the iron core than the block-like laminated member constituting the outer-circumference-side portion of the iron core. In other words, in the iron core 60, the n1 block-like laminated members within the innermost circumference-side unit (first unit) constituting the connecting sections $70_{11}$, $70_{12}$, . . . , $70_{1n1}$ are each formed by laminating 30 sheets of amorphous sheet members with a thickness of approximately $0.025\times10^{-3}$ m, the n2 block-like laminated members within the unit (second unit) constituting the connecting sections $70_{21}$, $70_{22}$, . . . , $70_{2n2}$ are each formed by laminating 25 sheets of amorphous sheet members with a thickness of approximately $0.025\times10^{-3}$m, and the n3 block-like laminated members within the outermost circumference-side unit (third unit) constituting the connecting sections $70_{31}$, $70_{32}$, . . . , $70_{3n3}$ are each formed by laminating 20 sheets of amorphous sheet members with a thickness of approximately $0.025\times10^{-3}$ m. According to such arrangement, in the iron core 60, a certain predetermined thickness can be ensured for the iron core 60 with the number of block-like laminated members reduced and the number of connecting sections reduced at the inner-circumference-side portion of the iron core so as to enable magnetic flux to be passed therethrough easily.

According to the above-described arrangement, the numbers of amorphous sheet members constituting a single block-like laminated member are varied among units, but in another example, it is possible to vary the number of amorphous sheet members per block-like laminated member units. For example, in the first unit, the number of laminated layers of amorphous sheet materials in the block-like laminated member formed in a ring shape in connecting section $70_{11}$ can be formed greater than the number of laminated layers of amorphous sheet materials in the block-like laminated member formed in a ring shape in the connecting section $70_{12}$, or in the first unit, the number of laminated layers of the amorphous sheet materials in the plurality of block-like laminated members in the inner circumference side of the iron core can be formed greater than the number of laminated layers of the amorphous sheet materials in the outer circumference side of the iron core, or the number of laminated layers of the amorphous sheet materials of one or a plurality of block-like laminated members on the inner circumference side of the iron core in the first unit can be formed greater than the number of laminated layers of the amorphous sheet materials of the block-like laminated members within the second unit or the third unit.

Further, in the respective arrangements, the amorphous sheet materials of the respective block-like laminated members is formed by laminating amorphous sheets having a fixed thickness, such as a thickness of approximately $0.025\times10^{-3}$ m, but the block-like laminated members can be formed by laminating amorphous sheet materials having varied thicknesses. For example, the respective block-like laminated members in the first unit can be formed by laminating amorphous sheet materials having a thickness greater than approximately $0.025\times10^{-3}$ m, and the block-like laminated members in the second and third units can be formed by laminating amorphous sheet materials having a thickness of approximately $0.025\times10^{-3}$ m.

In the ring-shaped iron core 60, the connecting sections $70_{11}$, $70_{12}$, . . . , $70_{1n1}$, $70_{21}$, $70_{22}$, . . . $70_{2n1}$, $70_{31}$, $70_{32}$, . . . , $70_{3n3}$ are arranged in a dispersed manner in a longer area in the other long side (the long side around which the coil 62 is not wound) $60a_{12}$ or in the linear portion of the other long side $60a_{12}$ than the length of the linear portion of the short side $60a_{12}$ or in the linear portion of the short side $60a_{22}$. In the arrangement of FIG. 15, the respective connecting sections are arranged in a dispersed manner across the length area corresponding to the whole length of the linear portion of the other long side $60a_{12}$. Similarly, the connecting sections $70_{11}$, $70_{12}$, . . . , $70_{1n1}$, $70_{21}$, $70_{22}$, . . . , $70_{2n1}$, $70_{31}$, $70_{32}$, . . . , $70_{3n3}$ are arranged in a dispersed manner in the other long side $60a_{12}$ or in the linear portion of the other long side $60a_{12}$ in a length area 1.3 times or longer than the length of the linear portion of the short side $60a_{21}$ or the linear portion of the short side $60a_{22}$, and the connecting sections $70_{11}$, $70_{12}$, . . . , $70_{1n1}$, $70_{21}$, $70_{22}$, . . . , $70_{2n1}$, $70_{31}$, $70_{32}$, . . . , $70_{3n3}$ are arranged in a dispersed manner in the long side $60a_{12}$ or in the linear portion of the long side $60a_{12}$ in a length area 50% or greater than the length of the linear portion.

Further, the coil 62 is formed so that a secondary-side coil which is a low pressure-side coil is disposed on the inner side and a primary-side coil which is a high pressure-side coil is disposed on the outer side, wherein high pressure is applied to the primary-side coil to excite the iron core 60 and to generate a low-pressure induction voltage on the secondary-side coil.

The components included in the arrangements of FIGS. 14 and 15 that appear in the following description are denoted with the same reference numbers as those in FIGS. 14 and 15.

FIGS. 16A and 16B are explanatory views of the arrangement of the connecting sections of the iron core used in the transformer of FIGS. 14 and 15. According to the transformer of FIGS. 14 and 15, the arrangements of the connecting sections of the iron cores are substantially the same, so that in FIGS. 16A and 16B, the arrangement of the iron core $\mathbf{60}a_{12}$ used in transformer 1000A of FIG. 14 will be shown. FIG. 16A shows connecting sections of a plurality of block-like laminated members within the first unit of the iron core $\mathbf{60}a_{12}$, and FIG. 16B shows a connecting section of the single block-like laminated member disposed on the innermost circumference side of the iron core out of the plurality of said block-like laminated members.

In FIG. 16A, $\mathbf{100}_{A11}$, $\mathbf{100}_{A12}$, $\mathbf{100}_{A13}$, . . . , $\mathbf{100}_{A1n1}$ respectively refer to block-like laminated members, $\mathbf{100}_{A1}$ refers to a first unit composed of n1 numbers of block-like laminated members $\mathbf{100}_{A11}$, $\mathbf{100}_{A12}$, $\mathbf{100}_{A13}$, . . . , $\mathbf{100}_{A1n1}$ and $\mathbf{70}a_1$ refers to the connecting section in the first unit $\mathbf{100}_{A1}$. The connecting sections $\mathbf{70}a_{11}$, $\mathbf{70}a_{12}$, $\mathbf{70}a_{13}$, . . . , $\mathbf{70}a_{1n1}$ are respectively formed by butting together the end surfaces of a leading end and end surfaces of a rear end of the block-like laminated members $\mathbf{100}_{A11}$, $\mathbf{100}_{A12}$, $\mathbf{100}_{A13}$, . . . , $\mathbf{100}_{A1n1}$, by which the respective block-like laminated members are formed in a ring-shape. The connecting section $\mathbf{70}a_1$ is composed of respective connecting sections $\mathbf{70}a_{11}$, $\mathbf{70}a_{12}$, $\mathbf{70}a_{13}$, . . . , $\mathbf{70}a_{1n1}$. In the first unit $\mathbf{100}_{A1}$, the respective block-like laminated members $\mathbf{100}_{A11}$, $\mathbf{100}_{A12}$, $\mathbf{100}_{A13}$, . . . , $\mathbf{100}_{A1n1}$ are formed by laminating a plurality of magnetic thin plates, for example, 30 sheets of amorphous sheet materials having a thickness of approximately $0.025\times10^{-3}$ m, wherein the respective connecting sections $\mathbf{70}a_{11}$, $\mathbf{70}a_{12}$, $\mathbf{70}a_{13}$, . . . , $\mathbf{70}a_{1n1}$ are disposed so that they are mutually displaced in the magnetic circuit direction (+− directions in the Z axis), and wherein the distances between the adjacent connecting sections in the magnetic circuit direction (amount of displacement) are made equal. For example, the length of each connecting section $\mathbf{70}a_{11}$, $\mathbf{70}a_{12}$, $\mathbf{70}a_{13}$, . . . , $\mathbf{70}a_{1n1}$ in the magnetic circuit direction is approximately $5\times10^{-3}$ m, and the distance between adjacent connecting sections in the magnetic circuit direction (amount of displacement) is approximately $13\times10^{-3}$ m (in this case, the distance between center lines of adjacent connecting sections in the magnetic circuit direction is approximately $18\times10^{-3}$ m). Further, in the second unit, the respective block-like laminated members are formed by laminating a smaller number of sheets of magnetic thin plates than the first unit, for example, laminating twenty-five sheets of amorphous sheets having a thickness of approximately $0.025\times10^{-3}$ m, and the respective connecting sections are displaced mutually in the magnetic circuit direction (+− directions in the Z axis), wherein the distances between adjacent connecting sections in the magnetic circuit direction (amounts of displacement) are set to be equal, wherein for example, the length of the connecting sections in the magnetic circuit direction is approximately $5\times10^{-3}$ m, and the distance between adjacent connecting sections in the magnetic circuit direction (amounts of displacement) is approximately $10\times10^{-3}$ m (in this case, the distance between center lines of adjacent connecting sections in the magnetic circuit direction is approximately $15\times10^{-3}$ m). Further, in the third unit, the respective block-like laminated members are formed by laminating a smaller number of sheets of magnetic thin plates than the first unit, for example, laminating twenty sheets of amorphous sheets having a thickness of approximately $0.025\times10^{-3}$ m, and the respective connecting sections are displaced mutually in the magnetic circuit direction (+− directions in the Z axis), wherein the distances between adjacent connecting sections in the magnetic circuit direction (amounts of displacement) are set to be equal, wherein for example, the length of the connecting sections in the magnetic circuit direction is approximately $5\times10^{-3}$ m, and the distance between adjacent connecting sections in the magnetic circuit direction (amount of displacement) is approximately $7\times10^{-3}$ m (in this case, the distance between center lines of adjacent connecting sections in the magnetic circuit direction is approximately $12\times10^{-3}$ m).

Further, in FIG. 16B, $\mathbf{100}_{A111}$, $\mathbf{100}_{A112}$, . . . , $\mathbf{100}_{A111x}$ are each magnetic thin plates constituting the block-like laminated member $\mathbf{100}_{A11}$, which are amorphous sheet materials having a thickness of approximately $0.025\times10^{-3}$ m, for example. The block-like laminated member $\mathbf{100}_{A11}$ is formed by laminating x numbers of magnetic thin plates, such as laminating thirty sheets of amorphous sheet materials having a thickness of approximately $0.025\times10^{-3}$ m, for example. Reference $\mathbf{100}_{A11t}$ is an end surface of a leading end of the block-like laminated member $\mathbf{100}_{A11}$, $\mathbf{100}_{A11e}$ is an end surface of a rear end of the block-like laminated member $\mathbf{100}_{A11}$, and g refers to the distance (gap) between both end surfaces $\mathbf{100}_{A11t}$ and $\mathbf{100}_{A11e}$. The distance g is, for example, $3\times10^{-3}$m through $5\times10^{-3}$m. The same applies for other block-like laminated members $\mathbf{100}_{A12}$, $\mathbf{100}_{A113}$, . . . , $\mathbf{100}_{A1n1}$ within the first unit $\mathbf{100}_{A1}$. The block-like laminated members constituting the second unit or the block-like laminated members constituting the third unit are formed by reducing the number of laminated magnetic thin plates than those constituting the block-like laminated members in the first unit $\mathbf{100}_{A1}$, wherein for example, the block-like laminated member constituting the second unit is formed by laminating twenty-five amorphous sheet materials having a thickness of approximately $0.025\times10^{-3}$ m, for example, and the block-like laminated member constituting the third unit is formed by laminating twenty amorphous sheet materials having a thickness of approximately $0.025\times10^{-3}$ m, for example.

In the following description, the components included in the arrangements of FIGS. 16A and 16B are denoted with the same reference numbers as those in FIGS. 16A and 16B.

FIG. 17 is a view showing the laminated state of the iron core according to the transformer illustrated in FIGS. 14 and 15. FIG. 17 shows the laminated state of block-like laminated members $\mathbf{100}_{A11}$, $\mathbf{100}_{A12}$, $\mathbf{100}_{A13}$, . . . , $\mathbf{100}_{A1n1}$ in a linear state prior to performing a bending process in the first unit $\mathbf{100}_{A1}$ of the transformer of FIG. 14.

Each of the block-like laminated members $\mathbf{100}_{A11}$, $\mathbf{100}_{A12}$, $\mathbf{100}_{A13}$, . . . , $\mathbf{100}_{A1n1}$ laminated as shown in FIG. 17 are subjected to a bending process to be bent within the ZX plane, wherein the end surfaces of the respective leading ends and end surfaces of the respective rear ends are opposed to one another to form connecting sections $\mathbf{70}a_{11}$, $\mathbf{70}a_{12}$, . . . $\mathbf{70}a_{1n1}$ and formed in a ring shape.

FIG. 18 is an explanatory view of processing of the iron core according to the transformer shown in FIGS. 14 and 15. FIG. 18 illustrates an example where the iron core 60*a* of the transformer shown in FIG. 14 is subjected to a bending process.

In FIG. 18, $\mathbf{100}_{A2}$ denotes a second unit formed of a plurality of (n2) block-like laminated members. The iron core 60*a* is formed by subjecting the block-like laminated members of the first unit $\mathbf{100}_{A1}$ to bending process, and then the second unit $\mathbf{100}_{A2}$ to the bending process, and then the third unit (not shown) to the bending process. FIG. 18 shows the state where the first unit $\mathbf{100}_{A1}$ and the second unit $\mathbf{100}_{A2}$ are subjected to the bending process. In FIG. 18, out of the n1 block-like laminated members of the first unit $\mathbf{100}_{A1}$, block-like laminated members $\mathbf{100}_{A11}$ through $\mathbf{100}_{A15}$ have completed bending processes, wherein the end surface of the leading end and the end surface of the rear end are butted against each other to form connecting sections $\mathbf{70}_{a11}$ through $\mathbf{70}a_{15}$ on the long side (other long side) $\mathbf{1}a_{12}$, by which an annular section constituting a portion of the inner circumference side of the iron core 60*a* is formed, wherein as for the block-like laminated members of the first unit $\mathbf{100}_{A1}$ other than the block-like laminated members $\mathbf{100}_{A11}$ through $\mathbf{100}_{A15}$ and the block-like laminated members of the second unit $\mathbf{100}_{A2}$, they are still in mid way of the bending process, wherein the end surfaces of the leading ends and the end surfaces of the rear ends are not yet butted against one another. By completing the bending processes of the block-like laminated members of the first and second units and the block-like laminated members of the third unit, a ring-shaped iron core 60*a* is formed. When forming at least the long side (the other long side) $\mathbf{60}a_{12}$ of the iron core 60*a*, the leading ends and the rear ends of the respective block-like laminated members are simultaneously bent in each of the respective first, second and third units. By simultaneously bending the leading ends and the rear ends of the respective block-like laminated members of each unit, it becomes possible to reduce the time required for manufacturing the iron core 60*a* compared to when the leading ends and rear ends of the respective block-like laminated members are bent independently.

The iron core 60*b* of the transformer shown in FIG. 14 and the iron core 60 of the transformer shown in FIG. 15 are formed in a similar manner as the above-described iron core 60*a*.

FIGS. 19A and 19B are explanatory views of the effects of the iron core in the transformer shown in FIGS. 14 and 15 as embodiments of the present invention. FIGS. 19A and 19B are explanatory views regarding the iron core 60*a* of the transformer shown in FIG. 14. FIG. 19A is a configuration diagram of the area surrounding the connecting sections of the block-like laminated members of the first unit $\mathbf{100}_{A1}$ formed on the long side (the other long side) $\mathbf{60}a_{12}$ of the iron core 60*a*, and FIG. 19B is a configuration diagram of the area around the connecting sections of the block-like laminated members of a short side $\mathbf{60}_{B}$' of a rectangular iron core 60' according to a prior art transformer shown in FIG. 20. In the drawing, 70' denotes the whole area of the connecting section.

In FIG. 19A, g denotes a distance (gap) between the end surface of a leading end and the end surface of a rear end of the respective block-like laminated members $\mathbf{100}_{A11}$, $\mathbf{100}_{A12}$ and $\mathbf{100}_{A13}$, $p_1$ denotes the distance between the center of the connecting section $\mathbf{70}a_{11}$ (center of gap g) of the block-like laminated member $\mathbf{70}_{A11}$ and the center of the connecting section $\mathbf{70}a_{12}$ of the block-like laminated member $\mathbf{100}_{A12}$ (center of gap g) (the distance between the center of the connecting section $\mathbf{70}a_{12}$ of the block-like laminated member $\mathbf{100}_{A12}$ (center of gap g) and the center of the connecting section $\mathbf{70}a_{13}$ of the block-like laminated member $\mathbf{100}_{A13}$ (center of gap g) is also denoted as $p_1$), and $q_1$ refers to the distance between the end surface of the leading end of the block-like laminated member $\mathbf{100}_{A11}$ and the end surface of the rear end of the block-like laminated member $\mathbf{100}_{A12}$ (the distance between the end surface of the leading end of the block-like laminated member $\mathbf{100}_{A12}$ and the end surface of the rear end of the block-like laminated member $\mathbf{100}_{A13}$ is also referred to as $q_1$). The gap g is approximately $5\times10^{-3}$ m, the distance (distance between adjacent connecting sections in the magnetic circuit direction (quantity of displacement)) is approximately $13\times10^{-3}$ m, and the distance (distance between center lines of adjacent connecting sections in the magnetic circuit direction) $p_1$ is approximately $18\times10^{-3}$ m. If the length of the linear portion of the long side $\mathbf{1}a_{12}$ of the rectangular iron core 60*a* is approximately $200\times10^{-3}$m, the number of block-like laminated members per single unit is eleven at maximum (200÷18). Accordingly, when the iron core 60*a* is formed for example by using 150 block-like laminated members formed by laminating 3000 to 4000 amorphous sheet materials having a thickness of approximately $0.025\times10^{-3}$ m, the number of units required for forming the iron core 60*a* is 14 (150÷11).

In FIG. 19B, g' refers to a distance (gap) between the end surface of a leading end and the end surface of a rear end of the respective block-like laminated members $\mathbf{100}_{A11}$', $\mathbf{100}_{A12}$', $\mathbf{100}_{A13}$', . . . , $\mathbf{100}_{A16}$', $p_2$ refers to the distance between the center of the connecting section $\mathbf{70}a_{11}$' (center of gap g') of the block-like laminated member $\mathbf{100}_{A11}$' and the center of the connecting section $\mathbf{70}a_{12}$' of the block-like laminated member $\mathbf{100}_{A12}$' (center of gap g) (the distance between centers of connecting sections of other adjacent block-like laminated members are also denoted as $p_2$), and $q_2$ refers to the distance between the end surface of the leading end of the block-like laminated member $\mathbf{100}_{A11}$' and the end surface of the rear end of the block-like laminated member $\mathbf{100}_{A12}$' (the distance between the end surface of the leading end and the end surface of the rear end of other adjacent block-like laminated members are also denoted as $q_2$). According to the prior art arrangement, for example, the gap g' is approximately $3\times10^{-3}$ m, the distance (distance between adjacent connecting sections in the magnetic circuit direction (quantity of displacement)) is approximately $5\times10^{-3}$ m, and the distance (distance between center lines of adjacent connecting sections in the magnetic circuit direction) $p_2$ is approximately $8\times10^{-3}$ m. If the length of the linear portion of the short side $\mathbf{1}_{B}$' of the rectangular iron core 60' is approximately $50\times10^{-3}$ m, the number of block-like laminated members in a single unit is six at maximum (50÷8). Accordingly, when the iron core 60' is formed by using 150 block-like laminated members as a whole, the number of units necessary for forming the iron core 60 will be 25 (150÷6).

Upon comparing the arrangement of FIG. 19A showing the embodiment of the present invention and the arrangement of FIG. 19B showing the prior art arrangement, the number of block-like laminated members per a single unit is six in the arrangement of FIG. 19B whereas the number is 11 at maximum according to the arrangement of FIG. 19A, and the number of units required for forming the whole iron core is 25 according to the arrangement of FIG. 19B whereas the number is 14 according to the arrangement of FIG. 19A. Further, if the length L' (length required for forming the connecting sections of block-like laminated members in a single unit) in FIGS. 19A and 19B is approximately $50\times10^{-3}$ m, six connecting sections are formed in a single unit within this length according to the arrangement of FIG. 19B, whereas only three connecting sections per single unit are formed according to the arrangement of FIG. 19A.

In other words, according to the arrangement of FIG. 19A, the number of block-like laminated members in a single unit can be increased in the iron core for a transformer compared to the arrangement of FIG. 19B, and the iron core can be formed using a smaller number of units, so the workability for manufacturing the iron cores can be improved. Further, since the distance between connecting sections between adjacent block-like laminated members can be increased so as to reduce the number of connecting sections per unit length of the magnetic circuit, the flow of magnetic flux can be smoothed in the magnetic circuit of the long side having the connecting section and the magnetic resistance can be reduced, and as a result, the efficiency of the transformer can be improved.

As described above, according to the present embodiment, the workability can be improved for connecting the leading end and the rear end in the longitudinal direction of the block-like laminated members formed by laminating a plurality of magnetic thin sheets such as amorphous sheet materials in manufacturing cores 60*a*, 60*b* and 60 of transformers $\mathbf{1000}_A$ and $\mathbf{1000}_{8B}$. Further, in the magnetic circuit of iron cores 60*a*, 60*b* and 60, the flow of magnetic flux can be smoothed and the increase of magnetic resistance can be suppressed. As a result, a transformer that can be manufactured easily and with ensured performance can be obtained.

Further according to the above-described embodiment, all the block-like laminated members have their leading ends and rear ends butted against each other and connected to form a ring-shaped structure, but it is also possible to mutually overlap leading ends and rear ends of a portion of the block-like laminated members to form a ring-shaped structure. Also according to this arrangement, effects similar to the above-described embodiment can be obtained.

Figure 21:
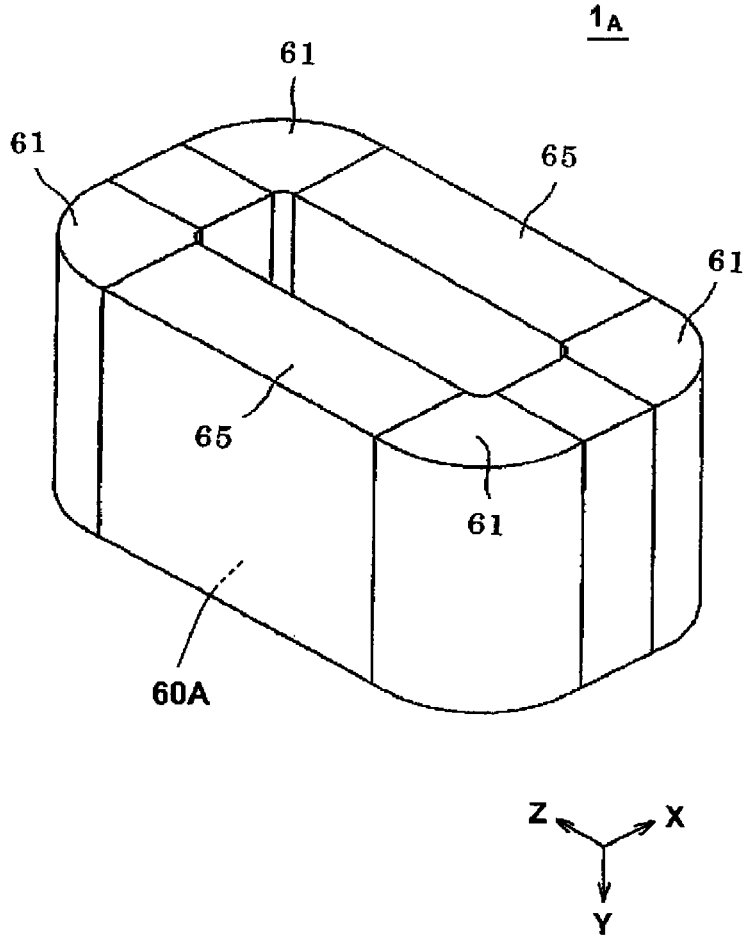
FIG. 21 is a view showing the arrangement of the iron core used in a transformer according to an embodiment of the present invention.

FIG. 21 is a view showing the arrangement of an iron core used in a transformer according to an embodiment of the present invention.

In FIG. 21, $\mathbf{60}_A$ refers to an iron core formed by laminating a plurality of amorphous material thin plates, 65 refers to a sheet-like insulation material such as paper wound around the linear portion of the iron core $\mathbf{1}_A$, and 61 refers to a thermosetting or light curing coating applied on a laminated end surface of the magnetic thin plate in iron core $\mathbf{60}_A$. The coating is applied on the corner portion of the iron core $\mathbf{60}_A$. This arrangement enables to prevent scattering of fragments of amorphous material thin plates. Especially, the workability is improved according to this arrangement since thermosetting or light curing coating is applied on the corner portion without winding a sheet-like insulation material thereto.

Figure 22:
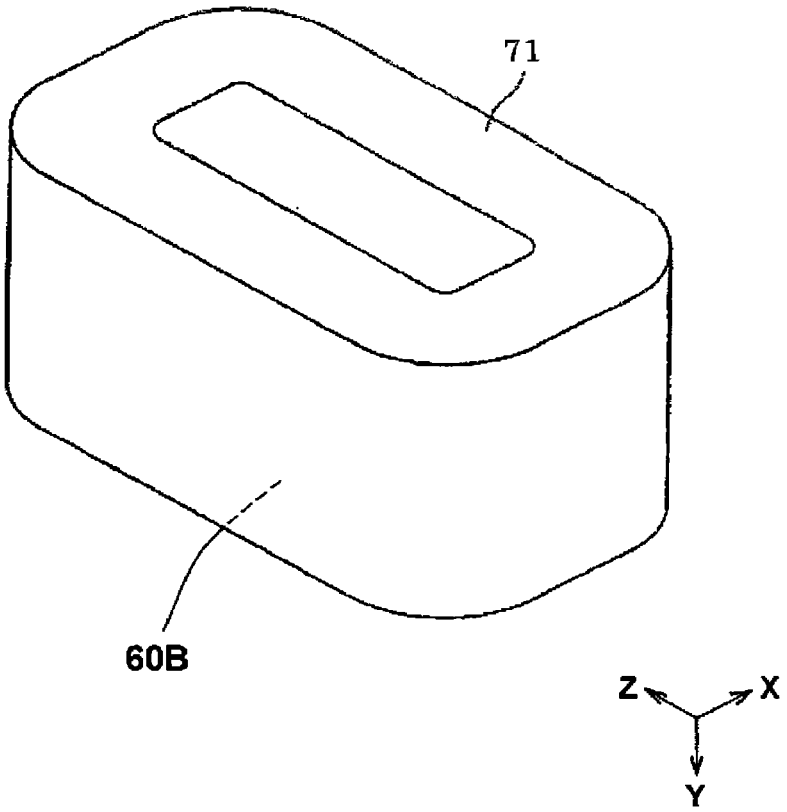
FIG. 22 is a view showing the arrangement of the iron core used in a transformer according to an embodiment of the present invention.

FIG. 22 is a view showing the arrangement of another iron core used in a transformer according to an embodiment of the present invention.

In FIG. 22, $\mathbf{60}_B$ refers to an iron core formed by laminating a plurality of amorphous material thin plates, and 71 refers to a thermosetting or light curing coating applied on a laminated end surface of the magnetic thin plate in iron core $\mathbf{60}_B$. The coating is applied on the whole laminated end surface of thin plates of the iron core $\mathbf{60}_B$. This arrangement enables to prevent scattering of fragments of amorphous material thin plates. Especially, the workability is improved according to this arrangement since thermosetting or light curing coating is applied.

Figure 23A:
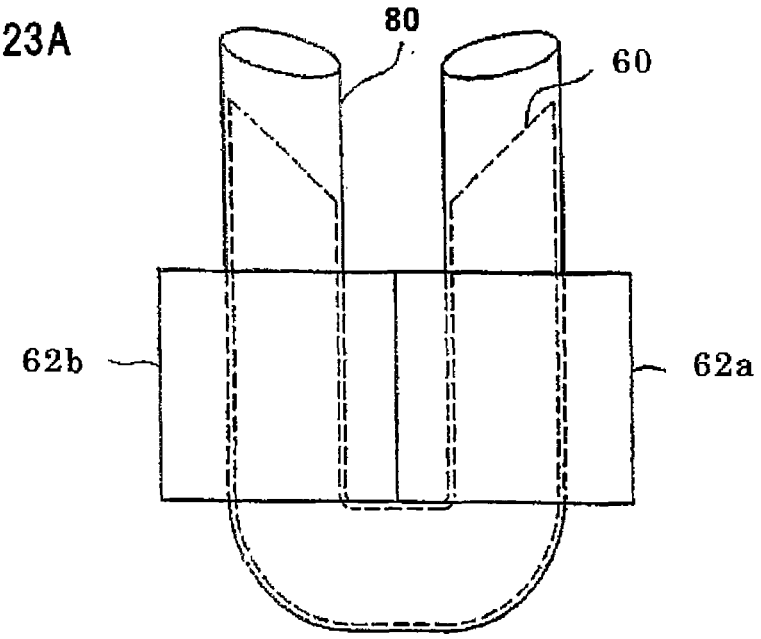
FIG. 23A is a configuration diagram of a transformer according to an embodiment of the present invention, wherein the iron core prior to being formed in a ring shape is covered via a pouched insulation member.
Figure 23B:
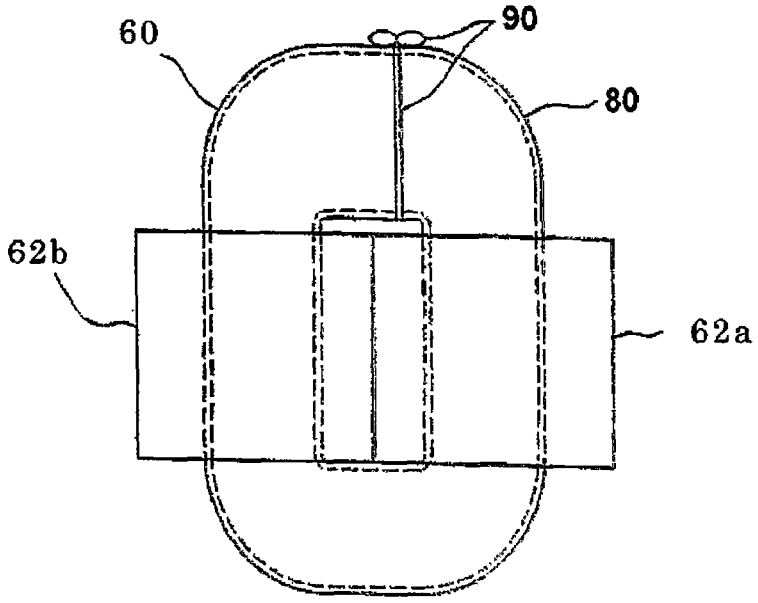
FIG. 23B is a configuration diagram of a transformer according to an embodiment of the present invention, wherein the iron core formed in a ring shape is covered via a pouched insulation member.

FIGS. 23A and 23B are drawings showing other arrangements of a transformer according to an embodiment of the present invention.

In FIGS. 23A and 23B, 60 refers to an iron core formed by laminating amorphous material thin plates, 62*a* and 62*b* refer to coils, 80 refers to a pouched insulation material with both ends opened, and 90 refers to a band for fixing the pouched insulation material 80 to the iron core 60. After covering the outer surface of the iron core 60 with the pouched insulation material 80, the iron core 60 together with the pouched insulation material 80 is passed through a center hole of coils 62*a* and 62*b* (FIG. 23A), and thereafter, both ends of the iron core 60 are connected to form a ring-shaped iron core, the connecting section of the iron core 60 is also covered with the pouched insulation material 80, and both ends of the pouched insulation material 80 is fixed to the iron core 60 via a band (FIG. 23B). This arrangement enables to prevent scattering of fragments of amorphous material thin plates with an easy arrangement without fail. Further, the outer surface of the iron core 60 can be covered with a sheet-like thermosetting resin instead of the above-mentioned pouched insulation material 80, and this arrangement also enables to prevent scattering of fragments of amorphous material thin plates.

Figure 24:
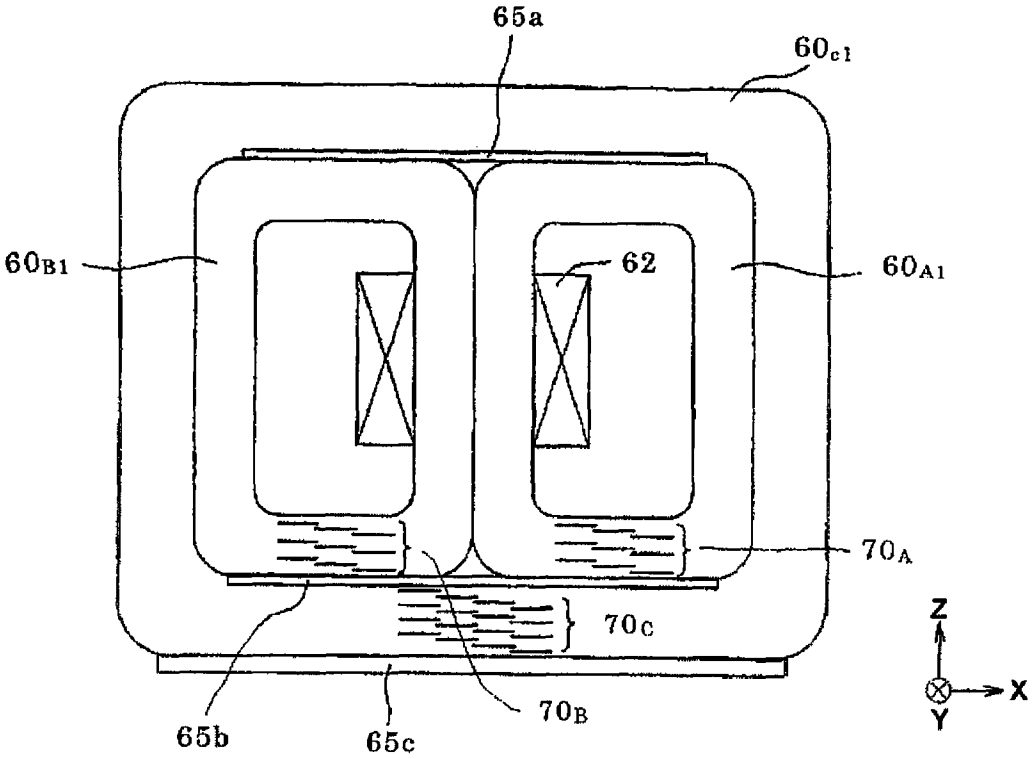
FIG. 24 is a configuration diagram of a transformer according to an embodiment of the present invention.

FIG. 24 is a view showing yet another arrangement of the transformer according to a preferred embodiment of the present invention. The present transformer adopts an arrangement in which the iron core is supported via a retention member.

In FIGS. 24, $\mathbf{60}_{A1}$ and $\mathbf{60}_{B1}$ are inner iron cores having amorphous material thin plates laminated and formed into a ring shape, $\mathbf{60}_{C1}$ refers to an outer iron core similarly having amorphous material thin plates laminated and formed into a ring shape and surrounding the outer side of the inner iron cores $\mathbf{60}_{A1}$ and $\mathbf{60}_{B1}$, $\mathbf{70}_A$ is a connecting section disposed on the lower side of the inner iron core $\mathbf{60}_{A1}$, $\mathbf{70}_B$ is a connecting section disposed on the lower side of the inner iron core $\mathbf{60}_{B1}$, $\mathbf{70}_C$ is a connecting section disposed on the lower side of the outer iron core $\mathbf{60}_{C1}$, 62 is a coil, and 65*a*, 65*b* and 65*c* are flat-plate shape retention members. Each connecting section $\mathbf{70}_A$, $\mathbf{70}_B$ and $\mathbf{70}_C$ are formed by butting together or superposing the leading ends and the rear ends in the longitudinal direction of the amorphous material thin plates or the leading ends and the rear ends in the longitudinal direction of the collective body of thin plates (block-like laminated members). The retention member 65*a* is arranged on the inner circumference surface of the upper side of the outer iron core $\mathbf{60}_{C1}$ so as to retain the outer iron core $\mathbf{60}_{C1}$, especially supporting its self weight of the upper side of the outer iron core $\mathbf{60}_{C1}$ so as to suppress the deformation of the outer iron core $\mathbf{60}_{C1}$ itself by the self weight and to suppress the deformation of the upper side and the sides of the inner iron cores $\mathbf{60}_{A1}$ and $\mathbf{60}_{B1}$. The retention member 65*b* is arranged on the outer circumference surface of the inner iron cores $\mathbf{60}_{A1}$ and $\mathbf{60}_{B1}$ so as to retain the inner iron cores $\mathbf{60}_{A1}$ and $\mathbf{60}_{B1}$, thereby suppressing the deformation of the lower side of the inner iron cores $\mathbf{60}_{A1}$ and $\mathbf{60}_{B1}$ by the total load of the self weight of the inner iron cores $\mathbf{60}_{A1}$ and $\mathbf{60}_{B1}$ and the self weight of the coil 62, or by the total load of the self weight of the inner iron cores $\mathbf{60}_{A1}$ and $\mathbf{60}_{B1}$, the self weight of the coil 62 and the self weight of the upper side of the outer iron core $\mathbf{60}_{C1}$, especially suppressing the deformation of the connecting sections $\mathbf{70}_A$ and $\mathbf{70}_B$ and the occurrence of breaking. The retention member 65*c* is arranged on the outer circumference surface of the lower side of the outer iron core $\mathbf{70}_{C1}$ so as to retain the outer iron core $\mathbf{60}_{C1}$, thereby suppressing the deformation of the lower side of the outer iron core $\mathbf{60}_{C1}$ by the total load of the self weight of the outer iron core $\mathbf{60}_{C1}$, the self weight of the inner iron cores $\mathbf{60}_{A1}$ and $\mathbf{60}_{B1}$ and the self weight of the coil 62, especially suppressing the deformation of the connecting section 70*c* and the occurrence of breaking. As described, the present arrangement enables to suppress the deformation of inner iron cores $\mathbf{60}_{A1}$ and $\mathbf{60}_{B1}$ and the outer iron core $\mathbf{60}_{C1}$, or the deformation and braking of the respective connecting sections $70_A$, $70_B$ and $70_C$, according to which a transformer having a stable strength and stable performance can be obtained.

Figure 25A:
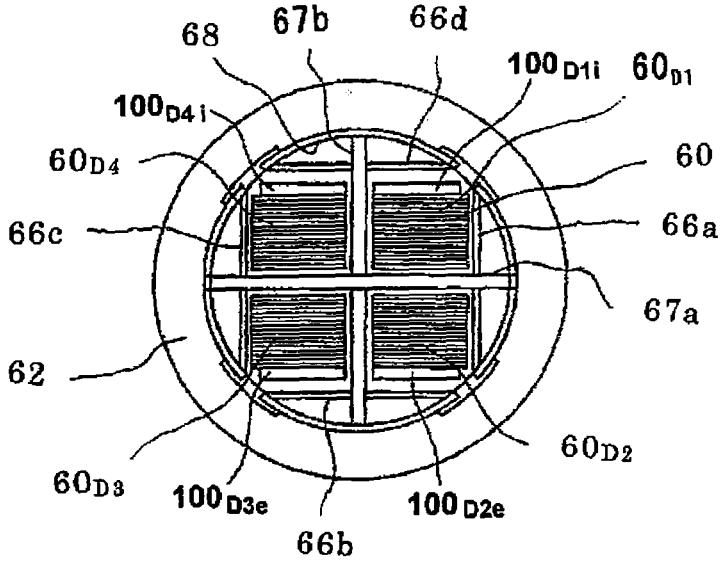
FIG. 25A is a configuration diagram of a transformer according to an embodiment of the present invention, showing a plan view of the coil and the iron core.
Figure 25B:
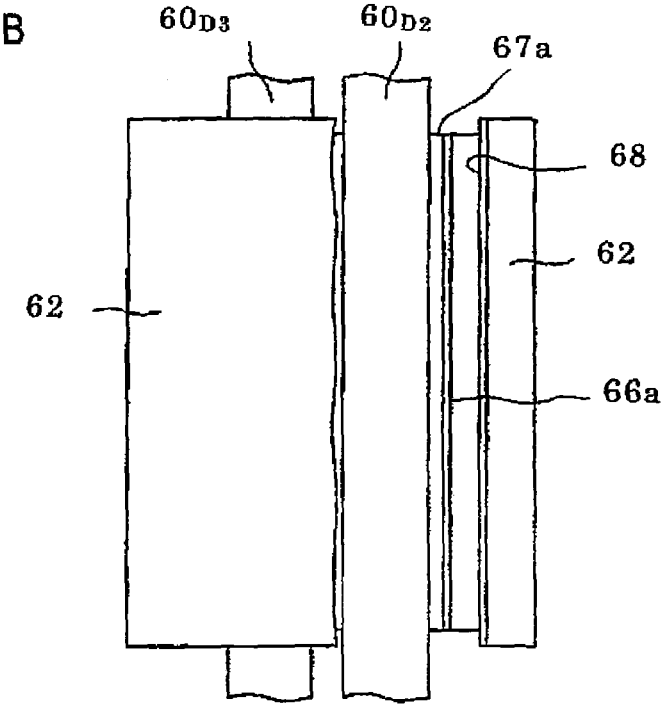
FIG. 25B is a side view of the arrangement of FIG. 25A.

FIGS. 25A and 25B show yet another arrangement of a transformer according to one embodiment of the present invention. The transformer according to the present embodiment has an arrangement in which a coil is reinforced via a plate-shaped reinforcement member. FIGS. 25A and 25B show a major arrangement of a part of the transformer according to the present embodiment, wherein FIG. 25A is a plan view of a coil and an iron core passed through the center hole of the core, and FIG. 25B is a side view of the arrangement of FIG. 25A.

In FIGS. 25A and 25B, 60 denotes an iron core formed by laminating magnetic thin plates of amorphous materials or the like, $60_{D1}$, $60_{D2}$, $60_{D3}$ and $60_{D4}$ are divided iron cores constituting the iron core 60, which divide the iron core 60 into both the width direction of the magnetic member and the laminated direction thereof and constituting four independent magnetic circuits (hereinafter referred to as divided cores), 62 denotes a pipe-like coil, 68 denotes a cylindrical winding frame formed of a nonmagnetic material and having a coil 62 wound around the outer circumference thereof, and 67*a*, 67*b*, 66*a*, 66*b*, 66*c* and 66*d* are each plate-shaped reinforcement members disposed within the winding frame 68 for reinforcing the coil 62. The reinforcement member 67*a* is arranged between the divided cores $60_{D1}$ and $60_{D2}$ and between the divided cores $60_{D3}$ and $60_{D4}$, and both end surfaces thereof are in contact with the inner circumference surface of the winding frame 68 within the winding frame 68. Further, the reinforcement member 67*b* is arranged between the divided cores $60_{D1}$ and $60_{D4}$ and between the divided cores $60_{D2}$ and $60_{D3}$ and orthogonal to the reinforcement member 67*a*, wherein both end surfaces thereof are in contact with the inner circumference surface of the winding frame 68 within the winding frame 68. Further, the reinforcement member 66*a* is arranged between the iron cores $60_{D1}$ and $60_{D2}$ and the inner circumference surface of the winding frame 68 in parallel with the reinforcement member 67*b*, wherein both end surfaces thereof are in contact with the inner circumference surface of the winding frame 68, the reinforcement member 66*c* is arranged between the iron cores $60_{D3}$ and $60_{D4}$ and the inner circumference surface of the winding frame 68 in parallel with the reinforcement member 67*b*, wherein both end surfaces thereof are in contact with the inner circumference surface of the winding frame 68, the reinforcement member 66*b* is arranged between the iron cores $60_{D2}$ and $60_{D3}$ and the inner circumference surface of the winding frame 68 in parallel with the reinforcement member 67*a*, wherein both end surfaces thereof are in contact with the inner circumference surface of the winding frame 68, and the reinforcement member 66*d* is arranged between the iron cores $60_{D1}$ and $60_{D4}$ and the inner circumference surface of the winding frame 3 in parallel with the reinforcement member 67*a*, wherein both end surfaces thereof are in contact with the inner circumference surface of the winding frame 68. The reinforcement members 67*a*, 67*b*, 66*a*, 66*b*, 66*c* and 66*d* have their respective end surfaces coming in contact with the inner circumference surface of the winding frame 68, to thereby reinforce the coil 62 via the winding frame 68. The reinforcement member 67*a*, 67*b*, 66*a*, 66*b*, 66*c* and 66*d* can be formed of magnetic material.

The iron core 60 has at least the portion passing through the winding frame 68 correspond to the radius of curvature of the inner circumference surface of the cylindrical winding frame 68, wherein the width of the magnetic material laminated on the inner circumference side and the outer circumference side of the iron core has a narrower width than the magnetic material laminated on the center area of the iron core 60. In other words, in the divided cores $60_{D1}$ and $60_{D4}$, at least the portions passing through the winding frame 68 have the width of the magnetic materials $100_{D1i}$ and $100_{D41}$ laminated on the side of the reinforcement member 66*d* narrowed than the magnetic material laminated on the reinforcement member 67*a*, and in the divided cores $60_{D2}$ and $60_{D3}$, at least the portions passing through the winding frame 68 have the width of the magnetic materials $100_{D2e}$ and $100_{D3e}$ laminated on the side of the reinforcement member 66*d* narrowed than the magnetic material laminated on the reinforcement member 67*a*.

According to this arrangement, the reinforcement members 67*a*, 67*b*, 66*a*, 66*b*, 66*c* and 66*d* reinforce the coil 62 without fail, improving the reliability of the transformer. Especially when a magnetic material is used for the reinforcement members 67*a*, 67*b*, 66*a*, 66*b*, 66*c* and 66*d*, the cross-sectional area of the magnetic circuit of the iron core 60 can be substantially increased, according to which the amount of magnetic flux passing through the magnetic circuit is increased and the characteristics of the transformer is improved. Moreover, the arrangement in which the magnetic material laminated on the inner circumference side and the outer circumference side of the ring-shaped iron core 60 is narrowed than the magnetic material laminated on the center side of the iron core 60 to correspond to the radius of curvature of the inner circumference surface of the winding frame 68, the laminated number of magnetic materials can be increased, according to which the cross-sectional area of the magnetic circuit of the iron core 60 is also increased, by which the magnetic resistance of the magnetic circuit is reduced, the amount of magnetic flux within the magnetic circuit is increased and the characteristics of the transformer is improved. Further, this arrangement in which the width of the magnetic material sheets laminated on the inner circumference side and the outer circumference side of the ring-shaped iron core is narrowed than the width of magnetic materials on other portions in correspondence with the radius of curvature of the inner circumference surface of the winding frame can be applied to examples where the winding frame adopts shapes other than the cylindrical shape or where the iron core is not composed of divided cores.

Next, the invention related to (4) the protection of iron core of an amorphous transformer will be described with reference to the drawings.

In the present invention, the protection member covering the iron core is formed of an insulating member and having a box shaped structure covering the circumference of the iron core, wherein the contact surface with the work table is formed of a single panel. Further, the lines shown by the broken lines of the protection member denote folding lines for performing fold forming.

Embodiment 6

FIGS. 26A through 26D illustrate a sixth embodiment of an amorphous iron core transformer according to the present invention, which are work drawings showing in perspective views operations starting from an iron coil wrapping operation to an coil insertion operation.

Figure 26A:
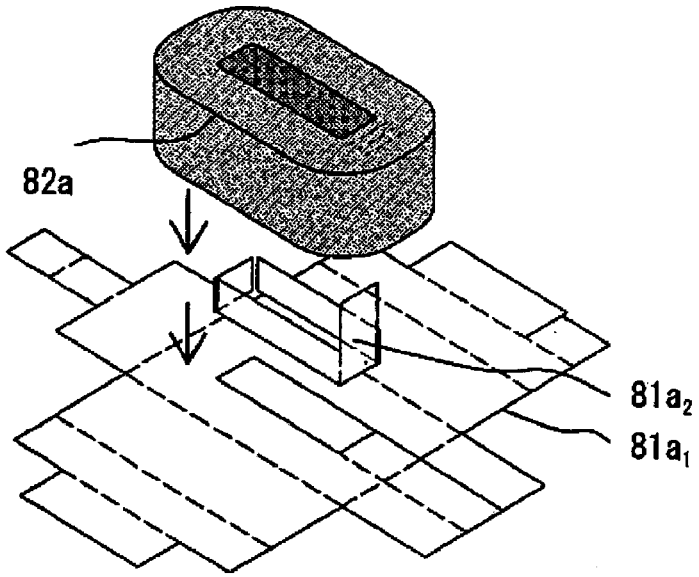
FIG. 26A is a perspective view showing embodiment 6 of the amorphous iron core transformer according to the present inv ention, wherein the amorphous iron core is placed on the protection member.

An iron coil protection member $81a_1$ is formed of an insulation member cut in advance into dimensions capable of being assembled into a box shape, which is formed of a single panel so that the connecting sections of the iron core protections members $81a_1$ are not disposed on the contact surface with the work table. A protection member 81$a_2$ to be disposed on an inner side of a window of the iron core is disposed by being adhered to the center of the iron core protection member 81$a_1$. An amorphous iron core 82$a$ is placed on the iron core protection member 81$a_1$ arranged as above. The protection member 81$a_2$ on the inner surface iron core window is disposed within the iron core window of the amorphous iron core 82$a$ (FIG. 26A).

Figure 26B:
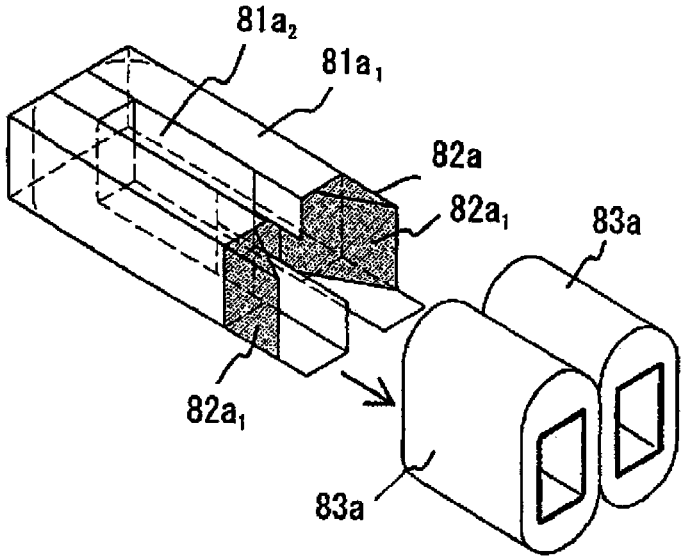
FIG. 26B is a perspective view showing the operation for inserting the wrapped amorphous iron core shown in FIG. 26A to a coil.
Figure 26C:
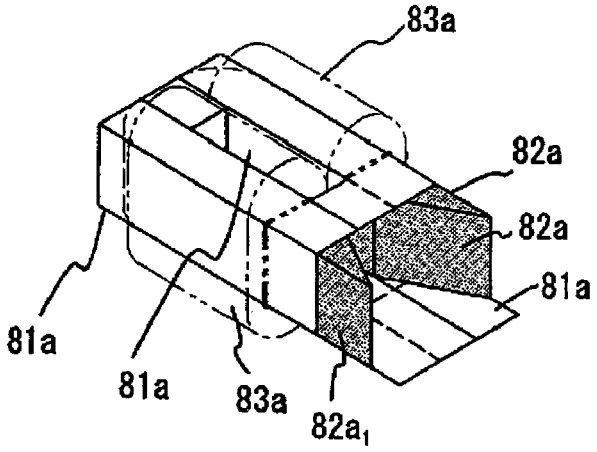
FIG. 26C is a perspective view showing the operation for expanding protection members from the amorphous iron core inserted to the coil shown in FIG. 26B.

After taking out a formed cored bar disposed during annealing from the amorphous iron core 82$a$, the iron core protection member 81$a_1$ is fold-formed in a box shape around the amorphous iron core 82$a$. At this time, the joint portion of the amorphous iron core 82$a$ is separated temporarily, and then slid and inserted to coils 83$a$ and 83$a$ placed transversely (FIG. 26B). The iron core protection member 81$a_1$ is formed by fold forming around the released expanded sections 82$a_1$ and 82$a_1$ of the amorphous iron core 82$a$ having its joint sections separated temporarily. Therefore, upon inserting the amorphous iron core 82$a$ into coils 83$a$ and 83$a$, the iron core protection members 81$a_3$ surrounding the expanded sections 82$a_1$ and 82$a_1$ will not interfere with the coils 83$a$ and 83$a$.

Figure 26D:
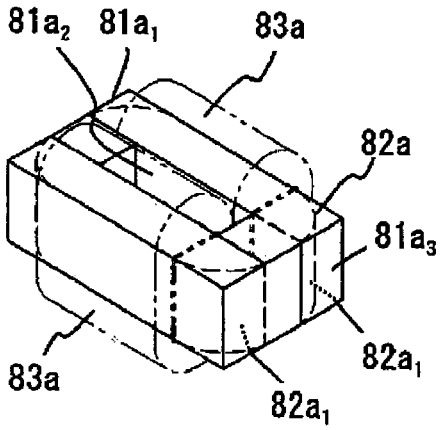
FIG. 26D is a perspective view showing the operation for folding the protection member after reattaching the amorphous iron core shown in FIG. 26C.

After inserting the amorphous iron core 82$a$ into coils 83$a$ and 83$a$, the iron core protection member 81$a_3$ having been folded to the inner side of expanded sections 82$a_1$ and 82$a_1$ of the amorphous iron core 82$a$ is expanded (FIG. 26C), and both expanded sections 82$a_1$ and 82$a_1$ of the amorphous iron core 82$a$ are attached together again. The iron core protection member 81$a_3$ having been expanded is folded and assembled around the reattached expanded sections 82$a_1$ and 82$a$1, which cover the reattached joint section to connect the protection members together and fix the same (FIG. 26D).

Upon insertion to the coils 83$a$ and 83$a$, the iron core protection member 81$a_3$ covers the expanded sections 82$a_1$ and 82$a_1$ formed by temporarily expanding the joint section of the iron core, and exerts an effect to protect the expanded sections 82$a_1$ and 82$a_1$ inserted as the leading end to the coils 83$a$ and 83$a$. Further, the iron core protection member 81$a_3$ ensures an insulation distance between the amorphous iron core 82$a$ and coils 83$a$ and 83$a$, so that there is no need to insert an independent insulation member between the amorphous iron cores 82$a$ and coils 83$a$ and 83$a$. Furthermore, since the dimension of the iron core protection member 81$a_3$ can be formed easily, it becomes possible to insert the amorphous iron core 82$a$ into the coils 83$a$ and 83$a$ without deforming the core.

According to embodiment 6, since the whole circumference of the amorphous iron core 82$a$ is covered via the iron core protection members 81$a_1$ and 81$a$2, it becomes possible to obtain an amorphous iron core transformer capable of protecting the fragments of amorphous material from scattering within the transformer while suppressing work time and manufacturing costs. Further, when the iron core protection members 81$a_1$ and 81$a_2$ are formed into a box shape, the connecting sections between the iron core protection members are not positioned at the contact surface with the work table but are positioned at the side wall of the transversely positioned iron core 82$a$ or the inner surface of the upper surface of the iron core window, so that the connecting operation of iron core protection members can be facilitated.

Embodiment 7

Figure 27A:
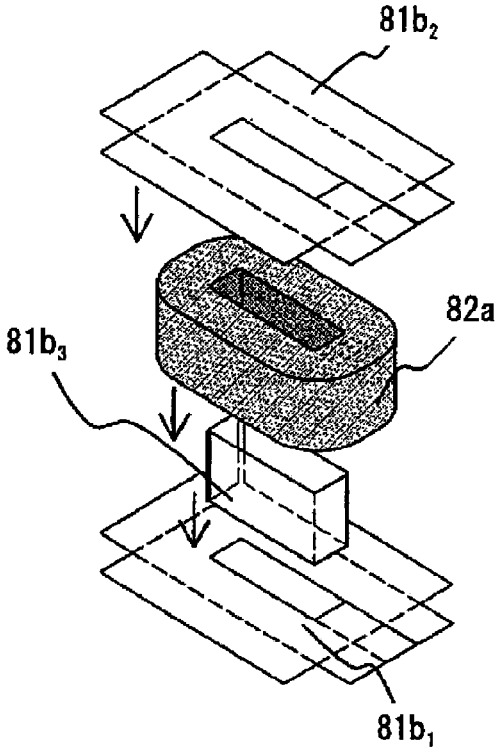
FIG. 27A is a perspective view showing the iron core wrapping operation of the amorphous iron core transformer according to embodiment 7 of the present invention.
Figure 27B:
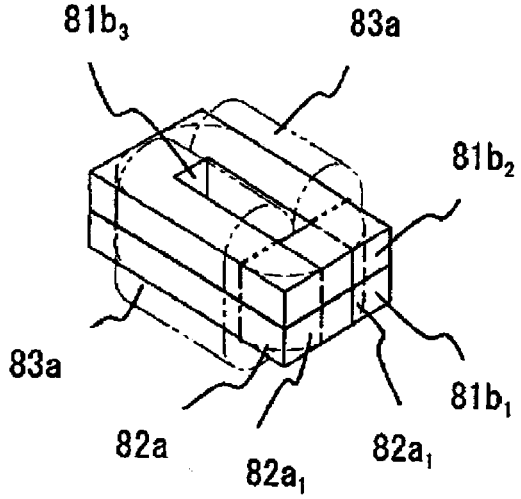
FIG. 27B is a perspective view showing the operation for inserting the coil after wrapping the iron core and folding the protection member shown in FIG. 27A.

FIGS. 27A and 27B are work drawings showing a seventh embodiment of the amorphous iron core transformer according to the present invention, wherein the iron core wrapping operation and the state in which the coil is inserted are shown in perspective views.

As shown in FIG. 27, the iron core protection member is composed of a lower part 81$b_1$ and an upper part 81$b_2$. The lower part 81$b_1$ of the iron core protection member is a single plate cut into a dimension for assembling a box-shaped lower part in advance, to which is attached a protection member 81$b_3$ to be inserted to the inner side of an iron core window of the amorphous iron core 82$a$. After placing the amorphous iron core 82$a$ on the lower part 81$b_1$ of the iron core protection member and removing the molding cored bar disposed during annealing, the upper part 81$b_2$ of the iron core protection member is covered (FIG. 27A). The lower pat 81$b_1$ and the upper part 81$b_2$ of the iron core protection member are folded and formed along the surface of the amorphous iron core 82$a$, and formed into a box shape by being mutually connected at the side wall of the amorphous iron core 82$a$. Thereby, the connecting sections between the lower part 81$b_1$ and the upper part 81$b_2$ of the iron core protection member will not be disposed on the contact surface of the work table on which the amorphous iron core 82$a$ is placed, and the connecting operation can be performed extremely easily at the side wall of the amorphous iron core 82$a$.

The joint portion of the amorphous iron core 82$a$ will be separated once, and the expanded amorphous iron core 82$a$ is inserted by sliding into the transversely placed coils 83$a$ and 83$a$. During insertion, the protection members 81$b_1$ and 81$b_2$ of the iron core joint portion exerts an effect to protect the portions to be joined in the amorphous iron core 82$a$. The expanded sections 82$a_1$ and 82$a_1$ having been expanded are reattached, and protection members 81$b$1 and 81$b$2 are folded and formed around the joint portion and connected, so that the whole circumference of the amorphous iron core 82$a$ are covered with the protection members 81$b_1$ and 81$b_2$ without any clearance (FIG. 27B). Further, the iron core protection members 81$b$1 and 81$b$2 ensure an insulation distance between the amorphous iron core 82$a$ and coils 83$a$ and 83$a$, so that there is no need to insert a separate insulation material between the amorphous iron core 82$a$ and coils 83$a$ and 83$a$. Further, since the dimension of the iron core protection members 81$b_1$ and 81$b_2$ can be formed easily, it becomes possible to insert the amorphous iron core 82$a$ into the coils 83$a$ without deforming the core.

According to embodiment 7, since the whole circumference of the amorphous iron core 2$a$ is covered with the iron core protection members 81$b_1$ and 81$b_2$, it becomes possible to obtain an amorphous iron core transformer capable of preventing fragments of amorphous materials from scattering within the transformer while suppressing the work time and manufacturing costs. Especially since the joint portion can be positioned in a restricted manner only on the side walls and the inner side of the amorphous iron core window, the operation for connecting the iron core protection members together can be performed extremely easily.

Embodiment 8

Figure 28A:
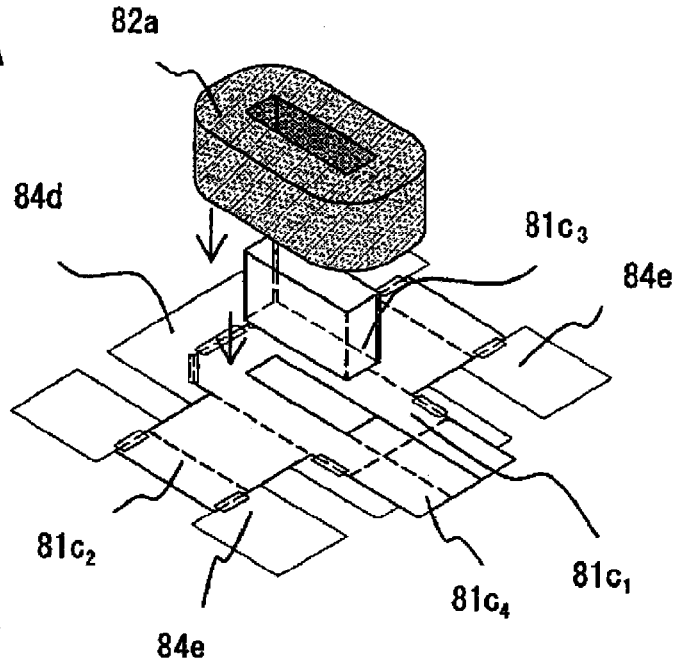
FIG. 28A is a perspective view showing an iron core wrapping operation of the amorphous iron core transformer according to embodiment 8 of the present invention.
Figure 28B:
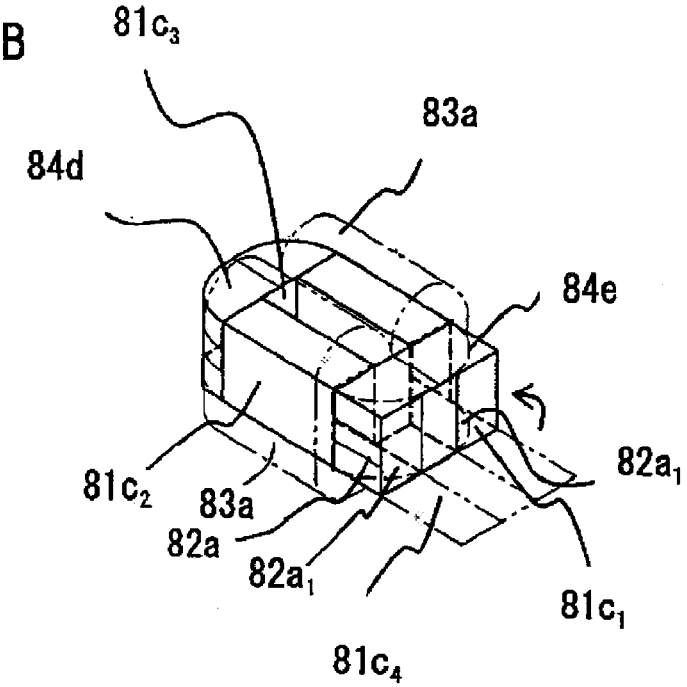
FIG. 28B is a perspective view showing the operation for inserting the coil after wrapping the iron core and folding the protection member shown in FIG. 28A.

FIGS. 28A and 28B are work drawings showing an eighth embodiment of an amorphous iron core transformer according to the present invention, wherein the coil wrapping operation and the state after inserting the coil is shown in perspective views.

As shown in FIG. 28A, the iron core protection member comprises a bottom surface protection member 81$c$1 composed of a single plate cut to a dimension capable of being assembled into a box shape in advance and designed so that there is no connecting section disposed on the contact surface with the work table, a contact surface protection member 81$c_2$ extended from the bottom-surface protection member 81$c_1$ and disposed on the contact surface between the iron core 82*a* and the coil 83*a*, an iron core window inner surface protection member 81$c_3$ inserted to the inner side of the iron core window, and a joint portion side wall protection member 81$c_4$ disposed on the side wall of the iron core joint portion. The iron core protection member also has attached thereto insulation materials 84*d* and 84*e* covering the surface of an iron core 82*a* that cannot be covered by the iron core protection member.

The amorphous iron core 82*a* is placed on the iron core protection member having attached to the single-plate iron core protection member 81$c_1$ the iron core window inner side protection member 81$c_3$ and the insulation materials 84*d* and 84*e*. The iron core protection member 81$c_3$ is attached to the inner side of the window of the amorphous iron core 82*a* (FIG. 28A). After wrapping the amorphous iron core 82*a* with iron core protection members 81$c_1$ through 81$c_4$, the joint portion of the amorphous iron core 82*a* is temporarily separated, and the amorphous iron core 82*a* covered with the iron core protection members 81$c_1$ through 81$c_4$ and expanded is inserted by sliding into the transversely placed coil 83*a*. During insertion, the protection member 81$c_4$ on the side wall of the iron core joint portion exerts an effect to protect the expanded sections 82$a_1$ and 82$a_1$ of the iron core formed by the joint portion being expanded. After insertion, the inner side portion of the protection member 81$c_4$ is opened and the expanded sections 82$a_1$ and 82$a_4$ of the iron core 82*a* are reattached, and thereafter, the protection member 81$c_4$ at the side wall of the iron core joint portion is folded, connected and fixed, and the area without the protection member is wrapped via an insulation material 84*e* (FIG. 28B). At this time, the amorphous iron core protection members 81$c_4$ through 81$c_4$ ensure an insulation distance between the iron core 82*a* and the coils 83*a* and 83*a*, so that there is no need to insert an insulation member between the amorphous iron core 82*a* and the coils 83*a* and 83*a*. Further, since the dimension of the iron core protection member 81$c_2$ of the iron core contact surface can be formed easily, it becomes possible to insert the amorphous iron core 82*a* into the coils 83*a* and 83*a* without deforming the core.

According to embodiment 8, the whole circumference of the amorphous iron core 82*a* is covered by the iron core protection members 81$c_4$ through 81$c_4$ without any clearances, so that an amorphous iron core transformer capable of preventing scattering of fragments of amorphous materials while reducing work time and manufacturing costs. Specifically, the present embodiment enables to minimize the strength of the iron core protection member and to further cut down material costs.

Embodiment 9

Figure 29A:
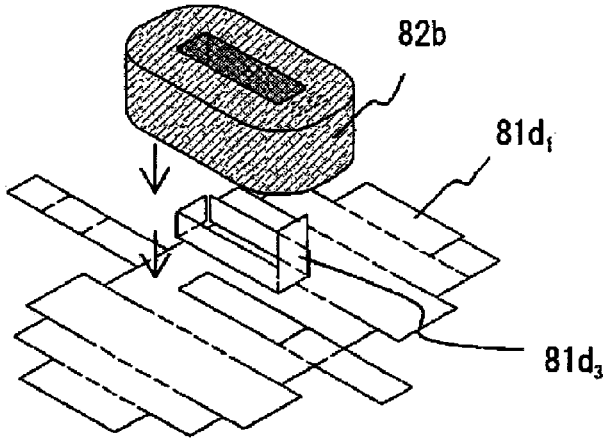
FIG. 29A is a perspective view showing the operation for wrapping the inner iron core of a three-phase amorphous iron core transformer of the amorphous iron core transformer according to embodiment 9 of the present invention.
Figure 29B:
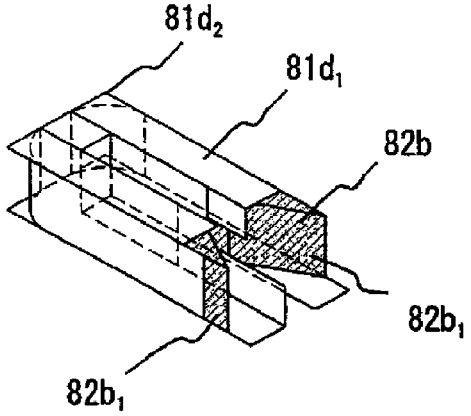
FIG. 29B is a perspective view showing the operation for expanding the joint portion of the inner iron core after performing wrapping operation shown in FIG. 29A.

The above-mentioned embodiments described examples related to a single-phase amorphous iron core transformer, but the present invention is not restricted to such single-phase amorphous iron core transformers. FIGS. 29A through 29F are perspective work drawings showing a ninth embodiment of an amorphous iron core transformer according to the present invention. FIGS. 29A through 29F show iron core wrapping operations using iron core protections members for inner and outer iron cores in a three-phase amorphous iron core transformer. The iron core protection member 81$d_1$ of an inner core 82*b* is a single plate of a bottom surface cut in advance into a dimension capable of being assembled into a box shape and having no connecting section disposed on the contact surface with the work table. The protection member 81$d_3$ is a protection member fit to an inner side of an iron core window (FIG. 29A). According to embodiment 9, in a state where the joint portion of an amorphous wound iron core 82*a* is expanded and the protection members are folded and formed to cover a major portion of the amorphous wound iron core 82*a* excluding the expanded sections 82$b_1$ and 82$b_1$ (FIG. 29B), overhanging structures 81*d*2 (only one of which is selected and denoted with the reference number for representation) remain only on the lower side and the upper side corresponding to the corners of the amorphous wound iron core 82*a*. The overhanging structure 81*d*2 enable the inner core 82*b* to be assembled with the outer iron core 82*c* as described later.

Figure 29C:
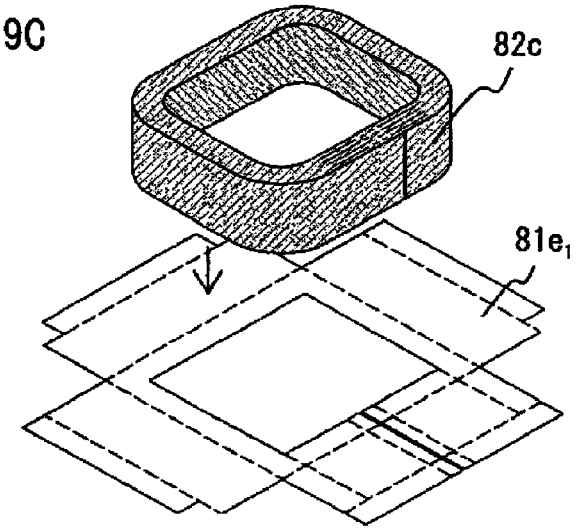
FIG. 29C is a perspective view showing the operation for wrapping the outer iron core of a three-phase amorphous iron core transformer of the amorphous iron core transformer according to embodiment 9 of the present invention.
Figure 29D:
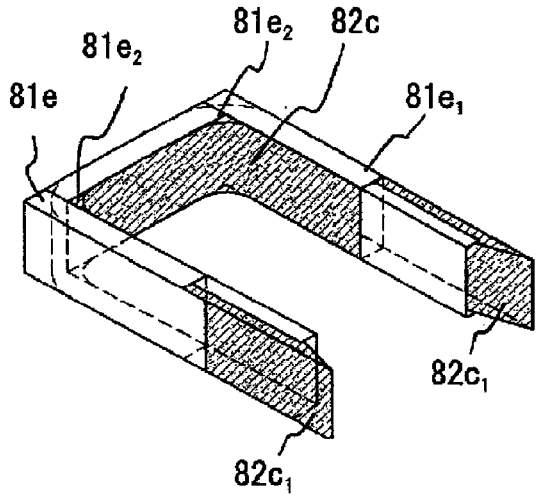
FIG. 29D is a perspective view showing the operation for expanding the joint portion of the outer iron core after performing wrapping operation shown in FIG. 29C.

The state of the wrapping operation of the outer iron core 82*c* is shown in FIGS. 29C and 29D. The protection member 81$e_1$ is substantially square shape, with a window formed at the center and cutouts formed at the four corners. An outer iron core 2*c* is placed above an iron core protection member 81$e_1$ formed of a single plate for covering the outer iron core 82*c* in a box shape (FIG. 29C), and the protection member 81$e_1$ is folded and formed into a box shape around the outer iron core 82*c*. Thereafter, the joint portion of the outer iron core 82*c* is temporarily expanded (FIG. 29D). Curved portions are formed at corners of the outer iron core 82*c*, but upon fold forming the protection member 81$e_1$, normally the member is folded via right angles, so that in correspondence to the corners of the outer iron core 82*c*, overhanging structures 81*e*, are formed on the outer side of the protection member 81$e_1$, and inner corners 81$e_2$ and 81$e_2$ are formed on the inner side where the curved portions of the outer iron core 82*c* are exposed.

Figure 29E:
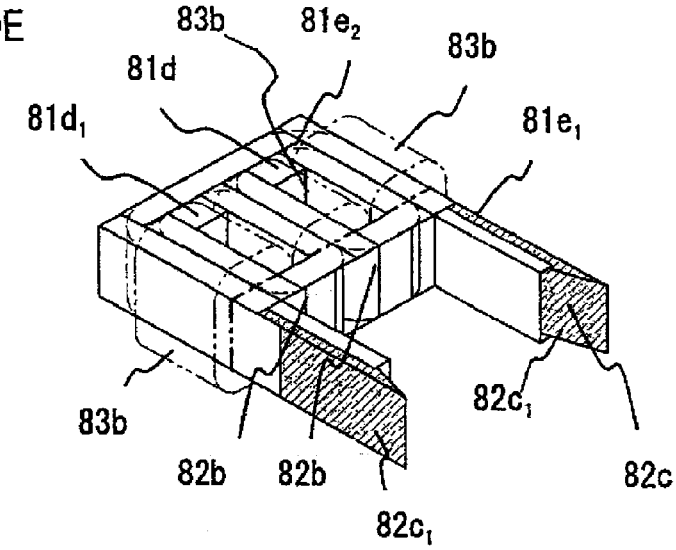
FIG. 29E is a perspective view showing the operation for assembling the inner and outer iron cores, inserting the coil and folding the protection member for the inner iron core shown in FIGS. 29B and 29D.
Figure 29F:
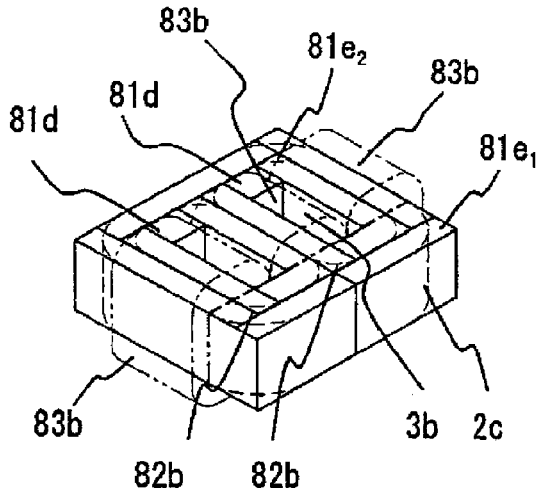
FIG. 29F is a perspective view showing the operation for reattaching the joint portion of the outer iron core after assembling the inner and outer iron cores and folding the protection member shown in FIG. 29E.
Figure 30:
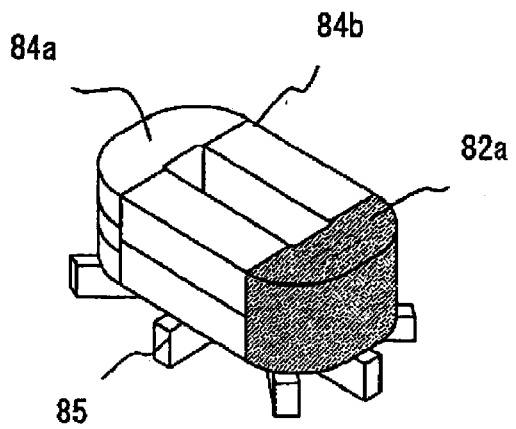
FIG. 30 is a perspective view showing the prior art method for wrapping the iron core.
Figure 31:
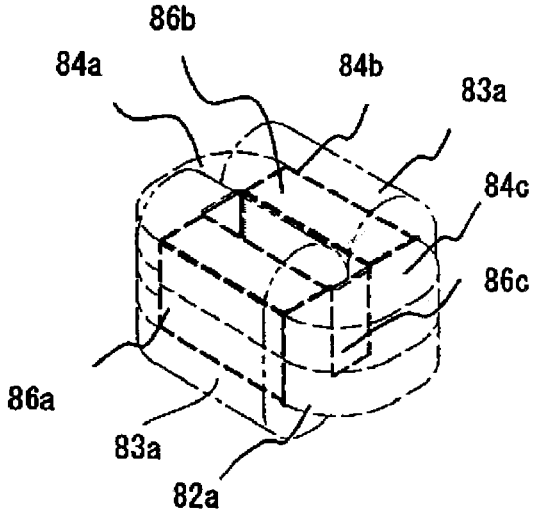
FIG. 31 is a perspective view showing the prior art structure after inserting the iron core coil.

FIGS. 29E and 29F are perspective views showing a state after the coils are inserted to a three-phase three-leg amorphous iron core. Two inner iron cores 82*b* and 82*b* illustrated in FIG. 29B covered with protection members 81$d_1$ through 81*d*, are inserted transversely into three coils 83*b*, 83*b* and 83*b*, and an outer iron core 82*c* shown in FIG. 29D is inserted to both outer side coils 83*b* and 83*b*. Thereafter, expanded sections 82$b_1$, 82$b_1$, 82$c_1$ and 82$c_1$ of the inner iron cores 82*b*, 82*b* and outer iron core 82*c* are reattached, the iron core protection members 81$d_1$, 81$d_1$ and 81$e_1$ are folded and formed to cover the joint portion being assembled and reattached, and then the protection members covering the joint portion are mutually connected and fixed to each other. At this time, the curved portions at the four corners of the outer iron core 82*c* conform the curved portions as contact surfaces on four corners of two parallel inner cores 82*b* and 82*b*, and surrounds the circumference of the inner iron core 82*b*. Further, the overhanging structures 81$d_2$ formed on the lower surface and the upper surface of the inner iron cores 82*b* and 82*b* by the protection members overhung to the outer side are connected to cover the openings formed between adjacent curved portions of inner iron cores 82*b* and 82*b* and also connected with the iron core protection member 81$e_1$, and are connected to the four corners of the outer iron core 82*c* by being fit to the respective inner corners 81$e_2$ exposed on the inner side of the outer core, so that the protection members 81$d_1$, 81$d_1$ and 81$e_1$ can be mutually assembled without any clearances formed thereto. Therefore, since the whole circumference of the amorphous iron cores 82*a* and 82*c* can be covered completely by the iron core protection members 81$d_1$ through 81$d_3$ and 81$e_1$, an amorphous iron core transformer capable of preventing scattering of amorphous material fragments can be provided with reduced work time and manufacturing costs, capable of exerting equivalent effects as the aforementioned embodiments.

Further, it is clear that the expanded drawings of the iron core protection members and the joint portions of the above-described embodiments can adopt other shapes and positions as long as it satisfies the condition that joint portions are not disposed on the contact surface with the work table.

Embodiment 10

Next, we will describe the invention related to (5) a coil winding frame for a transformer with reference to the drawings.

FIGS. 32 through 39 are explanatory views of a coil winding frame and a transformer using the same according to the present invention.

Figure 32:
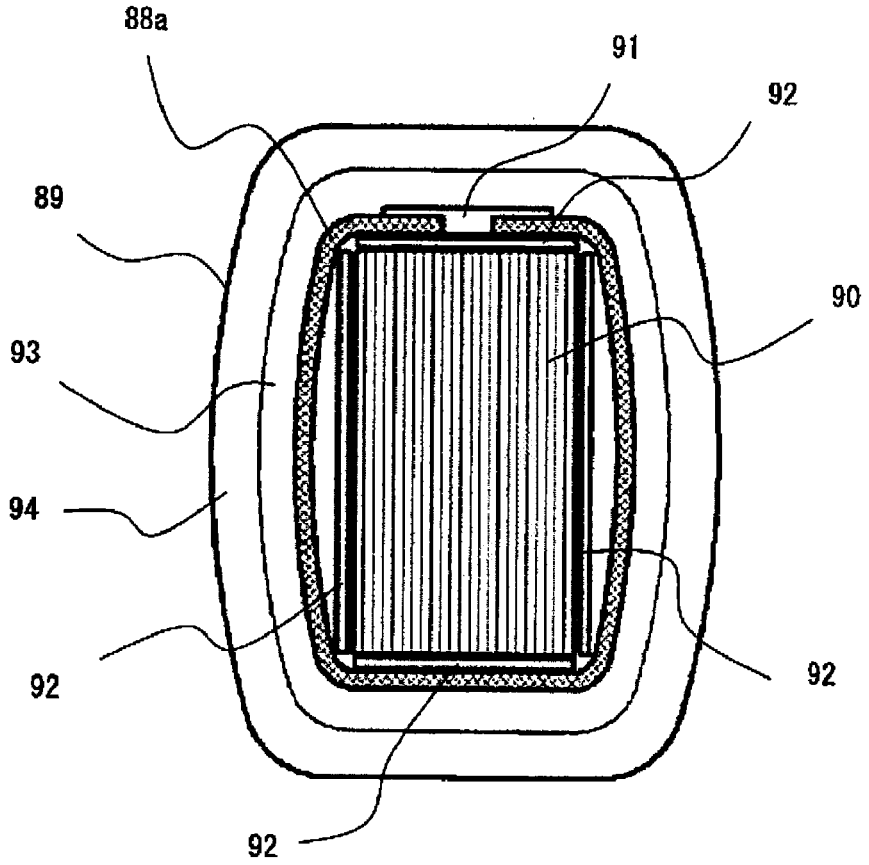
FIG. 32 is a cross-sectional view of a winding wire of the transformer according to embodiment 10 of the present invention.
Figure 33:
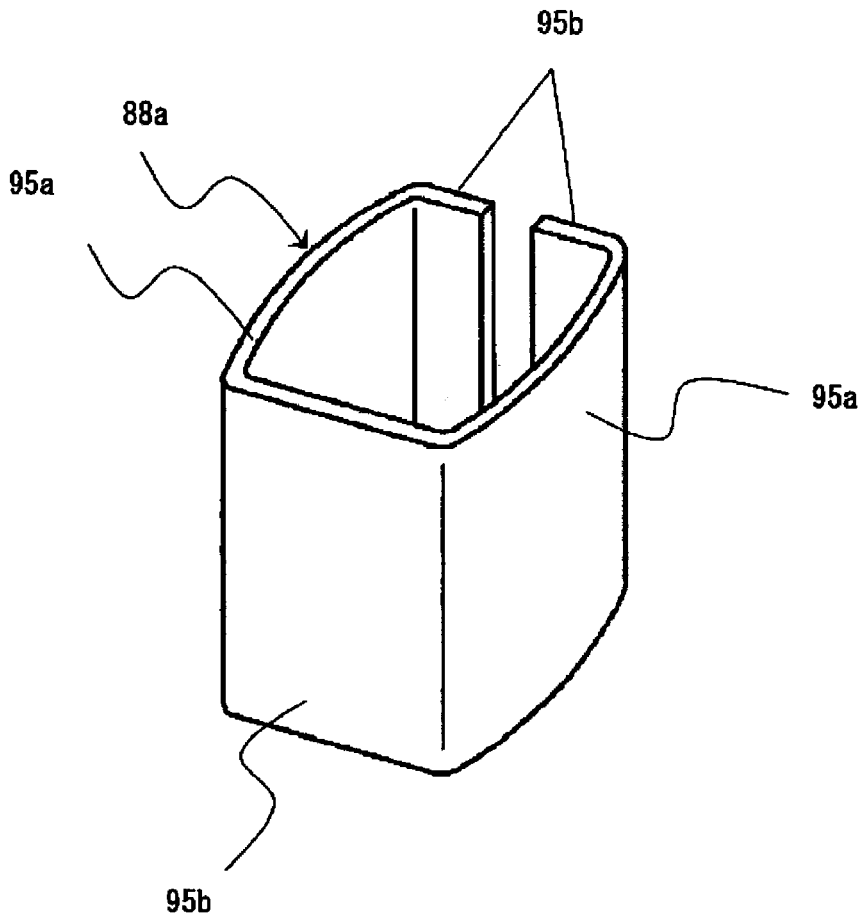
FIG. 33 is an external view showing the coil winding frame used in the transformer shown in FIG. 32.

A tenth embodiment of a transformer according to the present invention will be described with reference to FIGS. 32 and 33. FIG. 32 is a transverse cross-sectional view showing embodiment 10 of the transformer according to the present invention. FIG. 33 is an external view of a coil winding frame used for the transformer shown in FIG. 32. Hereafter, the reference numbers denoting the components used in the drawings are used in common for all the drawings related to embodiments 11 to 13.

According to embodiment 10 of the transformer shown in FIG. 32, the transformer comprises an iron core 90 and a coil 89 wound around the iron core 90. The coil 89 is composed of an inner winding wire 93 and an outer winding wire 94 wound concentrically on the outer side thereof via a main insulation. The iron core 90 can be formed for example by winding multiple layers of amorphous magnetic thin plates, but is not restricted thereto. A coil winding frame 88*a* is disposed on the inner side of the inner winding wire 93. A winding frame member insulation portion 91 is disposed on the coil winding frame 88*a* so as not to form a magnetic line loop. The iron core characteristics of the iron core 90 is sensitive to stress especially when an amorphous wound iron core is used, so spacers 92 are inserted to four sides of the iron core 90 between the iron core 90 and the coil winding frame 88*a* to prevent the coil winding frame 88*a* from applying force to the iron core 90.

According to the transformer structure, if the coil winding frame has a rectangular cross-sectional shape, if short circuit occurs to the load side of the transformer and short-circuit current is generated in the coil 89, an electromagnetic mechanical force is applied to the inner side of the inner winding wire 93, and the coil winding frame is buckled toward the inner side so as to dent toward the iron core 90. The buckling of the coil winding frame 88*a* occurs so that the center of the side corresponding to the long side in the cross-section is dented further than the short side. When buckling occurs to the coil winding frame 88*a*, the coil 89 is deformed, and the buckling causes pressure to be applied to the iron core 90*m*, deteriorating iron loss and excitation current.

According to the present invention, in order to prevent buckling of the coil winding frame, the coil winding frame 88*a* having a bow-like cross-sectional shape is used. FIG. 33 is an external view of a coil winding frame 88*a* used for the transformer illustrated in FIG. 32. As shown in FIGS. 32 and 33, the coil winding frame 88*a* is formed so that the coil winding frame portions 95*a* and 95*a* of the long sides in the cross section where buckling is likely to occur is formed in a bow-like cross-sectional shape expanded to the outer side. Such bow-like cross-sectional shape resists against the center section of the coil winding frame portions 95*a* and 95*a* from denting toward the iron core 90. In other words, in order for the coil winding frame portions 95*a* and 95*a* to be dented and buckled to the inner side, a force strong enough to deform the frame against the expanded portions expanded to outward in a bow-like shape is required, so that it can be recognized that the buckling strength is increased. As for the coil winding frame sections 95*b* and 95*b* on the short sides of the cross-sectional shape, buckling itself is relatively not likely to occur, so they are formed of flat surfaces. The buckling strength of the bow-like coil winding frame 88*a* can be improved by approximately 30% than the prior art rectangular coil winding frame.

Embodiment 11

Figure 34:
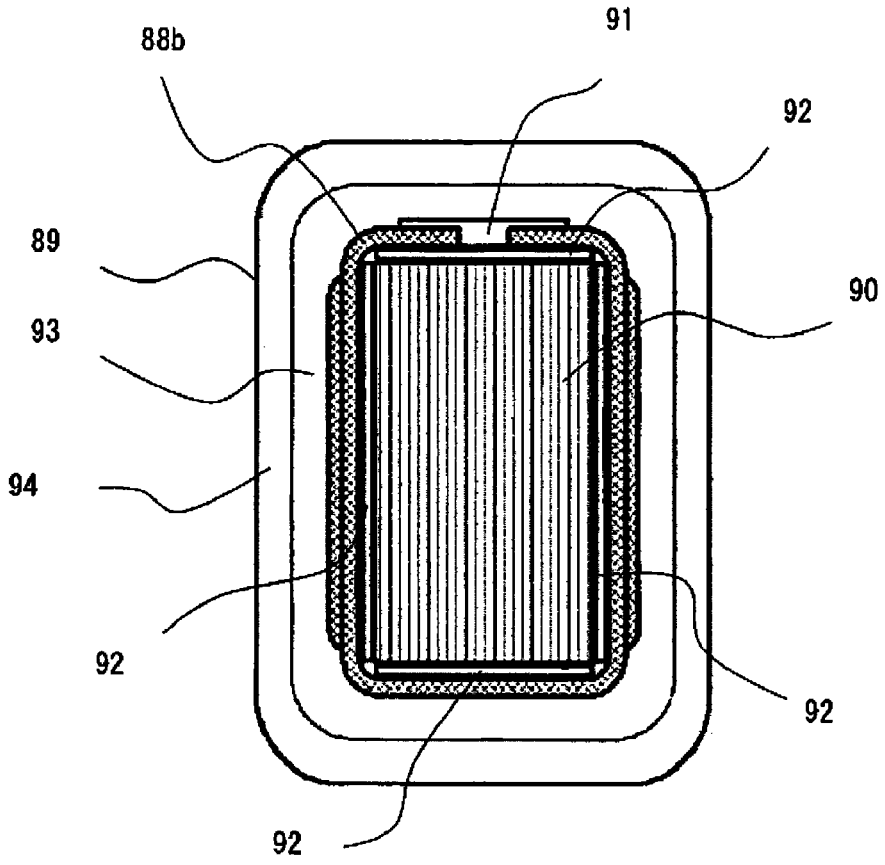
FIG. 34 is a cross-sectional view of the winding wire of the transformer according to embodiment 11 of the present invention.
Figure 35:
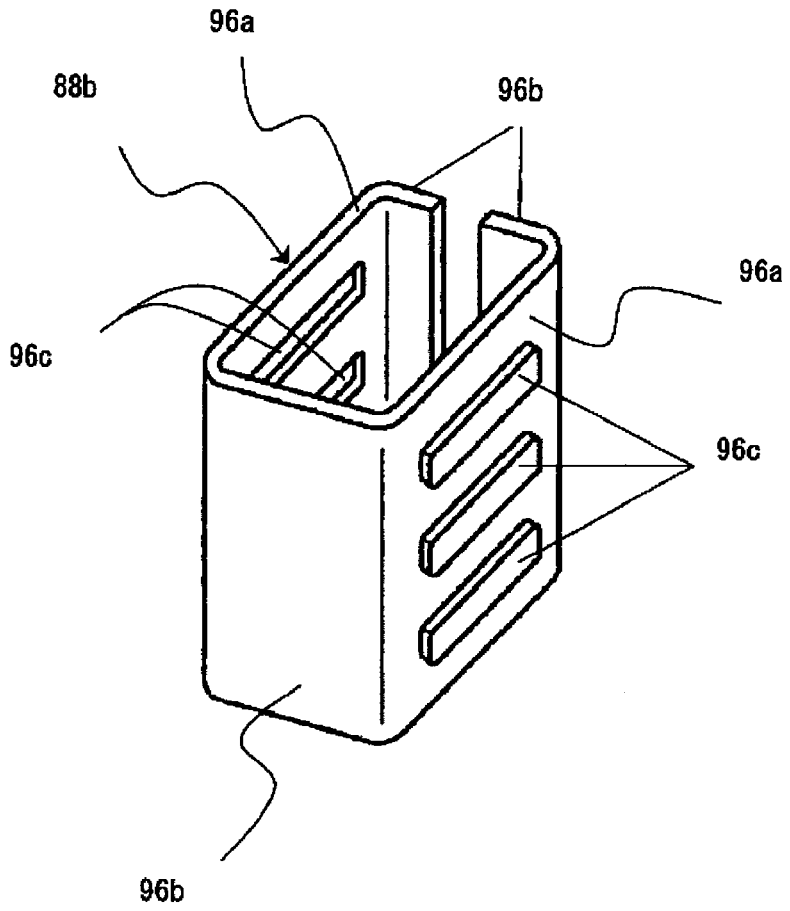
FIG. 35 is an external view of the coil winding frame used in the transformer shown in FIG. 34.

An eleventh embodiment of a transformer according to the present invention will be described with reference to FIGS. 34 and 35. FIG. 34 is a transverse cross-sectional view illustrating embodiment 11 of the transformer according to the present invention. FIG. 35 is an external view of the coil winding frame used in the transformer shown in FIG. 34. In embodiment 11, the coil winding frame 88*b* is subjected to extrusion machining 96*c*, but the other structures are the same as embodiment 10. As shown in FIG. 35, extrusion machining 96*c* is provided at multiple locations on the long sides in the cross section of the coil winding frame portions 96*a* and 96*a* easily buckled and therefore requiring strength against buckling. The coil winding frame portions 96*a* and 96*a* tend to receive bending deformation force to buckle the center section to the inner side in a dented state, but the extrusion machining 96*c* exerts an effect to resist against such bending and improve the buckling strength of the coil winding frame 88*b*.

The buckling strength of the coil winding frame 88*b* subjected to extrusion machining is improved by approximately 60% compared to the prior art rectangular coil winding frame. Further, since the buckling strength can be varied by the shape of the extrusion machining, the processing shape of the extrusion machining can be determined to correspond to the magnetic mechanical force generated from the inner winding wire 93.

Embodiment 12

Figure 36:
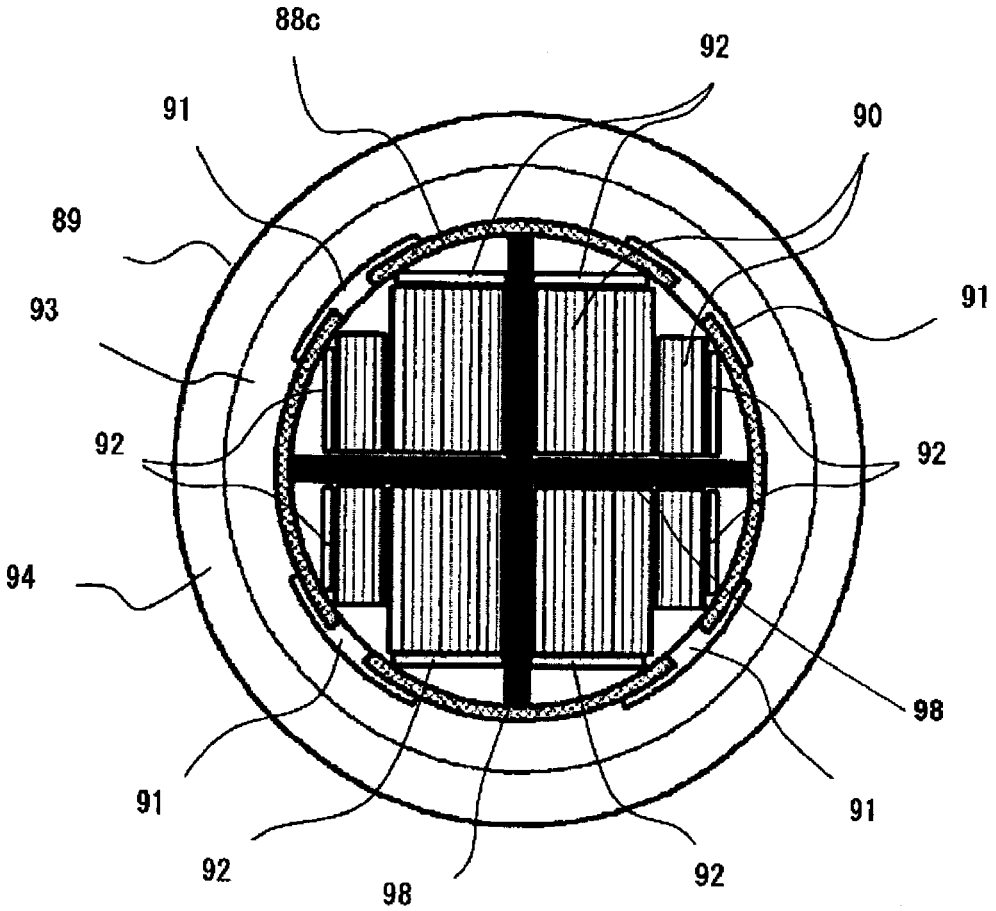
FIG. 36 is a cross-sectional view of a winding wire of the transformer according to embodiment 12 of the present invention.
Figure 37:
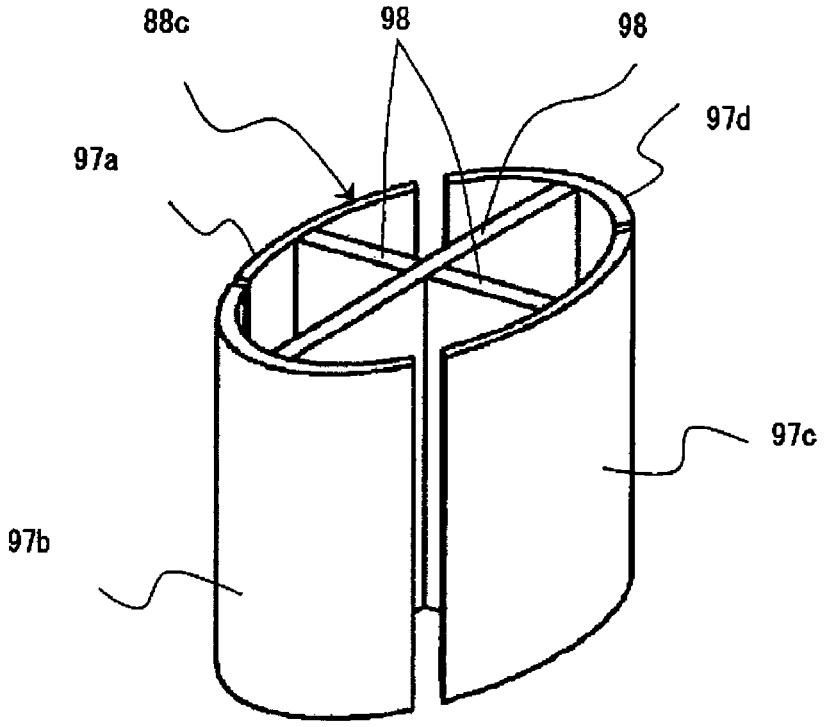
FIG. 37 is an external view of the coil winding frame used in the transformer shown in FIG. 36.

A twelfth embodiment of the transformer according to the present invention will be described with reference to FIGS. 36 and 37. FIG. 36 is a transverse cross-sectional view showing embodiment 12 of the transformer according to the present invention. FIG. 37 is an external view of the coil winding frame used from the transformer shown in FIG. 36. In embodiment 12, the coil winding frame 88*c* is formed as a cylinder with supporting posts 98 and 98 disposed on the center hollow portion, wherein the other structures are the same as embodiment 10. The coil winding frame 88*c* has a cylindrical profile, but it is discontinued via insulation portions 91 at four regular intervals. The coil winding frame 88*c* and the supporting posts 98 and 98 are formed of metal panels, wherein the coil winding frame 88*c* is connected via welding to the side ends of the support posts 98 and 98 at angular positions separated by 45 degrees around the center from the insulation portions 91, and the supporting posts 98 and 98 are formed for example by being assembled in a cross shape via welding. The iron core 90 is formed by assembling a large (large area) portion and a small (small area) portion for filling the space within the coil winding frame 88*c*. As for the spacers 92, the large portion and the small portion are arranged in a relatively wide area facing the inner side of the coil winding frame 88.

The cylindrical coil winding frame 88*c* is composed of four cylindrical parts of coil winding frames 97*a*, 97*b*, 97*c* and 97*d*, and the respective coil winding frames 97*a* through 97*d* are arched toward the outer side, so that it has high strength against buckling to the inner side caused by the force in the compression direction, and since it is reinforced from the inner side via supporting posts 98 and 98 assembled in a cross-shape, the buckling strength is improved further. Moreover, the supporting posts 98 and 98 improve not only the buckling strength but also the workability for inserting the iron core 90 to the coil 89 during assembly.

Embodiment 13

Figure 38:
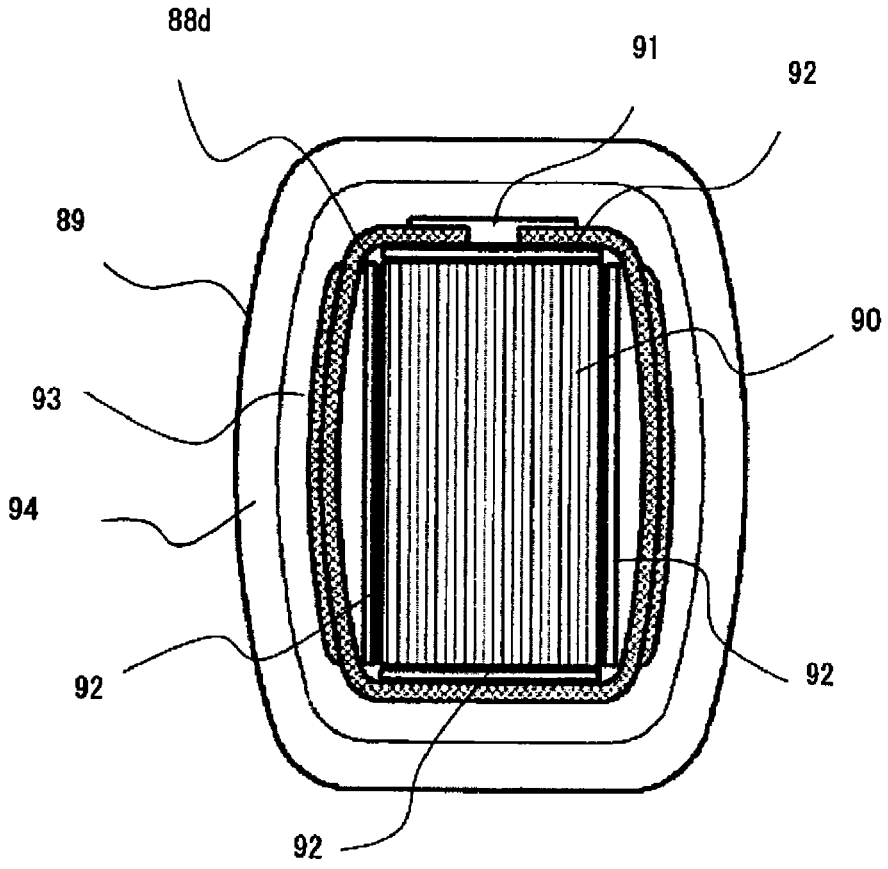
FIG. 38 is a cross-sectional view of the winding wire of the transformer according to embodiment 13 of the present invention.
Figure 39:
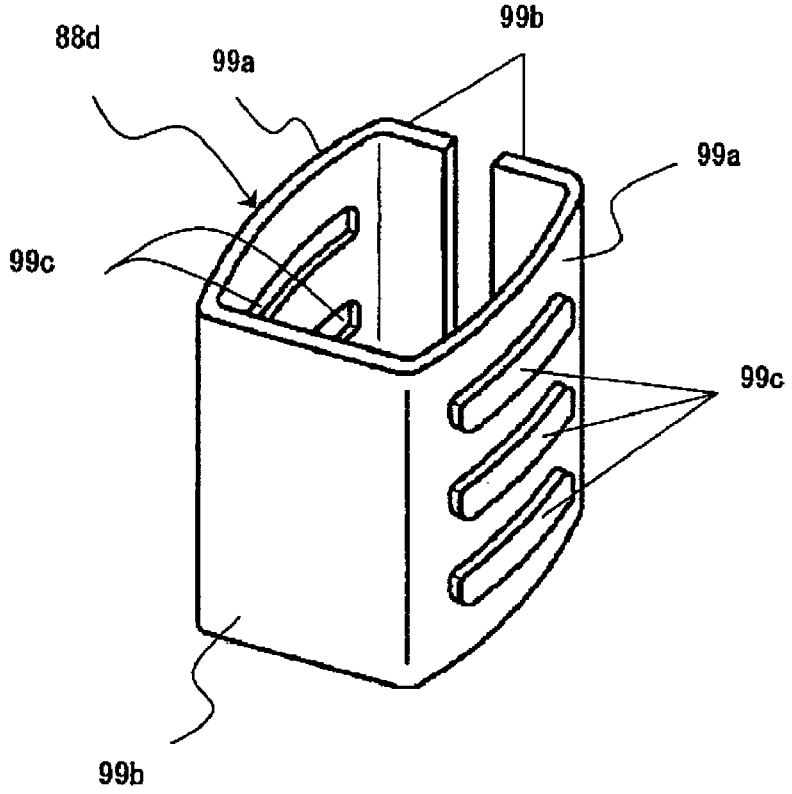
FIG. 39 is an external view of the coil winding frame used in the transformer shown in FIG. 38.
Figure 40:
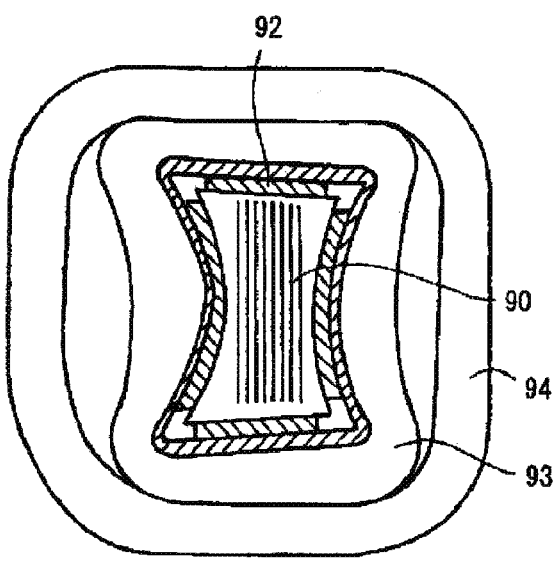
FIG. 40 is a cross-sectional view showing the state of buckling of the coil winding frame used in the prior art transformer.

A thirteenth embodiment of the transformer according to the present invention will be described with reference to FIGS. 38 and 39. FIG. 38 is a transverse cross-sectional view showing embodiment 13 of the transformer according to the present invention. FIG. 39 is an external view of the coil winding frame used in the transformer shown in FIG. 38. In embodiment 13, similar to embodiment 10, the coil winding frame 88*d* adopts a bow-like shape expanded to the outer side, and further, similar to embodiment 11, multiple extrusion machining 99*c* is applied to the outer side of the coil winding frames 99*a* and 99*a* on the long sides.

The transformer according to the present invention is not restricted to the respective coil winding frame structures as shown in FIGS. 32 through 37, but can be applied to assembled structures such as a bow-like coil winding frame subjected to extrusion machining as shown in FIGS. 38 and 39. Further, it is possible to provide extrusion machining shown in embodiment 11 to the cylindrical coil winding frame shown in embodiment 12.

Next, the invention of (6) a shell-type amorphous transformer is described with reference to the drawings.

Embodiment 14

Figure 41A:
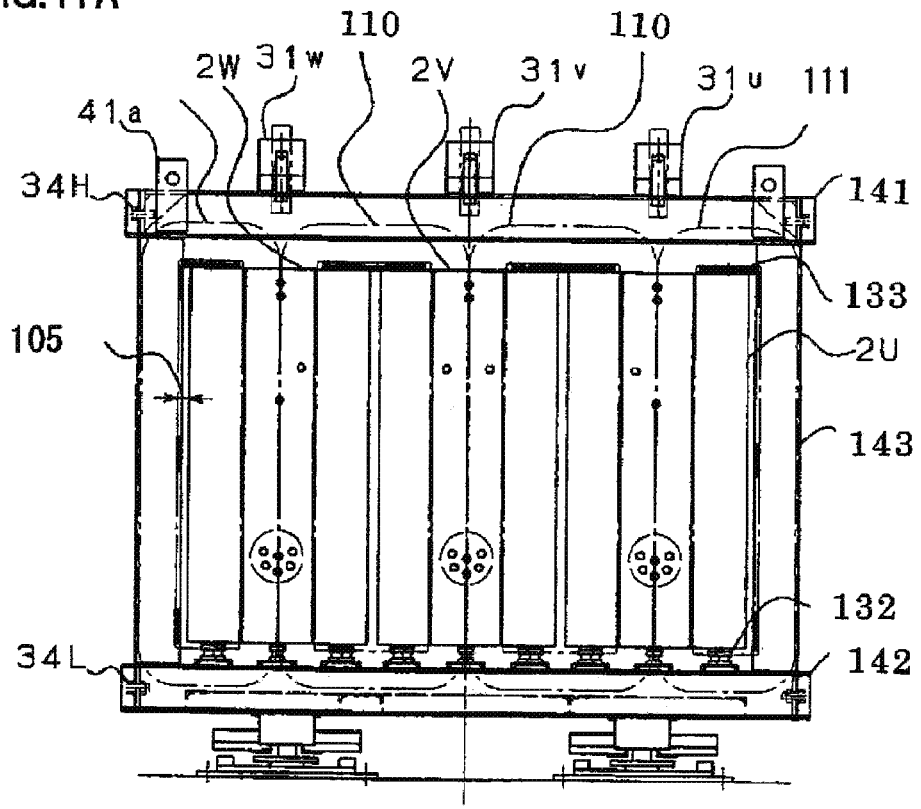
FIG. 41A is a front view showing a shell-type amorphous transformer according to embodiment 14 of the present invention, which is an amorphous mold transformer having a three-phase five-leg wound iron core structure for receiving and distributing high pressure.
Figure 41B:
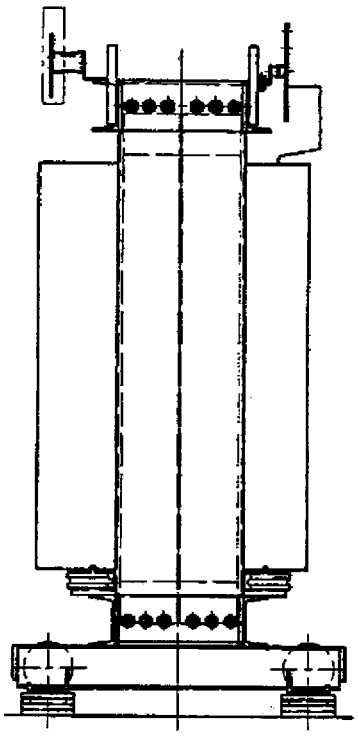
FIG. 41B is a side view of the shell-type amorphous mold transformer according to FIG. 41A.
Figure 41C:
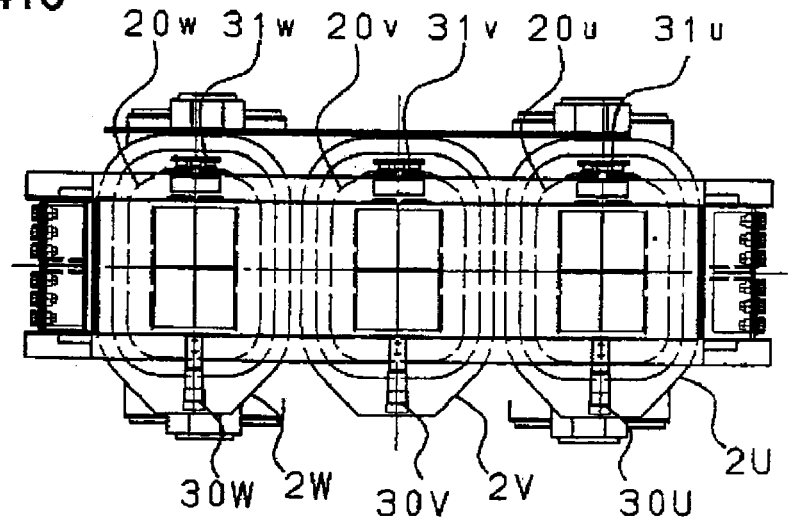
FIG. 41C is an upper view of the shell-type amorphous mold transformer according to FIG. 41A.

FIGS. 41A through 41C show a fourteenth embodiment of a shell-type amorphous mold transformer. FIG. 41A is a front view of the shell-type amorphous mold transformer, FIG. 41B is a side view thereof, and FIG. 41C is an upper view thereof. The amorphous mold transformer having a three-phase five leg wound iron core structure shown in FIGS. 41A through 41C is mainly composed of an inner iron core 110, an outer iron core 111, primary coils 2U, 2V and 2W, secondary coils 20*u*, 20*v* and 20*w*, primary terminals 30U, 30V and 30W, secondary terminals 31*u*, 31*v* and 31*w*, a coil support 132, an iron core support 133, an upper bracket 141, a lower bracket 142 and a side bracket 143.

Since the primary coils 2U, 2V and 2W and the secondary coils 20*u*, 20*v* and 20*w* isolated electrically are magnetically connected via the inner iron core 110 and the outer iron core 111, so that the winding ratio of the primary coil and the secondary coil is reflected as the voltage ratio and is voltage-converted. In a most standard transformer for receiving and distributing high pressure, the primary terminals 30U, 30V and 30W receive power of 6600 V, and a voltage of 210 V is induced to the secondary terminals 31*u*, 31*v* and 31*w*. The user of the transformer uses the transformer by connecting loads to the secondary terminals 31*u*, 31*v* and 31*w*.

The inner iron core 110 and the outer iron core 111 are placed via an iron core support 133 on primary coils 2U, 2V and 2W and secondary coils 20*u*, 20*v* and 20*w*. The primary coils 2U, 2V and 2W and the secondary coils 20*u*, 20*v* and 20*w* are placed via a coil support 132 on the lower bracket 142. The lower bracket 142 is connected via bolts to the side bracket 143 (in the drawing, six bolts 34H and 34L are used at respective connecting sections), and the side bracket 143 is connected via a similar bolt connection to the upper bracket 141. The upper bracket 141 has a lifting lug 41*a* formed on the outer side for suspending the same. Therefore, the load of the inner cores 110 and the outer cores 111 and the load of the primary coils 2U, 2V and 2W and the secondary coils 20*u*, 20*v* and 20*w* are transmitted via the lower bracket 142, the side bracket 143 and the upper bracket 141 to the lifting lug 41*a*, so that the main body of the transformer can be supported in a suspended manner via the lifting lug 41*a*.

Since the amorphous transformer for receiving and distributing high pressure has inner iron cores 110 and outer iron cores 111 which are amorphous iron cores formed by laminating amorphous ribbons of approximately 0.025 mm, so that the rigidity thereof is extremely small. Therefore, in a shell-type amorphous transformer in which the legs of the amorphous iron core are positioned outside the coils as in the case of a three-phase five-leg wound iron core structure, the outer side of the legs of the outer iron core (legs on the opposite side from the side arranged within the coil) may contact or come close to the high pressure primary coils via vibration during transportation or the like. Since voltage applied to the primary coil surface is a few thousandbolts while the iron core is grounded and has zero potential, so that if it is not possible to ensure a sufficient distance 5 between the primary coil and the outer iron core legs, insulation failure may occur.

Figure 42A:
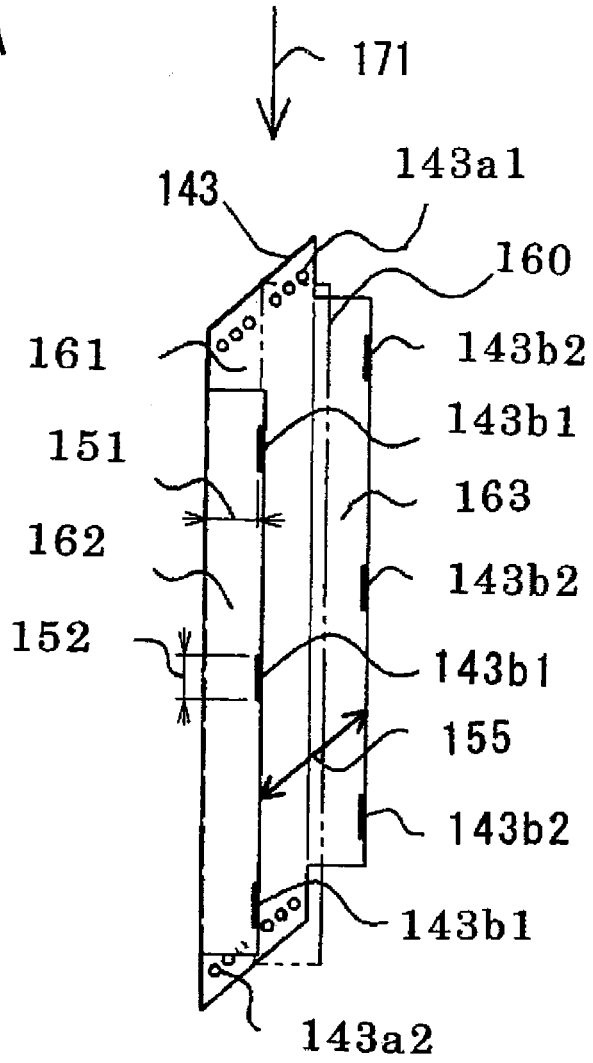
FIG. 42A is a perspective view of a side bracket according to a shell-type amorphous transformer shown in FIG. 41.
Figure 42B:
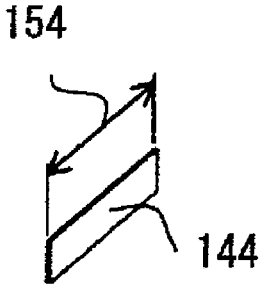
FIG. 42B is a perspective view showing the iron core support panel used in the side bracket shown in FIG. 42A.
Figure 42C:
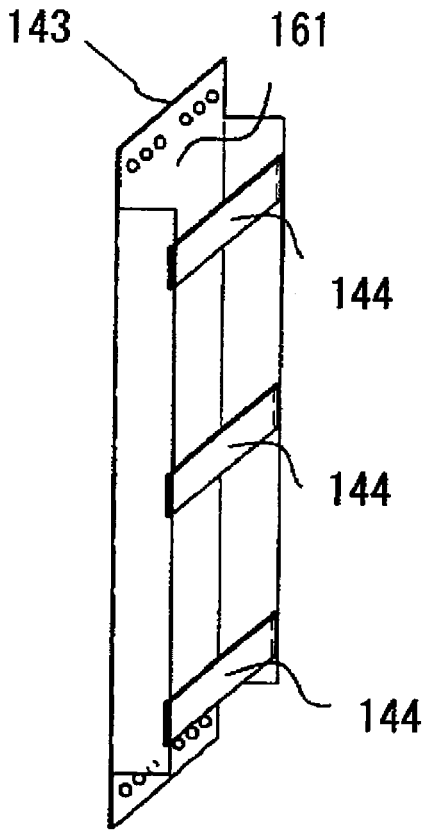
FIG. 42C is a perspective view of the side bracket equipped with the iron core support panel shown in FIG. 42B.

The shell-type amorphous transformer (embodiment 14) according to the present invention will be described with reference to FIGS. 42A through 42C. FIGS. 42A through 42C are perspective views illustrating a shell-type amorphous transformer, wherein FIG. 42A shows a side bracket, FIG. 42B shows an iron core protection plate used for the side bracket, and FIG. 42C shows a side bracket having the iron core protection plates. Embodiment 14 adopts a side bracket structure without using iron core covers 10*a* and 11*a* for ensuring a predetermined distance 5 between the primary coil and the outer iron core legs.

FIG. 42A shows a side bracket 43 prior to assembling the transformer, which is a member formed of iron having a "U-shape" when viewed from arrow 71. The "U-shaped" side bracket 143 is composed of a main face plate 161 constituting a side wall of the transformer and two side face plates 162 and 163 connected perpendicularly to the main face plate 161. Holes 43*a*1 and 43*a*2 are formed on upper and lower areas of the main face plate 161. The holes 43*a*1 are for inserting bolts 34H for connecting the upper bracket 141 with the side brackets 143 (refer to FIG. 41A), and holes 43*a*2 are for inserting bolts 34L for connecting the lower bracket 142 with the side brackets 143 (refer to FIG. 41A).

On two side face plates 162 and 163 are formed a plurality of long rectangular holes 43*b*1 and 43*b*2 along the sides opposite from the connecting sides connected perpendicularly with the main face plate 161. The same number of holes 43*b*1 and 43*b*2 are disposed at symmetrical positions with respect to a surface 160 perpendicular to the main face plate 161 and passing the center in the depth direction of the main face plate 161.

In the present embodiments, three holes 43*b*1 and three holes 43*b*2 are disposed respectively on the side face plates 162 and 163, but the safety of ensuring a distance 105 between the primary coil and outer iron core leg portions increases as the number of holes increases or as the length 152 of the long side of the rectangular holes increases.

Figure 45A:
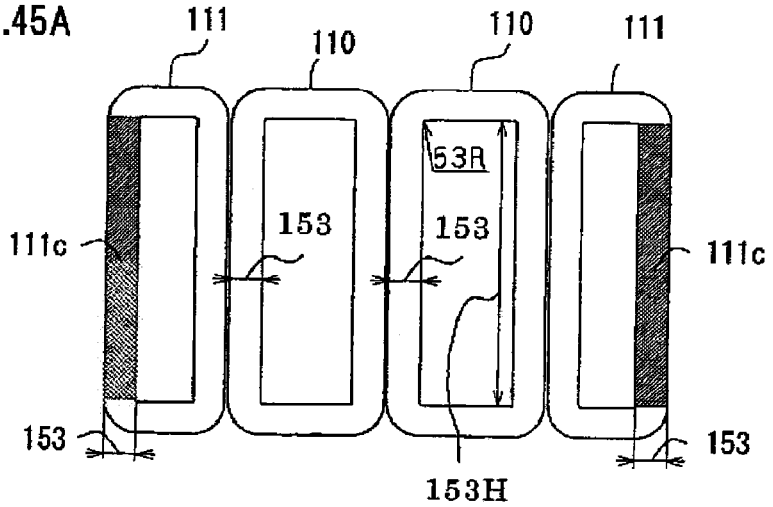
FIG. 45A is a view showing one example of a three-phase five-leg amorphous wound iron core according to the prior art.

The minimum distance 151 from the holes 43*b*1 and 43*b*2 to the main face plate 161 is set longer than the laminated thickness 153 of the iron core (refer to FIG. 45A). Therefore, the outer iron core leg portion 11*c* can be disposed on the inner side of the area surrounded by the main face plate 161 and two side face plates 162 and 163 and denoted by distance 151. Iron core support panels 44 shown in FIG. 42B is passed through the holes 43*b*1 and 43*b*2 as shown in FIGS. 41A and 42C. The iron core support panels 144 are formed of insulation materials so that the side bracket 143 does not form a loop through which current flows. FIG. 42C omits the drawing of an outer iron core leg portion 11*c*, but actually, an outer iron core leg portion 11*c* is disposed between the main face plate 161 and the iron core support panel 144. The length 154 of the iron core support panels 144 is the same as the length 155 between two side face plates 162 an 163 or longer, and the iron core support panels 144 are fixed via silicon rubber or other adhesives at areas where the holes 43*b*1 and 43*b*2 are formed. According to the present arrangement, it becomes possible to ensure a predetermined distance as the distance 105 between the primary coil and the outer iron core leg portion.

Embodiment 15

Another example (embodiment 15) of a shell-type amorphous transformer according to the present invention will be described with reference to FIGS. 43A through 43C. FIG. 43 is a perspective view showing another example of the shell-type amorphous transformer, FIG. 43A shows a side bracket thereof, FIG. 43B shows an iron core support panel used with the side bracket, and FIG. 43C shows a side bracket equipped with the iron core support panel.

Figure 43A:
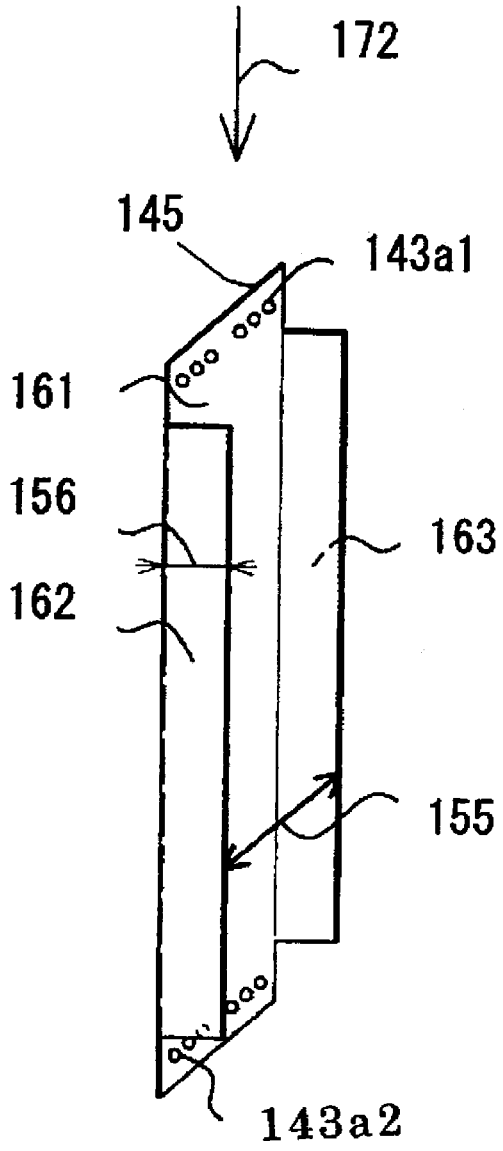
FIG. 43A is a perspective view of the side bracket of a shell-type amorphous transformer according to embodiment 15 of the present invention.
Figure 43B:
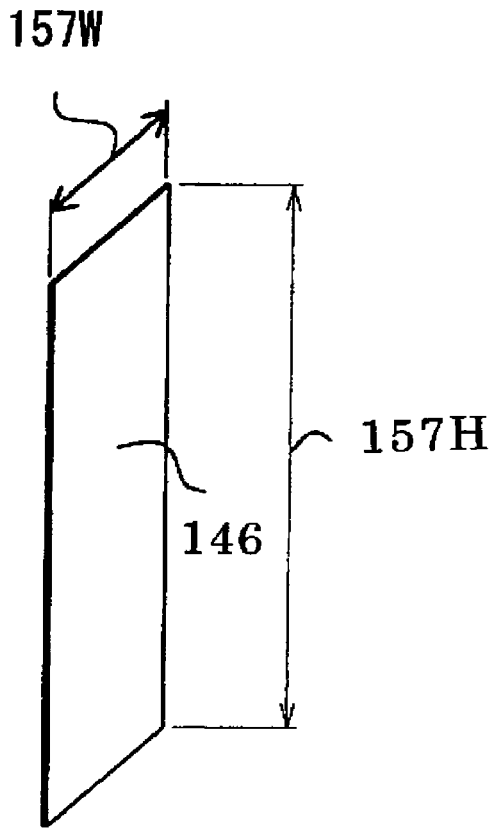
FIG. 43B is a perspective view showing the iron core support panel used in the side bracket shown in FIG. 43A.
Figure 43C:
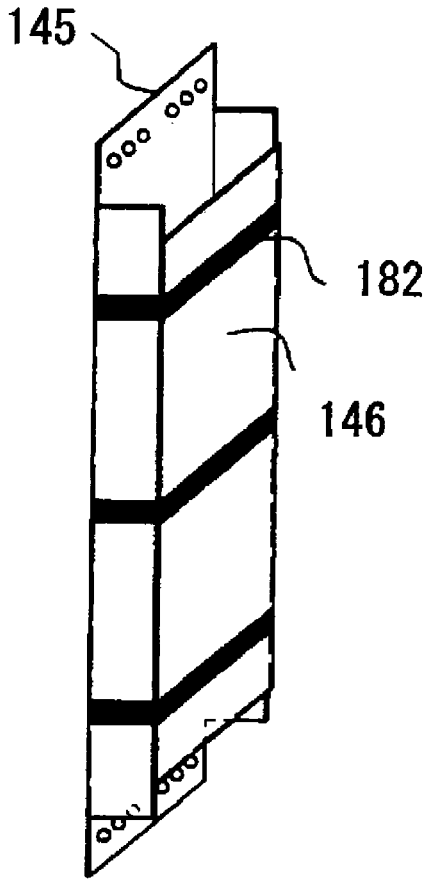
FIG. 43C is a perspective view of a side bracket equipped with an iron core support panel shown in FIG. 43B.

The bracket shown in FIG. 43A is a side bracket 145 according to embodiment 15 prior to assembling the transformer, which is a member formed of iron having a "U-shape" when viewed from arrow 172. This side bracket 143 with a "U-shaped" structure is composed of a main face plate 161 forming a side wall of the transformer and two side face plates 162 and 163 connected perpendicularly to the main face plate 161. Holes 43*a*1 and 43*a*2 are formed near the upper edge and the lower edge of the main face plate 161. The holes 43*a*1 are for inserting bolts 34H (refer to FIG. 41) for connecting the upper bracket 141 and the side bracket 145, and holes 43*a*2 are for inserting bolts 34L (refer to FIG. 41) for connecting the lower bracket 142 and the side bracket 145.

Figure 45B:
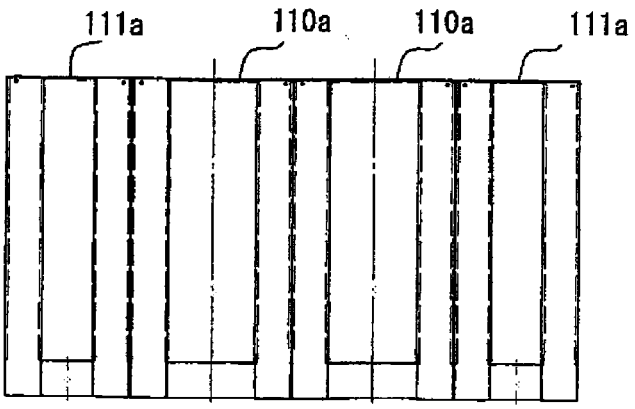
FIG. 45B is a view showing one example of the iron core cover for the three-phase five-leg amorphous wound iron core according to FIG. 45A.
Figure 45C:
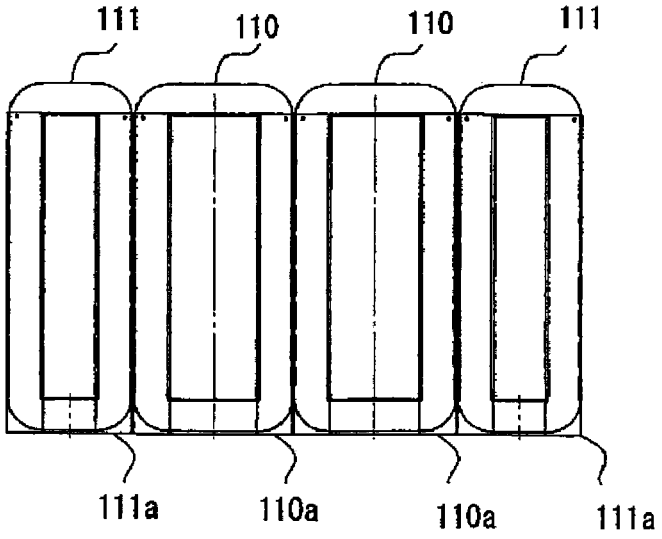
FIG. 45C is a view showing one example of the three-phase five-leg amorphous wound iron core in which the amorphous iron core shown in FIG. 45A is equipped with the iron cover core shown in FIG. 45B.

The width direction length 156 of the side face plates 162 and 163 of the side bracket 145 is set longer than the laminated thickness 153 of the iron core (refer to FIG. 45). Therefore, it becomes possible to arrange the outer iron core leg portion 11*c* inside the area surrounded by the main face plate 161 and two side face plates 162 and 163. In the side bracket 145, an insulating iron core support panel 146 shown in FIG. 43B is disposed on one side not forming the U-shape of the side bracket 145 (the side between leading ends of two side face plates 162 and 163). The iron core support panel 146 and the side bracket 145 cover the outer iron core leg portion 11*c* as shown in FIG. 43C. FIG. 43C omits the view of the outer iron core leg portion 11*c*. The height length 57H of the iron core support panel 146 is either equal to or shorter than the linear length having subtracted double the length of the inner-window corner radius 53R from the inner height 53H of the iron core window, and the width direction length 57W of the iron core support panel 146 is either equal to or longer than the length 155 between the side face plates 162 and 163. The iron core support panel 146 is either fixed via silicon rubber or other adhesives to the side bracket 45 or fixed by winding tapes 82 (FIG. 43C) to three areas or so in the height direction of the side bracket 145. The present arrangement enables to ensure a predetermined distance as the distance 5 between the primary coil and the outer iron core leg portion.

Embodiment 16

Figure 44A:
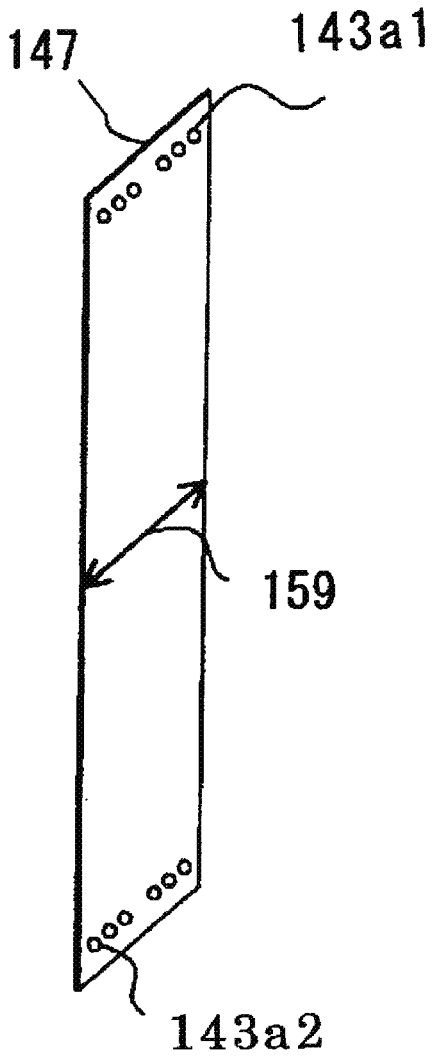
FIG. 44A is a perspective view showing the side bracket of a shell-type amorphous transformer according to embodiment 16 of the present invention.
Figure 44B:
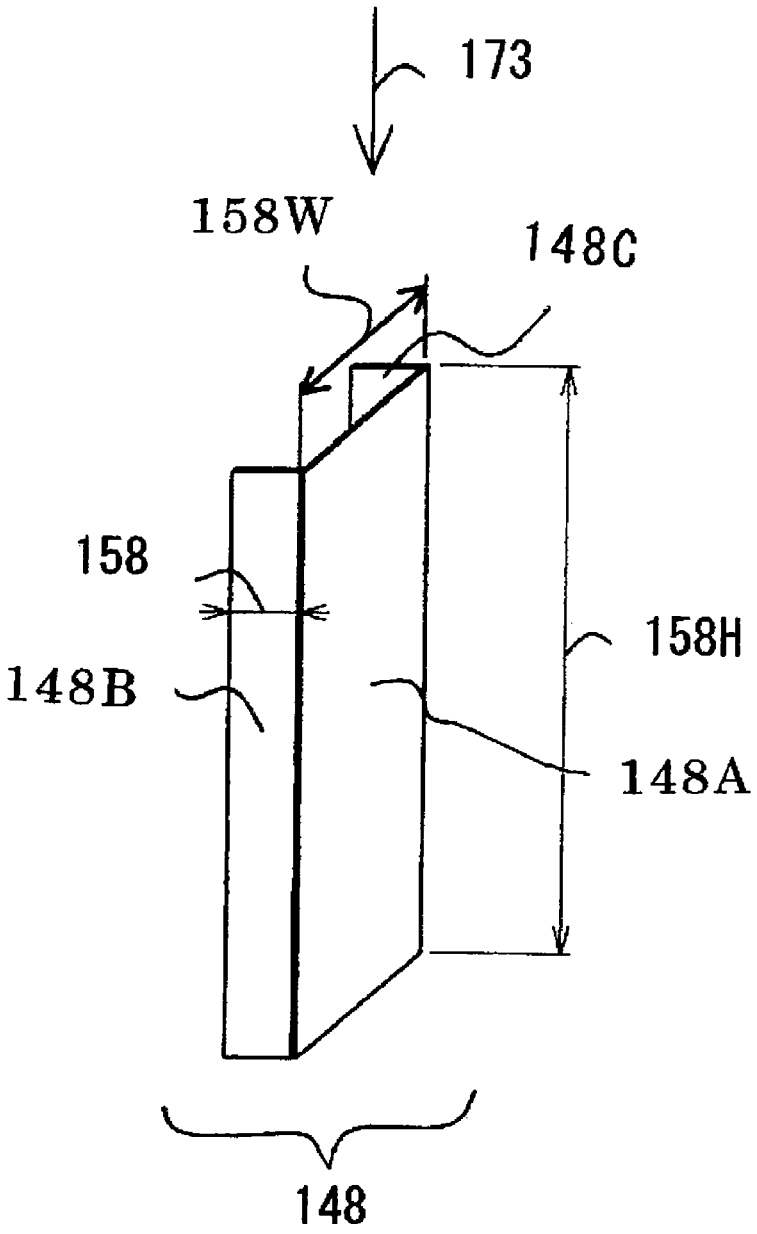
FIG. 44B is a perspective view of the iron core support panel used in the side bracket shown in FIG. 44A.
Figure 44C:
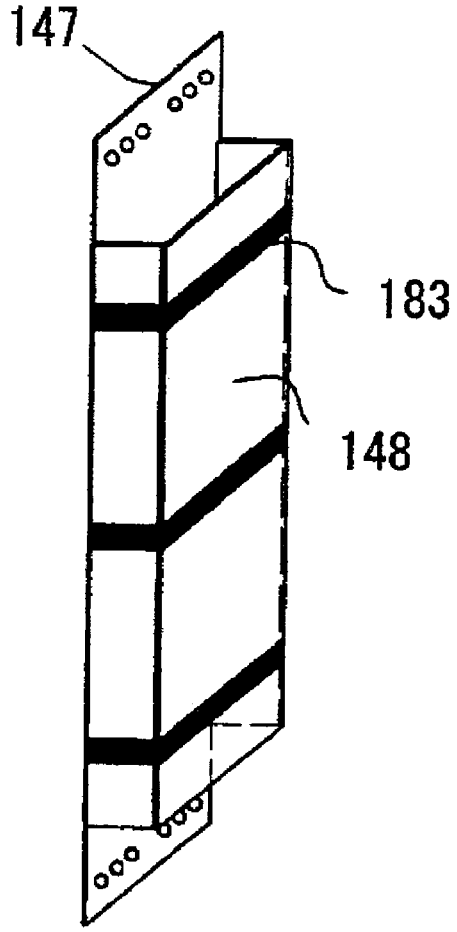
FIG. 44C is a perspective view of the side bracket equipped with the iron core support panel shown in FIG. 44B.

A yet another example (embodiment 16) of a shell-type amorphous transformer according to the present invention will be described with reference to FIGS. 44A through 44C. FIGS. 44A through 44C are perspective views showing yet another example of the shell-type amorphous transformer, wherein FIG. 44A shows a side bracket, FIG. 44B shows an iron core retention member used for the side bracket, and FIG. 44C show a side bracket equipped with the iron core support panel.

The bracket shown in FIG. 44A is a side bracket 47 according to embodiment 16 prior to assembling the transformer, which is a single plate-shaped iron member. The holes 43*a*1 formed near the upper edge are for inserting bolts 34H (refer to FIG. 41A) for connecting the upper bracket 141 and the side bracket 147, and the holes 43*a*2 formed on the lower edge are for inserting bolts 34L (refer to FIG. 41A) for connecting the lower bracket 142 and the side bracket 147.

The member shown in FIG. 44B is an iron core retention member 148 for retaining the leg portion of the outer iron core according to embodiment 16, formed in a "U-shape" when viewed from the arrow 73. The iron core retention member 148 is formed of plate-shaped insulation members 148A, 148B and 148C, which are fixed via silicon rubber or other adhesives and formed in a "U-shape". The width direction length 158 of the insulation members 148B and 148C is longer than the laminated thickness 153 of the iron core (refer to FIG. 45A). The height direction length 158H of the iron core retention member 148 is either equal to or shorter than the linear length having subtracted double the length of the inner-window corner radius 53R from the inner height 53H of the iron core window, and the width direction length 158W of the insulation member 148A is either equal to or shorter than the width direction length 159 of the side bracket 147. The side bracket 147 and the iron core retention member 148 are arranged as shown in FIG. 44C, and the outer iron core leg portion 11*c* is disposed in the area covered by these members. The view of the outer iron core leg portion 11*c* is omitted in FIG. 44C. The side bracket 147 and the iron core retention member 148 are either fixed via silicon rubber or other adhesives or fixed by winding tapes 183 (FIG. 44C) to three areas or so in the height direction of the side bracket 147. The present arrangement enables to ensure a predetermined distance as the distance 5 between the primary coil and the outer iron core leg portion.

EXPLANATION OF REFERENCES

1: pole-mounted transformer,
2: winding wire
3: wound iron core
11-14: magnetic materials with different magnetic permeability
L1-5: block formed of material 11
A1-5: block formed of material 14

105*a*, 105*b*: amorphous iron core transformer
31: iron core
31*a*: inner circumference of iron core
31*b*: outer circumference of iron core
31$a_{11}$, 31$a_{12}$, . . . , 31$a_{1n}$, 31$b_{22}$, 31$b_{12}$, . . . , 31$b_{1p}$: block-like laminated member
31$a_1$, 31$b_1$: group of block-like laminated members
32*a*, 32*b*: coil
41, 42, 43: sheet-like non-magnetic insulation material
51: jig for forming ring shape
51': jig for forming ring shape doubling as jig for preventing deformation
52*a*, 52*b*, 52*c*, 52*d*: jig for preventing deformation
1000$_A$, 1000$_B$: transformer
60, 60*a*, 60*b*, 60$_A$, 60$_B$, 60$_{A1}$, 60$_{B1}$, 60$_{C1}$, 60$_{D1}$, 60$_{D2}$, 60$_{D3}$, 60$_{D4}$: iron core
62, 62*a*, 62*b*: coil
68: winding frame
60$a_{11}$, 60$a_{12}$, 60$b_{11}$, 60$b_{12}$: long side of iron core
60$a_{21}$, 60$a_{22}$, 60$b_{21}$, 60$b_{22}$: short side of iron core
60$a_{C1}$-60$a_{C4}$, 60$b_{C1}$-60$b_{c4}$: corner portion of iron core
70$a_{11}$-70$a_{1n1}$, 70$a_{21}$-70$a_{2n2}$, 70$a_{31}$-70$a_{3n3}$, 70$b_{11}$-70$b_{1n1}$, 70$b_{21}$-70$b_{2n2}$,
70$_{31}$-70$_{3n3}$, 70$_{11}$-70$_{1n1}$, 70$_{21}$-70$_{2n2}$, 70$_{31}$-70$_{3n3}$, 70$_{a1}$, 70$_{0A}$, 70$_B$, 70$_C$: connecting section
65*a*, 65*b*, 65*c*: retention member
67*a*, 67*b*, 67*a*, 67*b*, 67*c*, 67*d*: reinforcement member
65: sheet-like insulation material
61, 71: thermosetting or light curing coating
80: pouched insulation material
90: band
100$_{A11}$, 100$_{A12}$, 100$_{A13}$, . . . , 100$_{A1n1}$, 100$_{A11}$', 100$_{A12}$', 100$_{A13}$', . . . , 100$_{A16}$': block-like laminated member
100$_{A1}$: first unit
100$_{A2}$: second unit
100$_{A111}$, 100$_{A112}$, . . . , 100A$_{11x}$: magnetic thin plate
100$_{A11t}$, 100$_{A11e}$: end surface
g, g': distance between end surfaces
81$a_1$, 81$a_2$, 81$a_3$; 81$b_1$, 81$b_2$, 81$b_3$; 81$c_1$, 81$c_2$, 81$c_3$, 81$c_4$; 81$d_1$, 81$d_2$, 81$d_3$; 81$e_1$, 81$e_2$, 81$e_3$: iron core protection member
82$a_1$, 82$b_1$; 82$c_1$, 82$c_1$: expanded section
82*a*, 82*b*, 82*c*: amorphous iron core
83*a*, 83*b*: coil
84*a*, 84*b*, 84*c*, 84*d*, 84*e*: insulation material
85: jig
86*a*, 86*b*: insulation material (for retaining insulation distance between iron core and coil)
88*a*: bow-like coil winding frame
88*b*: coil winding frame with extrusion machining
88*c*: coil winding frame having supporting posts disposed in cylinder
88*d*: bow-like coil winding frame with extrusion machining
89: coil
93: inner winding wire
94: outer winding wire
90: iron core
91: winding frame member insulating portion
92: spacer
98: supporting post
95*a*, 95*b*: coil winding frame portion
96*a*, 96*b*: coil winding frame portion
96*c*: extrusion machining
97*a*, 97*b*, 97*c*, 97*d*: coil winding frame portion
99*a*, 99*b*: coil winding frame portion
99*c*: extrusion machining
110: inner iron core
110*a*: inner iron core cover
111: outer iron core
111*a*: outer iron core cover
11*c*: outer iron core leg portion (outer side)
2U, 2V, 2W: primary coil
20*u*, 20*v*, 20*w*: secondary coil
30U, 30V, 30W: primary terminal
31*u*, 31*v*, 31*w*: secondary terminal
32: coil support
33: iron core support
34H: bolts connecting side bracket and upper bracket
34L: bolts connecting side bracket and lower bracket
141: upper bracket
42*a*: lifting lug
142: lower bracket
43, 45, 47: side bracket
43*a*1, 43*a*2: circular hole
43*b*1, 43*b*2: rectangular hole
144, 146, 148A, 148B, 148C: insulating iron core retention member (iron core support panel)
148: insulating member
105: distance between primary coil and outer iron core leg portion
151: distance between side wall of side bracket and rectangular hole
152: length of long side of rectangular hole
153: iron core laminated thickness
153H: inner height of iron core window
53R: inner corner radius of iron core window
154: insulation panel length
155, 159: depth direction length of side bracket
56: width direction length of side wall of side bracket
57W: depth direction length of insulation panel
57H: insulation panel height
58W: depth direction length of insulation member
58H: insulation member height
160: surface perpendicular to side wall of side bracket and passing the center of depth direction of side wall of side bracket
161: main face plate of side bracket
162, 163: side face plate perpendicular to main face plate constituting two sides of side bracket
171, 172, 173: arrow view viewing transformer from upper part of transformer
182, 183: tape

The invention claimed is:

1. A shell-type amorphous transformer comprising:
an amorphous iron core;
a coil;
a lower bracket for receiving load of the coil and the amorphous iron core;
an upper bracket having a lifting lug for suspending the transformer; and
a side bracket for connecting the lower bracket and the upper bracket, wherein:
the side bracket includes a main face plate and two side face plates disposed along an outer side surface and both width-direction side surfaces of the amorphous iron core,
the side bracket further includes insulating iron core support plates passing through multiple pairs of holes formed at opposing areas of the both side face plates along an inner side wall of the amorphous iron core,
the amorphous iron core has short sides and long sides longer than the short sides,
the coil is wound around one of the long sides, and the side bracket and the insulating iron core support plates cover ad support another of the long sides of the amorphous iron core.

2. The shell-type amorphous transformer according to claim 1, wherein the iron core support panel passed through the hole is fixed via an adhesive.

3. The shell-type amorphous transformer according to claim 1, wherein:

the amorphous iron core has four side walls, one of the four side walls being the inner side wall, and the side bracket covers three side walls of the amorphous iron core and the insulating iron core support plates covers only the inner side wall.

4. The shell-type amorphous transformer according to claim 2, wherein the adhesive is silicon rubber.

* * * * *